US012520931B2

(12) United States Patent
Elliott

(10) Patent No.: US 12,520,931 B2
(45) Date of Patent: Jan. 13, 2026

(54) ROTATING BRISTLE DEVICE AND METHOD OF USE

(71) Applicant: F.G. Elliott LLC, State College, PA (US)

(72) Inventor: Franklin Elliott, State College, PA (US)

(73) Assignee: F.G. ELLIOTT LLC, State College, PA (US)

( * ) Notice: Subject to any disclaimer, the term of this patent is extended or adjusted under 35 U.S.C. 154(b) by 364 days.

(21) Appl. No.: 18/117,652

(22) Filed: Mar. 6, 2023

(65) Prior Publication Data

US 2023/0200525 A1 Jun. 29, 2023

Related U.S. Application Data

(63) Continuation-in-part of application No. PCT/US2021/049218, filed on Sep. 7, 2021.

(60) Provisional application No. 63/316,602, filed on Mar. 4, 2022, provisional application No. 63/208,156, filed on Jun. 8, 2021, provisional application No. 63/074,787, filed on Sep. 4, 2020.

(51) Int. Cl.

| | |
|---|---|
| ***A46B 13/00*** | (2006.01) |
| ***A45D 20/50*** | (2006.01) |
| ***A46B 13/02*** | (2006.01) |

(52) U.S. Cl.

CPC ..... *A46B 13/005* (2013.01); *A45D 20/50* (2013.01); *A46B 13/02* (2013.01); *A46B 2200/104* (2013.01)

(58) Field of Classification Search

CPC ..... A46B 13/005; A46B 13/02; A46B 7/10; A45D 20/50

See application file for complete search history.

(56) References Cited

U.S. PATENT DOCUMENTS

| | | | | |
|---|---|---|---|---|
| 4,034,201 | A | 7/1977 | Walter et al. | |
| 5,832,939 | A | 11/1998 | Nathe | |
| 6,098,635 | A | 8/2000 | Marino | |
| 11,503,804 | B1 * | 11/2022 | MacPherson ..... | A46B 5/0012 |
| 2003/0131865 | A1 | 7/2003 | Richmond et al. | |
| 2008/0041406 | A1 | 2/2008 | Le | |
| 2011/0067194 | A1 | 3/2011 | Al-Qaffas | |
| 2020/0206785 | A1 | 7/2020 | Pringle, IV et al. | |

FOREIGN PATENT DOCUMENTS

| | | |
|---|---|---|
| WO | 2022/051707 | 3/2022 |

* cited by examiner

*Primary Examiner* — Andrew A Horton

(74) *Attorney, Agent, or Firm* — Millen, White, Zelano & Branigan, P.C.; Christopher W. Brody

(57) ABSTRACT

A material treatment device intended for use for human or animal hair includes a plurality of rods arranged circumferentially as part of a rod barrel and a handle attached to the rod barrel for rotatable support thereof. A mechanism is provided to rotate the rod barrel in a first direction and a second mechanism is provided to rotate each of the rods separately from the rod barrel in a second direction opposite the first direction. The material being contacted by the rods during use of the hair treatment device rolls away from the contacted rod in the second direction or permitting each of the rods to freely spin during rod barrel rotation. The device can also include bristles that move with respect to the rod barrel or are fixed thereto, the bristles moving with the rod barrel rotation.

18 Claims, 19 Drawing Sheets

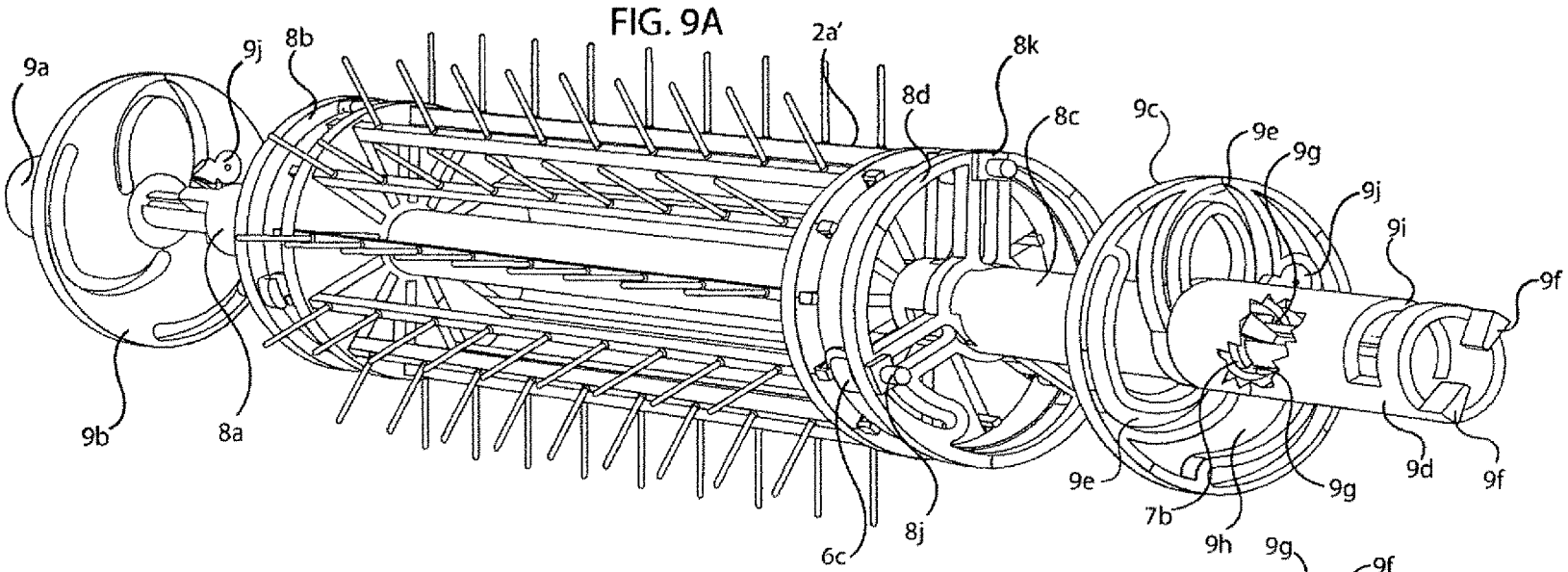
FIG. 9A
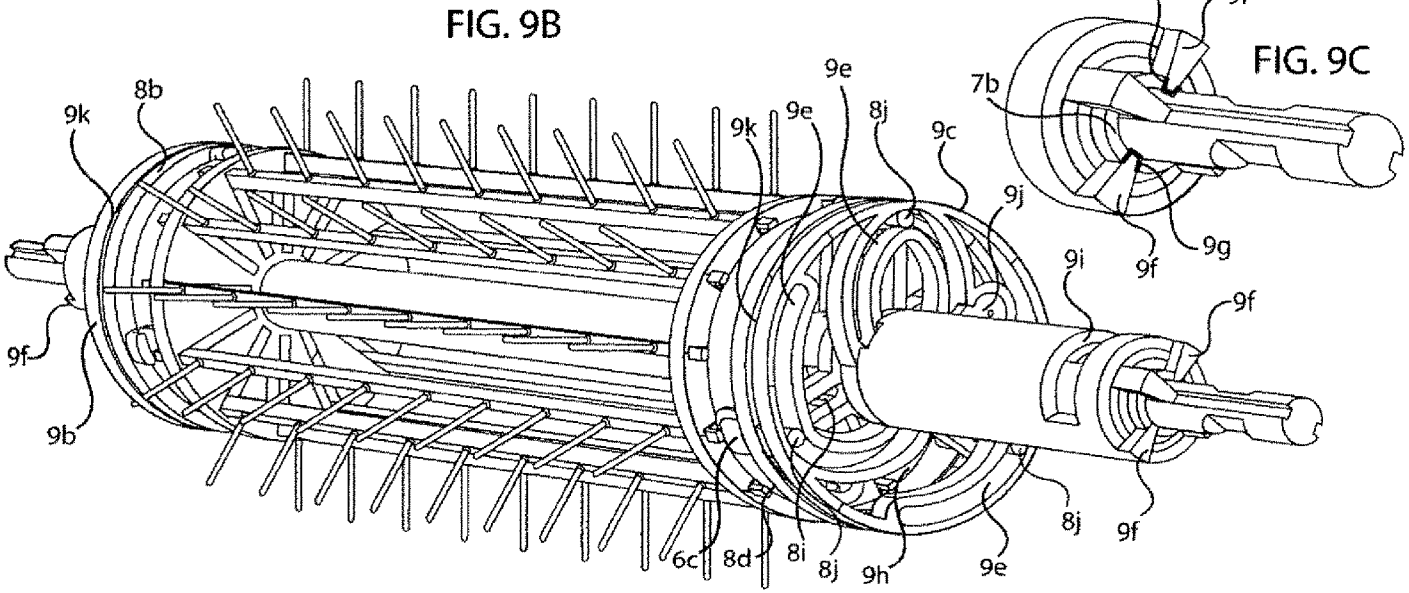
FIG. 9C
FIG. 9B

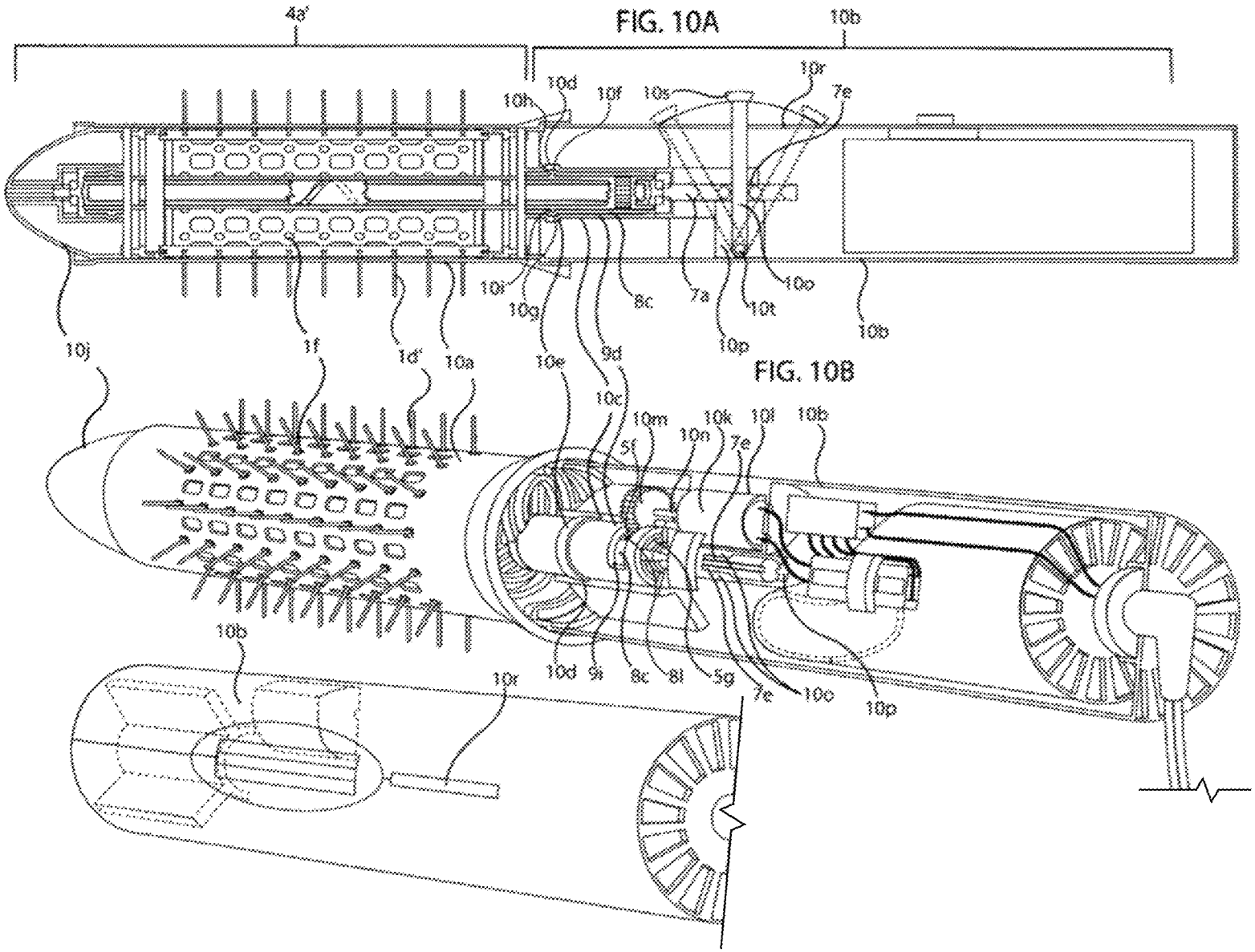
FIG. 10A
FIG. 10B
10b
4a'
10j
10k
10l
10m
10n
10o
10p
10q
10r
10s
10t
10u
10v
10w
10x
10y
10z
10aa
10ab
10ac
10ad
10ae
10af
10ag
10ah
10ai
10aj
10ak
10al
10am
10an
10ao
10ap
10aq
10ar
10as
10at
10au
10av
10aw
10ax
10ay
10az
10ba
10bb
10bc
10bd
10be
10bf
10bg
10bh
10bi
10bj
10bk
10bl
10bm
10bn
10bo
10bp
10bq
10br
10bs
10bt
10bu
10bv
10bw
10bx
10by
10bz
10ca
10cb
10cc
10cd
10ce
10cf
10cg
10ch
10ci
10cj
10ck
10cl
10cm
10cn
10co
10cp
10cq
10cr
10cs
10ct
10cu
10cv
10cw
10cx
10cy
10cz
10da
10db
10dc
10dd
10de
10df
10dg
10dh
10di
10dj
10dk
10dl
10dm
10dn
10do
10dp
10dq
10dr
10ds
10dt
10du
10dv
10dw
10dx
10dy
10dz
10ea
10eb
10ec
10ed
10ee
10ef
10eg
10eh
10ei
10ej
10ek
10el
10em
10en
10eo
10ep
10eq
10er
10es
10et
10eu
10ev
10ew
10ex
10ey
10ez
10fa
10fb
10fc
10fd
10fe
10ff
10fg
10fh
10fi
10fj
10fk
10fl
10fm
10fn
10fo
10fp
10fq
10fr
10fs
10ft
10fu
10fv
10fw
10fx
10fy
10fz
10ga
10gb
10gc
10gd
10ge
10gf
10gg
10gh
10gi
10gj
10gk
10gl
10gm
10gn
10go
10gp
10gq
10gr
10gs
10gt
10gu
10gv
10gw
10gx
10gy
10gz
10ha
10hb
10hc
10hd
10he
10hf
10hg
10hh
10hi
10hj
10hk
10hl
10hm
10hn
10ho
10hp
10hq
10hr
10hs
10ht
10hu
10hv
10hw
10hx
10hy
10hz
10ia
10ib
10ic
10id
10ie
10if
10ig
10ih
10ii
10ij
10ik
10il
10im
10in
10io
10ip
10iq
10ir
10is
10it
10iu
10iv
10iw
10ix
10iy
10iz
10ja
10jb
10jc
10jd
10je
10jf
10jg
10jh
10ji
10jj
10jk
10jl
10jm
10jn
10jo
10jp
10jq
10jr
10js
10jt
10ju
10jv
10jw
10jx
10jy
10jz
10ka
10kb
10kc
10kd
10ke
10kf
10kg
10kh
10ki
10kj
10kk
10kl
10km
10kn
10ko
10kp
10kq
10kr
10ks
10kt
10ku
10kv
10kw
10kx
10ky
10kz
10la
10lb
10lc
10ld
10le
10lf
10lg
10lh
10li
10lj
10lk
10ll
10lm
10ln
10lo
10lp
10lq
10lr
10ls
10lt
10lu
10lv
10lw
10lx
10ly
10lz
10ma
10mb
10mc
10md
10me
10mf
10mg
10mh
10mi
10mj
10mk
10ml
10mm
10mn
10mo
10mp
10mq
10mr
10ms
10mt
10mu
10mv
10mw
10mx
10my
10mz
10na
10nb
10nc
10nd
10ne
10nf
10ng
10nh
10ni
10nj
10nk
10nl
10nm
10nn
10no
10np
10nq
10nr
10ns
10nt
10nu
10nv
10nw
10nx
10ny
10nz
10oa
10ob
10oc
10od
10oe
10of
10og
10oh
10oi
10oj
10ok
10ol
10om
10on
10oo
10op
10oq
10or
10os
10ot
10ou
10ov
10ow
10ox
10oy
10oz
10pa
10pb
10pc
10pd
10pe
10pf
10pg
10ph
10pi
10pj
10pk
10pl
10pm
10pn
10po
10pp
10pq
10pr
10ps
10pt
10pu
10pv
10pw
10px
10py
10pz
10qa
10qb
10qc
10qd
10qe
10qf
10qg
10qh
10qi
10qj
10qk
10ql
10qm
10qn
10qo
10qp
10qq
10qr
10qs
10qt
10qu
10qv
10qw
10qx
10qy
10qz
10ra
10rb
10rc
10rd
10re
10rf
10rg
10rh
10ri
10rj
10rk
10rl
10rm
10rn
10ro
10rp
10rq
10rr
10rs
10rt
10ru
10rv
10rw
10rx
10ry
10rz
10sa
10sb
10sc
10sd
10se
10sf
10sg
10sh
10si
10sj
10sk
10sl
10sm
10sn
10so
10sp
10sq
10sr
10ss
10st
10su
10sv
10sw
10sx
10sy
10sz
10ta
10tb
10tc
10td
10te
10tf
10tg
10th
10ti
10tj
10tk
10tl
10tm
10tn
10to
10tp
10tq
10tr
10ts
10tt
10tu
10tv
10tw
10tx
10ty
10tz
10ua
10ub
10uc
10ud
10ue
10uf
10ug
10uh
10ui
10uj
10uk
10ul
10um
10un
10uo
10up
10uq
10ur
10us
10ut
10uv
10uw
10ux
10uy
10uz
10va
10vb
10vc
10vd
10ve
10vf
10vg
10vh
10vi
10vj
10vk
10vl
10vm
10vn
10vo
10vp
10vq
10vr
10vs
10vt
10vu
10vv
10vw
10vx
10vy
10vz
10wa
10wb
10wc
10wd
10we
10wf
10wg
10wh
10wi
10wj
10wk
10wl
10wm
10wn
10wo
10wp
10wq
10wr
10ws
10wt
10wu
10wv
10ww
10wx
10wy
10wz
10xa
10xb
10xc
10xd
10xe
10xf
10xg
10xh
10xi
10xj
10xk
10xl
10xm
10xn
10xo
10xp
10xq
10xr
10xs
10xt
10xu
10xv
10xw
10xx
10xy
10xz
10ya
10yb
10yc
10yd
10ye
10yf
10yg
10yh
10yi
10yj
10yk
10yl
10ym
10yn
10yo
10yp
10yq
10yr
10ys
10yt
10yu
10yv
10yw
10yx
10yy
10yz
10za
10zb
10zc
10zd
10ze
10zf
10zg
10zh
10zi
10zj
10zk
10zl
10zm
10zn
10zo
10zp
10zq
10zr
10zs
10zt
10zu
10zv
10zw
10zx
10zy
10zz
10aaa
10aab
10aac
10aad
10aae
10aaf
10aag
10aah
10aai
10aaj
10aak
10aal
10aam
10aan
10aao
10aap
10aaq
10aar
10aas
10aat
10aau
10aav
10aaw
10aax
10aay
10aaz
10aba
10abb
10abc
10abd
10abe
10abf
10abg
10abh
10abi
10abj
10abk
10abl
10abm
10abn
10abo
10abp
10abq
10abr
10abs
10abt
10abu
10abv
10abw
10abx
10aby
10abz
10aca
10acb
10acc
10acd
10ace
10acf
10acg
10ach
10aci
10acj
10ack
10acl
10acm
10acn
10aco
10acp
10acq
10acr
10acs
10act
10acu
10acv
10acw
10acx
10acy
10acz
10ada
10adb
10adc
10add
10ade
10adf
10adg
10adh
10adi
10adj
10adk
10adl
10adm
10adn
10ado
10adp
10adq
10adr
10ads
10adt
10adu
10adv
10adw
10adx
10ady
10adz
10aea
10aeb
10aec
10aed
10aee
10aef
10aeg
10aeh
10aei
10aej
10aek
10ael
10aem
10aen
10aeo
10aep
10aeq
10aer
10aes
10aet
10aeu
10aev
10aew
10aex
10aey
10aez
10afa
10afb
10afc
10afd
10afe
10aff
10afg
10afh
10afi
10afj
10afk
10afl
10afm
10afn
10afo
10afp
10afq
10afr
10afs
10aft
10afu
10afv
10afw
10afx
10afy
10afz
10aga
10agb
10agc
10agd
10age
10agf
10agg
10agh
10agi
10agj
10agk
10agl
10agm
10agn
10ago
10agp
10agq
10agr
10ags
10agt
10agu
10agv
10agw
10agx
10agy
10agz
10aha
10ahb
10ahc
10ahd
10ahe
10ahf
10ahg
10ahh
10ahi
10ahj
10ahk
10ahl
10ahm
10ahn
10aho
10ahp
10ahq
10ahr
10ahs
10aht
10ahu
10ahv
10ahw
10ahx
10ahy
10ahz
10aia
10aib
10aic
10aid
10aie
10aif
10aig
10aih
10aii
10aij
10aik
10ail
10aim
10ain
10aio
10aip
10aiq
10air
10ais
10ait
10aiu
10aiv
10aiw
10aix
10aiy
10aiz
10aja
10ajb
10ajc
10ajd
10aje
10ajf
10ajg
10ajh
10aji
10ajj
10ajk
10ajl
10ajm
10ajn
10ajo
10ajp
10ajq
10ajr
10ajs
10ajt
10aju
10ajv
10ajw
10ajx
10ajy
10ajz
10aka
10akb
10akc
10akd
10ake
10akf
10akg
10akh
10aki
10akj
10akk
10akl
10akm
10akn
10ako
10akp
10akq
10akr
10aks
10akt
10aku
10akv
10akw
10akx
10aky
10akz
10ala
10alb
10alc
10ald
10ale
10alf
10alg
10alh
10ali
10alj
10alk
10all
10alm
10aln
10alo
10alp
10alq
10alr
10als
10alt
10alu
10alv
10alw
10alx
10aly
10alz
10ama
10amb
10amc
10amd
10ame
10amf
10amg
10amh
10ami
10amj
10amk
10aml
10amm
10amn
10amo
10amp
10amq
10amr
10ams
10amt
10amu
10amv
10amw
10amx
10amy
10amz
10ana
10anb
10anc
10and
10ane
10anf
10ang
10anh
10ani
10anj
10ank
10anl
10anm
10ann
10ano
10anp
10anq
10anr
10ans
10ant
10anu
10anv
10anw
10anx
10any
10anz
10aoa
10aob
10aoc
10aod
10aoe
10aof
10aog
10aoh
10aoi
10aoj
10aok
10aol
10aom
10aon
10aoo
10aop
10aoq
10aor
10aos
10aot
10aou
10aov
10aow
10aox
10aoy
10aoz
10apa
10apb
10apc
10apd
10ape
10apf
10apg
10aph
10api
10apj
10apk
10apl
10apm
10apn
10apo
10app
10apq
10apr
10aps
10apt
10apu
10apv
10apw
10apx
10apy
10apz
10aqa
10aqb
10aqc
10aqd
10aqe
10aqf
10aqg
10aqh
10aqi
10aqj
10aqk
10aql
10aqm
10aqn
10aqo
10aqp
10aqq
10aqr
10aqs
10aqt
10aqu
10aqv
10aqw
10aqx
10aqy
10aqz
10ara
10arb
10arc
10ard
10are
10arf
10arg
10arh
10ari
10arj
10ark
10arl
10arm
10arn
10aro
10arp
10arq
10arr
10ars
10art
10aru
10arv
10arw
10arx
10ary
10arz
10asa
10asb
10asc
10asd
10ase
10asf
10asg
10ash
10asi
10asj
10ask
10asl
10asm
10asn
10aso
10asp
10asq
10asr
10ass
10ast
10asu
10asv
10asw
10asx
10asy
10asz
10ata
10atb
10atc
10atd
10ate
10atf
10atg
10ath
10ati
10atj
10atk
10atl
10atm
10atn
10ato
10atp
10atq
10atr
10ats
10att
10atu
10atv
10atw
10atx
10aty
10atz
10aua
10aub
10auc
10aud
10aue
10auf
10aug
10auh
10aui
10auj
10auk
10aul
10aum
10aun
10auo
10aup
10auq
10aur
10aus
10aut
10auu
10auv
10auw
10aux
10auy
10auz
10ava
10avb
10avc
10avd
10ave
10avf
10avg
10avh
10avi
10avj
10avk
10avl
10avm
10avn
10avo
10avp
10avq
10avr
10avs
10avt
10avu
10avv
10avw
10avx
10avy
10avz
10awa
10awb
10awc
10awd
10awe
10awf
10awg
10awh
10awi
10awj
10awk
10awl
10awm
10awn
10awo
10awp
10awq
10awr
10aws
10awt
10awu
10awv
10aww
10awx
10awy
10awz
10axa
10axb
10axc
10axd
10axe
10axf
10axg
10axh
10axi
10axj
10axk
10axl
10axm
10axn
10axo
10axp
10axq
10axr
10axs
10axt
10axu
10axv
10axw
10axx
10axy
10axz
10aya
10ayb
10ayc
10ayd
10aye
10ayf
10ayg
10ayh
10ayi
10ayj
10ayk
10ayl
10aym
10ayn
10ayo
10ayp
10ayq
10ayr
10ays
10ayt
10ayu
10ayv
10ayw
10ayx
10ayy
10ayz
10aza
10azb
10azc
10azd
10aze
10azf
10azg
10azh
10azi
10azj
10azk
10azl
10azm
10azn
10azo
10azp
10azq
10azr
10azs
10azt
10azu
10azv
10azw
10azx
10azy
10azz
10baa
10bab
10bac
10bad
10bae
10baf
10bag
10bah
10bai
10baj
10bak
10bal
10bam
10ban
10bao
10bap
10baq
10bar
10bas
10bat
10bau
10bav
10baw
10bax
10bay
10baz
10bba
10bbb
10bbc
10bbd
10bbe
10bbf
10bbg
10bbh
10bbi
10bbj
10bbk
10bbl
10bbm
10bbn
10bbo
10bbp
10bbq
10bbr
10bbs
10bbt
10bbu
10bbv
10bbw
10bbx
10bby
10bbz
10bca
10bcb
10bcc
10bcd
10bce
10bcf
10bcg
10bch
10bci
10bcj
10bck
10bcl
10bcm
10bcn
10bco
10bcp
10bcq
10bcr
10bcs
10bct
10bcu
10bcv
10bcw
10bcx
10bcy
10bcz
10bda
10bdb
10bdc
10bdd
10bde
10bdf
10bdg
10bdh
10bdi
10bdj
10bdk
10bdl
10bdm
10bdn
10bdo
10bdp
10bdq
10bdr
10bds
10bdt
10bdu
10bdv
10bdw
10bdx
10bdy
10bdz
10bea
10beb
10bec
10bed
10bee
10bef
10beg
10beh
10bei
10bej
10bek
10bel
10bem
10ben
10beo
10bep
10beq
10ber
10bes
10bet
10beu
10bev
10bew
10bex
10bey
10bez
10bfa
10bfb
10bfc
10bfd
10bfe
10bff
10bfg
10bfh
10bfi
10bfj
10bfk
10bfl
10bfm
10bfn
10bfo
10bfp
10bfq
10bfr
10bfs
10bft
10bfu
10bfv
10bfw
10bfx
10bfy
10bfz
10bga
10bgb
10bgc
10bgd
10bge
10bgf
10bgg
10bgh
10bgi
10bgj
10bgk
10bgl
10bgm
10bgn
10bgo
10bgp
10bgq
10bgr
10bgs
10bgt
10bgu
10bgv
10bgw
10bgx
10bgy
10bgz
10bha
10bhb
10bhc
10bhd
10bhe
10bhf
10bhg
10bhh
10bhi
10bhj
10bhk
10bhl
10bhm
10bhn
10bho
10bhp
10bhq
10bhr
10bhs
10bht
10bhu
10bhv
10bhw
10bhx
10bhy
10bhz
10bia
10bib
10bic
10bid
10bie
10bif
10big
10bih
10bii
10bij
10bik
10bil
10bim
10bin
10bio
10bip
10biq
10bir
10bis
10bit
10biu
10biv
10biw
10bix
10biy
10biz
10bja
10bjb
10bjc
10bjd
10bje
10bjf
10bjg
10bjh
10bji
10bjj
10bjk
10bjl
10bjm
10bjn
10bjo
10bjp
10bjq
10bjr
10bjs
10bjt
10bju
10bjv
10bjw
10bjx
10bjy
10bjz
10bka
10bkb
10bkc
10bkd
10bke
10bkf
10bkg
10bkh
10bki
10bkj
10bkk
10bkl
10bkm
10bkn
10bko
10bkp
10bkq
10bkr
10bks
10bkt
10bku
10bkv
10bkw
10bkx
10bky
10bkz
10bla
10blb
10blc
10bld
10ble
10blf
10blg
10blh
10bli
10blj
10blk
10bll
10blm
10bln
10blo
10blp
10blq
10blr
10bls
10blt
10blu
10blv
10blw
10blx
10bly
10blz
10bma
10bmb
10bmc
10bmd
10bme
10bmf
10bmg
10bmh
10bmi
10bmj
10bmk
10bml
10bmm
10bmn
10bmo
10bmp
10bmq
10bmr
10bms
10bmt
10bmu
10bmv
10bmw
10bmx
10bmy
10bmz
10bna
10bnb
10bnc
10bnd
10bne
10bnf
10bng
10bnh
10bni
10bnj
10bnk
10bnl
10bnm
10bnn
10bno
10bnp
10bnq
10bnr
10bns
10bnt
10bnu
10bnv
10bnw
10bnx
10bny
10bnz
10boa
10bob
10boc
10bod
10boe
10bof
10bog
10boh
10boi
10boj
10bok
10bol
10bom
10bon
10boo
10bop
10boq
10bor
10bos
10bot
10bou
10bov
10bow
10box
10boy
10boz
10bpa
10bpb
10bpc
10bpd
10bpe
10bpf
10bpg
10bph
10bpi
10bpj
10bpk
10bpl
10bpm
10bpn
10bpo
10bpp
10bpq
10bpr
10bps
10bpt
10bpu
10bpv
10bpw
10bpx
10bpy
10bpz
10bqa
10bqb
10bqc
10bqd
10bqe
10bqf
10bqg
10bqh
10bqi
10bqj
10bqk
10bql
10bqm
10bqn
10bqo
10bqp
10bqq
10bqr
10bqs
10bqt
10bqu
10bqv
10bqw
10bqx
10bqy
10bqz
10bra
10brb
10brc
10brd
10bre
10brf
10brg
10brh
10bri
10brj
10brk
10brl
10brm
10brn
10bro
10brp
10brq
10brr
10brs
10brt
10bru
10brv
10brw
10brx
10bry
10brz
10bsa
10bsb
10bsc
10bsd
10bse
10bsf
10bsg
10bsh
10bsi
10bsj
10bsk
10bsl
10bsm
10bsn
10bso
10bsp
10bsq
10bsr
10bss
10bst
10bsu
10bsv
10bsw
10bsx
10bsy
10bsz
10bta
10btb
10btc
10btd
10bte
10btf
10btg
10bth
10bti
10btj
10btk
10btl
10btm
10btn
10bto
10btp
10btq
10btr
10bts
10btt
10btu
10btv
10btw
10btx
10bty
10btz
10bua
10bub
10buc
10bud
10bue
10buf
10bug
10buh
10bui
10buj
10buk
10bul
10bum
10bun
10buo
10bup
10buq
10bur
10bus
10but
10buu
10buv
10buw
10bux
10buy
10buz
10bva
10bvb
10bvc
10bvd
10bve
10bvf
10bvg
10bvh
10bvi
10bvj
10bvk
10bvl
10bvm
10bvn
10bvo
10bvp
10bvq
10bvr
10bvs
10bvt
10bvu
10bvv
10bvw
10bvx
10bvy
10bvz
10bwa
10bwb
10bwc
10bwd
10bwe
10bwf
10bwg
10bwh
10bwi
10bwj
10bwk
10bwl
10bwm
10bwn
10bwo
10bwp
10bwq
10bwr
10bws
10bwt
10bwu
10bwv
10bww
10bwx
10bwy
10bwz
10bxa
10bxb
10bxc
10bxd
10bxe
10bxf
10bxg
10bxh
10bxi
10bxj
10bxk
10bxl
10bxm
10bxn
10bxo
10bxp
10bxq
10bxr
10bxs
10bxt
10bxu
10bxv
10bxw
10bxx
10bxy
10bxz
10bya
10byb
10byc
10byd
10bye
10byf
10byg
10byh
10byi
10byj
10byk
10byl
10bym
10byn
10byo
10byp
10byq
10byr
10bys
10byt
10byu
10byv
10byw
10byx
10byy
10byz
10bza
10bzb
10bzc
10bzd
10bze
10bzf
10bzg
10bzh
10bzi
10bzj
10bzk
10bzl
10bzm
10bzn
10bzo
10bzp
10bzq
10bzr
10bzs
10bzt
10bzu
10bzv
10bzw
10bzx
10bzy
10bzz
10caa
10cab
10cac
10cad
10cae
10caf
10cag
10cah
10cai
10caj
10cak
10cal
10cam
10can
10cao
10cap
10caq
10car
10cas
10cat
10cau
10cav
10caw
10cax
10cay
10caz
10cba
10cbb
10cbc
10cbd
10cbe
10cbf
10cbg
10cbh
10cbi
10cbj
10cbk
10cbl
10cbm
10cbn
10cbo
10cbp
10cbq
10cbr
10cbs
10cbt
10cbu
10cbv
10cbw
10cbx
10cby
10cbz
10cca
10ccb
10ccc
10ccd
10cce
10ccf
10ccg
10cch
10cci
10ccj
10cck
10ccl
10ccm
10ccn
10cco
10ccp
10ccq
10ccr
10ccs
10cct
10ccu
10ccv
10ccw
10ccx
10ccy
10ccz
10cda
10cdb
10cdc
10cdd
10cde
10cdf
10cdg
10cdh
10cdi
10cdj
10cdk
10cdl
10cdm
10cdn
10cdo
10cdp
10cdq
10cdr
10cds
10cdt
10cdu
10cdv
10cdw
10cdx
10cdy
10cdz
10cea
10ceb
10cec
10ced
10cee
10cef
10ceg
10ceh
10cei
10cej
10cek
10cel
10cem
10cen
10ceo
10cep
10ceq
10cer
10ces
10cet
10ceu
10cev
10cew
10cex
10cey
10cez
10cfa
10cfb
10cfc
10cfd
10cfe
10cff
10cfg
10cfh
10cfi
10cfj
10cfk
10cfl
10cfm
10cfn
10cfo
10cfp
10cfq
10cfr
10cfs
10cft
10cfu
10cfv
10cfw
10cfx
10cfy
10cfz
10cga
10cgb
10cgc
10cgd
10cge
10cgf
10cgg
10cgh
10cgi
10cgj
10cgk
10cgl
10cgm
10cgn
10cgo
10cgp
10cgq
10cgr
10cgs
10cgt
10cgu
10cgv
10cgw
10cgx
10cgy
10cgz
10cha
10chb
10chc
10chd
10che
10chf
10chg
10chh
10chi
10chj
10chk
10chl
10chm
10chn
10cho
10chp
10chq
10chr
10chs
10cht
10chu
10chv
10chw
10chx
10chy
10chz
10cia
10cib
10cic
10cid
10cie
10cif
10cig
10cih
10cii
10cij
10cik
10cil
10cim
10cin
10cio
10cip
10ciq
10cir
10cis
10cit
10ciu
10civ
10ciw
10cix
10ciy
10ciz
10cja
10cjb
10cjc
10cjd
10cje
10cjf
10cjg
10cjh
10cji
10cjj
10cjk
10cjl
10cjm
10cjn
10cjo
10cjp
10cjq
10cjr
10cjs
10cjt
10cju
10cjv
10cjw
10cjx
10cjy
10cjz
10cka
10ckb
10ckc
10ckd
10cke
10ckf
10ckg
10ckh
10cki
10ckj
10ckk
10ckl
10ckm
10ckn
10cko
10ckp
10ckq
10ckr
10cks
10ckt
10cku
10ckv
10ckw
10ckx
10cky
10ckz
10cla
10clb
10clc
10cld
10cle
10clf
10clg
10clh
10cli
10clj
10clk
10cll
10clm
10cln
10clo
10clp
10clq
10clr
10cls
10clt
10clu
10clv
10clw
10clx
10cly
10clz
10cma
10cmb
10cmc
10cmd
10cme
10cmf
10cmg
10cmh
10cmi
10cmj
10cmk
10cml
10cmm
10cmn
10cmo
10cmp
10cmq
10cmr
10cms
10cmt
10cmu
10cmv
10cmw
10cmx
10cmy
10cmz
10cna
10cnb
10cnc
10cnd
10cne
10cnf
10cng
10cnh
10cni
10cnj
10cnk
10cnl
10cnm
10cnn
10cno
10cnp
10cnq
10cnr
10cns
10cnt
10cnu
10cnv
10cnw
10cnx
10cny
10cnz
10coa
10cob
10coc
10cod
10coe
10cof
10cog
10coh
10coi
10coj
10cok
10col
10com
10con
10coo
10cop
10coq
10cor
10cos
10cot
10cou
10cov
10cow
10cox
10coy
10coz
10cpa
10cpb
10cpc
10cpd
10cpe
10cpf
10cpg
10cph
10cpi
10cpj
10cpk
10cpl
10cpm
10cpn
10cpo
10cpp
10cpq
10cpr
10cps
10cpt
10cpu
10cpv
10cpw
10cpx
10cpy
10cpz
10cqa
10cqb
10cqc
10cqd
10cqe
10cqf
10cqg
10cqh
10cqi
10cqj
10cqk
10cql
10cqm
10cqn
10cqo
10cqp
10cqq
10cqr
10cqs
10cqt
10cqu
10cqv
10cqw
10cqx
10cqy
10cqz
10cra
10crb
10crc
10crd
10cre
10crf
10crg
10crh
10cri
10crj
10crk
10crl
10crm
10crn
10cro
10crp
10crq
10crr
10crs
10crt
10cru
10crv
10crw
10crx
10cry
10crz
10csa
10csb
10csc
10csd
10cse
10csf
10csg
10csh
10csi
10csj
10csk
10csl
10csm
10csn
10cso
10csp
10csq
10csr
10css
10cst
10csu
10csv
10csw
10csx
10csy
10csz
10cta
10ctb
10ctc
10ctd
10cte
10ctf
10ctg
10cth
10cti
10ctj
10ctk
10ctl
10ctm
10ctn
10cto
10ctp
10ctq
10ctr
10cts
10ctt
10ctu
10ctv
10ctw
10ctx
10cty
10ctz
10cua
10cub
10cuc
10cud
10cue
10cuf
10cug
10cuh
10cui
10cuj
10cuk
10cul
10cum
10cun
10cuo
10cup
10cuq
10cur
10cus
10cut
10cuu
10cuv
10cuw
10cux
10cuy
10cuz
10cva
10cvb
10cvc
10cvd
10cve
10cvf
10cvg
10cvh
10cvi
10cvj
10cvk
10cvl
10cvm
10cvn
10cvo
10cvp
10cvq
10cvr
10cvs
10cvt
10cvu
10cvv
10cvw
10cvx
10cvy
10cvz
10cwa
10cwb
10cwc
10cwd
10cwe
10cwf
10cwg
10cwh
10cwi
10cwj
10cwk
10cwl
10cwm
10cwn
10cwo
10cwp
10cwq
10cwr
10cws
10cwt
10cwu
10cwv
10cww
10cwx
10cwy
10cwz
10cxa
10cxb
10cxc
10cxd
10cxe
10cxf
10cxg
10cxh
10cxi
10cxj
10cxk
10cxl
10cxm
10cxn
10cxo
10cxp
10cxq
10cxr
10cxs
10cxt
10cxu
10cxv
10cxw
10cxx
10cxy
10cxz
10cya
10cyb
10cyc
10cyd
10cye
10cyf
10cyg
10cyh
10cyi
10cyj
10cyk
10cyl
10cym
10cyn
10cyo
10cyp
10cyq
10cyr
10cys
10cyt
10cyu
10cyv
10cyw
10cyx
10cyy
10cyz
10cza
10czb
10czc
10czd
10cze
10czf
10czg
10czh
10czi
10czj
10czk
10czl
10czm
10czn
10czo
10czp
10czq
10czr
10czs
10czt
10czu
10czv
10czw
10czx
10czy
10czz
10daa
10dab
10dac
10dad
10dae
10daf
10dag
10dah
10dai
10daj
10dak
10dal
10dam
10dan
10dao
10dap
10daq
10dar
10das
10dat
10dau
10dav
10daw
10dax
10day
10daz
10dba
10dbb
10dbc
10dbd
10dbe
10dbf
10dbg
10dbh
10dbi
10dbj
10dbk
10dbl
10dbm
10dbn
10dbo
10dbp
10dbq
10dbr
10dbs
10dbt
10dbu
10dbv
10dbw
10dbx
10dby
10dbz
10dca
10dcb
10dcc
10dcd
10dce
10dcf
10dcg
10dch
10dci
10dcj
10dck
10dcl
10dcm
10dcn
10dco
10dcp
10dcq
10dcr
10dcs
10dct
10dcu
10dcv
10dcw
10dcx
10dcy
10dcz
10dda
10ddb
10ddc
10ddd
10dde
10ddf
10ddg
10ddh
10ddi
10ddj
10ddk
10ddl
10ddm
10ddn
10ddo
10ddp
10ddq
10ddr
10dds
10ddt
10ddu
10ddv
10ddw
10ddx
10ddy
10ddz
10dea
10deb
10dec
10ded
10dee
10def
10deg
10deh
10dei
10dej
10dek
10del
10dem
10den
10deo
10dep
10deq
10der
10des
10det
10deu
10dev
10dew
10dex
10dey
10dez
10dfa
10dfb
10dfc
10dfd
10dfe
10dff
10dfg
10dfh
10dfi
10dfj
10dfk
10dfl
10dfm
10dfn
10dfo
10dfp
10dfq
10dfr
10dfs
10dft
10dfu
10dfv
10dfw
10dfx
10dfy
10dfz
10dga
10dgb
10dgc
10dgd
10dge
10dgf
10dgg
10dgh
10dgi
10dgj
10dgk
10dgl
10dgm
10dgn
10dgo
10dgp
10dgq
10dgr
10dgs
10dgt
10dgu
10dgv
10dgw
10dgx
10dgy
10dgz
10dha
10dhb
10dhc
10dhd
10dhe
10dhf
10dhg
10dhh
10dhi
10dhj
10dhk
10dhl
10dhm
10dhn
10dho
10dhp
10dhq
10dhr
10dhs
10dht
10dhu
10dhv
10dhw
10dhx
10dhy
10dhz
10dia
10dib
10dic
10did
10die
10dif
10dig
10dih
10dii
10dij
10dik
10dil
10dim
10din
10dio
10dip
10diq
10dir
10dis
10dit
10diu
10div
10diw
10dix
10diy
10diz
10dja
10djb
10djc
10djd
10dje
10djf
10djg
10djh
10dji
10djj
10djk
10djl
10djm
10djn
10djo
10djp
10djq
10djr
10djs
10djt
10dju
10djv
10djw
10djx
10djy
10djz
10dka
10dkb
10dkc
10dkd
10dke
10dkf
10dkg
10dkh
10dki
10dkj
10dkk
10dkl
10dkm
10dkn
10dko
10dkp
10dkq
10dkr
10dks
10dkt
10dku
10dkv
10dkw
10dkx
10dky
10dkz
10dla
10dlb
10dlc
10dld
10dle
10dlf
10dlg
10dlh
10dli
10dlj
10dlk
10dll
10dlm
10dln
10dlo
10dlp
10dlq
10dlr
10dls
10dlt
10dlu
10dlv
10dlw
10dlx
10dly
10dlz
10dma
10dmb
10dmc
10dmd
10dme
10dmf
10dmg
10dmh
10dmi
10dmj
10dmk
10dml
10dmm
10dmn
10dmo
10dmp
10dmq
10dmr
10dms
10dmt
10dmu
10dmv
10dmw
10dmx
10dmy
10dmz
10dna
10dnb
10dnc
10dnd
10dne
10dnf
10dng
10dnh
10dni
10dnj
10dnk
10dnl
10dnm
10dnn
10dno
10dnp
10dnq
10dnr
10dns
10dnt
10dnu
10dnv
10dnw
10dnx
10dny
10dnz
10doa
10dob
10doc
10dod
10doe
10dof
10dog
10doh
10doi
10doj
10dok
10dol
10dom
10don
10doo
10dop
10doq
10dor
10dos
10dot
10dou
10dov
10dow
10dox
10doy
10doz
10dpa
10dpb
10dpc
10dpd
10dpe
10dpf
10dpg
10dph
10dpi
10dpj
10dpk
10dpl
10dpm
10dpn
10dpo
10dpp
10dpq
10dpr
10dps
10dpt
10dpu
10dpv
10dpw
10dpx
10dpy
10dpz
10dqa
10dqb
10dqc
10dqd
10dqe
10dqf
10dqg
10dqh
10dqi
10dqj
10dqk
10dql
10dqm
10dqn
10dqo
10dqp
10dqq
10dqr
10dqs
10dqt
10dqu
10dqv
10dqw
10dqx
10dqy
10dqz
10dra
10drb
10drc
10drd
10dre
10drf
10drg
10drh
10dri
10drj
10drk
10drl
10drm
10drn
10dro
10drp
10drq
10drr
10drs
10drt
10dru
10drv
10drw
10drx
10dry
10drz
10dsa
10dsb
10dsc
10dsd
10dse
10dsf
10dsg
10dsh
10dsi
10dsj
10dsk
10dsl
10dsm
10dsn
10dso
10dsp
10dsq
10dsr
10dss
10dst
10dsu
10dsv
10dsw
10dsx
10dsy
10dsz
10dta
10dtb
10dtc
10dtd
10dte
10dtf
10dtg
10dth
10dti
10dtj
10dtk
10dtl
10dtm
10dtn
10dto
10dtp
10dtq
10dtr
10dts
10dtt
10dtu
10dtv
10dtw
10dtx
10dty
10dtz
10dua
10dub
10duc
10dud
10due
10duf
10dug
10duh
10dui
10duj
10duk
10dul
10dum
10dun
10duo
10dup
10duq
10dur
10dus
10dut
10duu
10duv
10duw
10dux
10duy
10duz
10dva
10dvb
10dvc
10dvd
10dve
10dvf
10dvg
10dvh
10dvi
10dvj
10dvk
10dvl
10dvm
10dvn
10dvo
10dvp
10dvq
10dvr
10dvs
10dvt
10dvu
10dvv
10dvw
10dvx
10dvy
10dvz
10dwa
10dwb
10dwc
10dwd
10dwe
10dwf
10dwg
10dwh
10dwi
10dwj
10dwk
10dwl
10dwm
10dwn
10dwo
10dwp
10dwq
10dwr
10dws
10dwt
10dwu
10dwv
10dww
10dwx
10dwy
10dwz
10dxa
10dxb
10dxc
10dxd
10dxe
10dxf
10dxg
10dxh
10dxi
10dxj
10dxk
10dxl
10dxm
10dxn
10dxo
10dxp
10dxq
10dxr
10dxs
10dxt
10dxu
10dxv
10dxw
10dxx
10dxy
10dxz
10dya
10dyb
10dyc
10dyd
10dye
10dyf
10dyg
10dyh
10dyi
10dyj
10dyk
10dyl
10dym
10dyn
10dyo
10dyp
10dyq
10dyr
10dys
10dyt
10dyu
10dyv
10dyw
10dyx
10dyy
10dyz
10dza
10dzb
10dzc
10dzd
10dze
10dzf
10dzg
10dzh
10dzi
10dzj
10dzk
10dzl
10dzm
10dzn
10dzo
10dzp
10dzq
10dzr
10dzs
10dzt
10dzu
10dzv
10dzw
10dzx
10dzy
10dzz
10eaa
10eab
10eac
10ead
10eae
10eaf
10eag
10eah
10eai
10eaj
10eak
10eal
10eam
10ean
10eao
10eap
10eaq
10ear
10eas
10eat
10eau
10eav
10eaw
10eax
10eay
10eaz
10eba
10ebb
10ebc
10ebd
10ebe
10ebf
10ebg
10ebh
10ebi
10ebj
10ebk
10ebl
10ebm
10ebn
10ebo
10ebp
10ebq
10ebr
10ebs
10ebt
10ebu
10ebv
10ebw
10ebx
10eby
10ebz
10eca
10ecb
10ecc
10ecd
10ece
10ecf
10ecg
10ech
10eci
10ecj
10eck
10ecl
10ecm
10ecn
10eco
10ecp
10ecq
10ecr
10ecs
10ect
10ecu
10ecv
10ecw
10ecx
10ecy
10ecz
10eda
10edb
10edc
10edd
10ede
10edf
10edg
10edh
10edi
10edj
10edk
10edl
10edm
10edn
10edo
10edp
10edq
10edr
10eds
10edt
10edu
10edv
10edw
10edx
10edy
10edz
10eea
10eeb
10eec
10eed
10eee
10eef
10eeg
10eeh
10eei
10eej
10eek
10eel
10eem
10een
10eeo
10eep
10eeq
10eer
10ees
10eet
10eeu
10eev
10eew
10eex
10eey
10eez
10efa
10efb
10efc
10efd
10efe
10eff
10efg
10efh
10efi
10efj
10efk
10efl
10efm
10efn
10efo
10efp
10efq
10efr
10efs
10eft
10efu
10efv
10efw
10efx
10efy
10efz
10ega
10egb
10egc
10egd
10ege
10egf
10egg
10egh
10egi
10egj
10egk
10egl
10egm
10egn
10ego
10egp
10egq
10egr
10egs
10egt
10egu
10egv
10egw
10egx
10egy
10egz
10eha
10ehb
10ehc
10ehd
10ehe
10ehf
10ehg
10ehh
10ehi
10ehj
10ehk
10ehl
10ehm
10ehn
10eho
10ehp
10ehq
10ehr
10ehs
10eht
10ehu
10ehv
10ehw
10ehx
10ehy
10ehz
10eia
10eib
10eic
10eid
10eie
10eif
10eig
10eih
10eii
10eij
10eik
10eil
10eim
10ein
10eio
10eip
10eiq
10eir
10eis
10eit
10eiu
10eiv
10eiw
10eix
10eiy
10eiz
10eja
10ejb
10ejc
10ejd
10eje
10ejf
10ejg
10ejh
10eji
10ejj
10ej FIG. 12A (1 - 4)
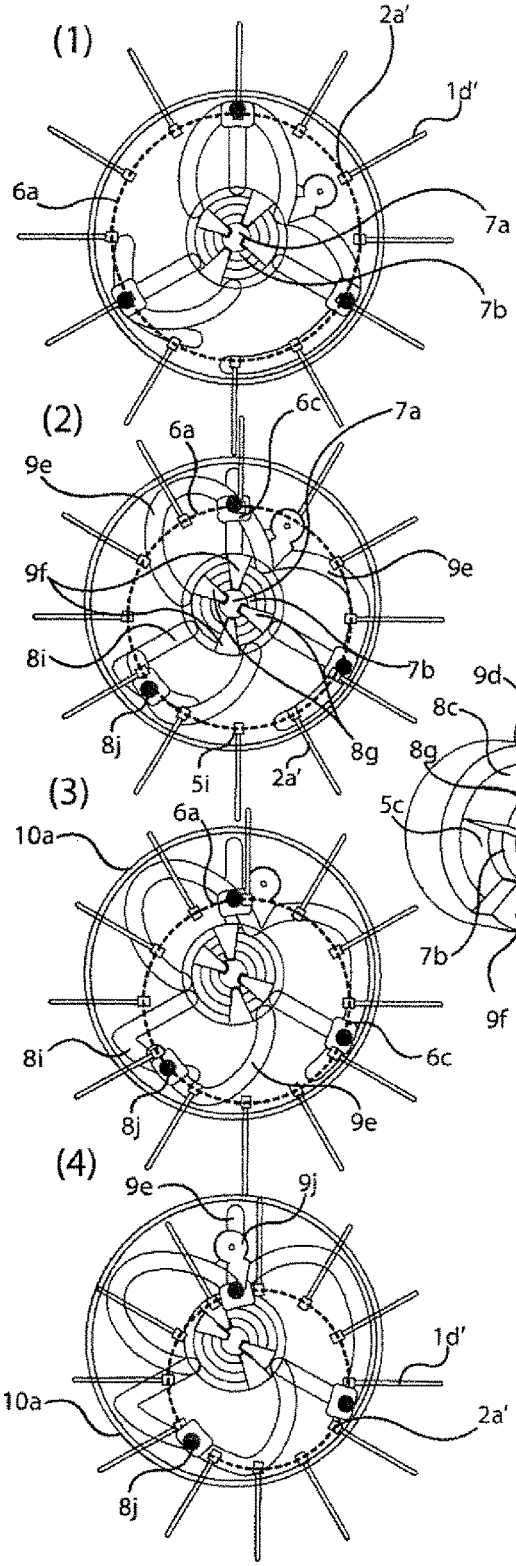
FIG. 12B (1 - 4)
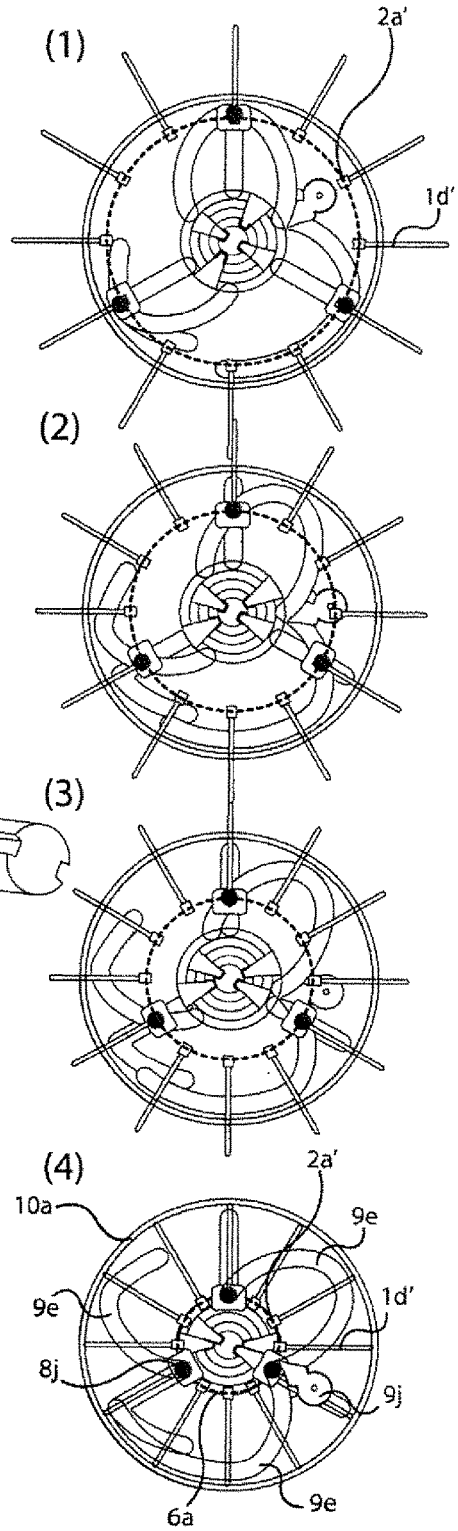
FIG. 12C
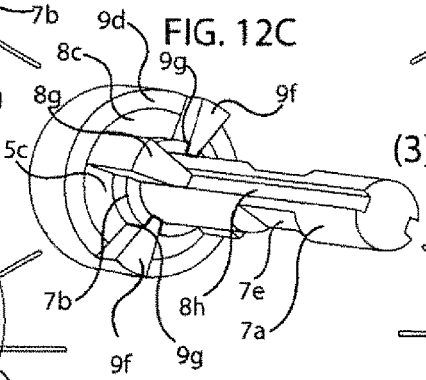

ROTATING BRISTLE DEVICE AND METHOD OF USE

FIELD OF INVENTION

The present invention addresses an issue that currently exists in all round brushes used for styling hair and exists most consequentially in motorized spinning round brushes; the appliance is designed in a manner that allows hair to become tangled around the brush.

BACKGROUND OF THE INVENTION

Hair styling round brushes, both spinning and non-spinning are available in many shapes, sizes and materials. These are commonly used with a blow-dryer in one hand and the brush in the other hand, with the blow-dryer following through the hair along with the brush.

A more sophisticated version of the above-described brush type includes a blow-dryer unit inside the handle portion of the brush. A hollow, perforated round brush barrel is fixed to said handle portion. Hot air from the blow-dryer enters the hollow barrel and exits through the perforations thereby drying the hair that is engaged with the bristles of the brush barrel.

Another version of said appliance is a 'rotating' round brush blow-dryer. Rather than being fixed to the blow-dryer handle portion, the hollow round brush barrel is driven by a motor and rotates on the handle as hot air is supplied to the barrel. This type of appliance is presently available but not without the inherent risk of tangling that such an appliance will certainly possess.

The invention provides a solution to the primary problem stated above by describing embodiments of the invention in terms of mechanical arrangements that may be employed in a rotating round brush to facilitate the continuous engagement and release of the hair from the spinning brush. These 'continuous engagement and release' mechanical arrangements apply to novel bristle mechanisms as well as novel barrel mechanisms. Furthermore, the barrel mechanisms are described herein as possessing a novel type of hair styling feature embodied in and of themselves and without the inclusion of bristle features. This embodiment may be considered a unique type of curling iron.

SUMMARY OF THE INVENTION

The invention as a material treatment device is an improvement in prior art brushes that are used for handling material, including animal and human hair.

In one embodiment, the material treatment device has a plurality of rods arranged circumferentially as part of a rod barrel. A handle is attached to the rod barrel for rotatable support thereof. A mechanism for rotating the rod barrel is provided in a first direction and a mechanism for rotating or allowing rotation of each of the rods separately from the rod barrel in a second direction opposite the first direction is also provided. The material being contacted by the rods during use of the hair treatment device rolls away from the contacted rod in the second direction.

The rods can be arranged so as to form one of a square barrel shape, a rectangular barrel shape, a triangular barrel shape, an oval barrel shape, a crescent barrel shape or a cylindrical barrel shape.

The device can also be configured to pass heated or cooled air into one or more of the plurality of rods or through the rod barrel. The surface of one or more of the rods can be textured, for example, a spiral texture or a stippled texture. The rods could also be perforated to allow hot, cold, or ambient air to contact the engaged material.

The embodiment with the roller barrel can also include a cage attached to a distal end of each of the plurality of rods, the cage preventing material from getting between the plurality of rods from the distal ends thereof. The cage can include a plurality of legs, one end of each leg rotatably attached to a distal end of each rod and the other ends of the plurality of legs joined together to prevent the material from getting between the plurality of rods from the distal ends thereof.

The invention also includes a method of engaging any material, for example animal or human hair, using the material treatment device described above, wherein the rod barrel and rods are rotated so that the rods can engage the material.

Another device of the invention combines the rod and brush barrel features described above with bristles. This rotating bristle device includes a bristle assembly, the bristle assembly comprising a plurality of aligned bristle sets, each bristle set mounted to a pair of bristle flanges, the bristle flanges configured to allow the bristle sets to move with respect to the bristle flanges. A plurality of rods are provided, opposite ends of the rods secured between the bristle flanges, each rod positioned between adjacent channels so as to create a space between adjacent rods for bristle movement, surfaces of the rods forming a part of the brush barrel.

One of two mechanisms with the rotating bristle device can be used. One mechanism rotates the brush barrel and the bristle assembly such that in one mode, the brush barrel rotates in a first direction with all of the bristles extending through the spaces formed by adjacent rods and beyond surfaces of the rods, in a second mode, the brush barrel rotates with the bristles continually extending through and beyond surfaces of the rods over one portion of the rotating brush barrel while bristles on other portions of the rotating brush barrel continually retract, and in a third mode, the bristles are fully retracted such that the bristles do not extend from the rotating brush barrel during rotation thereof.

The other mechanism rotates the brush barrel and the bristle assembly such that the brush barrel rotates with some bristles extending through and beyond surfaces of the rods over one portion of the rotating brush barrel while other bristles on other portions of the rotating brush barrel are retracted.

The bristle set can include a plurality of bristles or a plurality of bristle bundles.

The rods of either embodiment disclosed above can be coated with a non-stick coating, for example, PTFE and either embodiment above use two or more rods, e.g., two, four, six, or twelve rods are employed.

The bristle assembly can further be configured such that each bristle set is mounted to the pair of bristle flanges, each bristle flange having channels therein to allow the bristle sets to move along the channels, the bristle flanges mounted to a spine.

A third material treatment device is provided that includes the moving rods and a slide clamp for clamping purposes. This material treatment device includes a plurality of rods arranged circumferentially as part of a rod barrel and a handle attached to the rod barrel for rotatable support thereof. A mechanism is provided for rotating the rod barrel in a first direction and a mechanism is provided for rotating or allowing rotation of each of the rods separately from the rod barrel in a second direction opposite the first direction, that is, permitting each of the rods to freely spin during rod barrel rotation. A slide clip is provided that is moveably mounted on the handle and moves between an extended position and a retracted position. In the extended position, at least a portion of the slide clip is positioned adjacent a surface of one of the plurality of rods. A mechanism is provided for pivoting the slide clip with respect to the surface between an open position and a closed position, the open position allowing entraining of material between the portion of the slide clip and the surface and the closed position clamping the entrained material on the surface. A mechanism is also provided to prevent rotation of each of the plurality of rods when the slide clip is moved into the extended position while the rod barrel and slide clip can be rotated for winding of the material around the plurality of rods and for permitting rotation of each of the plurality of rods with the material wound on the plurality of rods and with rotation of the rod barrel when the slide clip is moved into the retracted position.

The invention also includes a method of engaging a material using the device that employs the slide clip. This method includes disengaging the plurality of rods from the rod barrel moving the slide clip to the extended position. The slide clip is moved to the open position to be able to position at least some material between the slide clip and the surface of the rod. The slide clip is moved to the closed position to clamp the material. Then the rod barrel and slide clip are rotated to wind material around the plurality of rods. Post rotation, the slide clip is moved to the retracted position and the plurality of rods and rod barrel are rotated with respect to the wound material. The rods can be optionally cooled or heated.

Yet another embodiment employs just bristles for material treatment. The rotating bristle device includes a bristle assembly, the bristle assembly comprising a plurality of aligned bristle sets, each bristle set mounted to a pair of bristle flanges, the bristle flanges configured to allow the bristle sets to move with respect to the bristle flanges. A brush barrel having perforations therein is provided, each perforation designed to receive one of the bristles in the bristle sets.

Two mechanisms can be used for moving the brush barrel and bristle assembly. One moves the brush barrel and the bristle assembly such that in one mode, the brush barrel rotates with all of the bristles extending from the perforations, in a second mode, the brush barrel rotates with the bristles continually extending over one side of the rotating brush barrel while bristles on the other side of the rotating brush barrel continually retract, and in a third mode, the bristles are fully retracted such that the bristles do not extend from the rotating brush barrel during rotation thereof. The other mechanism can rotate the brush barrel and the bristle assembly such that the brush barrel rotates with some bristles extending through and beyond surfaces of the rods over one portion of the rotating brush barrel while other bristles on other portions of the rotating brush barrel are retracted.

This rotating bristle device using the brush barrel and bristles can be used in a method of engaging material, for example, human or animal hair. The method includes rotating the spine so that the bristles can engage the material.

Another embodiment of the invention is a rotating bristle device that has an eccentric rotation. This device includes a bristle assembly, the bristle assembly comprising a plurality of aligned bristle sets, each bristle set mounted to a spine. A tube having perforations therein is provided, each perforation designed to receive one of the bristles in the bristle sets. Guide surfaces are arranged on an inner periphery of the tube, each guide surface forming a channel to guide the bristles in and out of the perforations. A plurality of rolling surfaces are arranged on an inner periphery of the tube. The spine is mounted inside the perforated tube such that the rolling surfaces rest on a portion of the spine and an axis of the spine is offset from an axis of the perforated tube, and the bristles extend into channels formed by the guide surfaces, wherein rotation of the spine causes the rolling surfaces of the perforated tube to roll on the spine and eccentrically rotate the perforated tube with respect to the spine, the eccentric rotation of the perforated tube allowing the bristles to extend and retract from the perforations in the perforated tube during spine rotation.

The eccentric rotating bristle device can include a plurality of elongated triangularly shaped bristle guides, each bristle guide arranged on an inner periphery of the perforated tube, adjacent bristle guides forming the channels, and a plurality of spaced apart spacer rings arranged longitudinally along the perforated tube and inside of the bristle guides, the spacer rings having the rolling surfaces. The housing can be a one-piece structure having the guides surfaces and rolling surfaces as a part thereof and the spine can include a handle for spine rotation. The eccentric rotating bristle device can include an electric motor assembly comprising a housing, which can be cylindrical or oblong in shape, and an electric motor inside the housing, the electric motor connected to the spine for rotation thereof.

The eccentric rotation bristle device can be used to engage material, for example, human or animal hair. The method entails rotating the spine so that the bristles can engage the material.

For the embodiments using the bristle assembly wherein the bristle sets are allowed to move with respect to the bristle flanges, one embodiment disclosed herein moves the bristles in a radial fashion using channels in the bristle flanges. However, other ways can be employed to move the bristle sets as well with respect to the bristle flanges so that the bristles can extend from the brush barrel for material engagement. One alternative would be to configure the device to move the bristles sets with a longitudinal movement and then an angular movement so that the bristles can extend from the device barrel in a controlled fashion for material engagement. Of course, other configurations can be employed as long as they move the bristles in and out of the brush barrel as the disclosed embodiments illustrate and describe.

While the rods are shown as geared or free spinning, they could be fixed and just the rod barrel could rotate.

In yet another embodiment, the rod barrel could include bristles fixed to the barrel such that the bristles rotate with the barrel, the bristles extending through and beyond spaces between adjacent rods so as to contact material being treated by the device.

In yet another embodiment, the device can include a cap mounted at a distal end of the device, the cap configured to remain stationary when the rod barrel rotates. As an alternative to the stationary end cap, the device can include a cap mounted to the rod barrel and including means to allow the cap to rotate with the rod barrel. The cap can be configured to inhibit hair from traveling over an outer cap surface, for example, form a lip at the end of the rod barrel, and/or to a allow hair to slide off an outer cap surface if hair comes into contact with the outer cap surface, for example, form the cap with a tapered surface. Preferably, the cap is removably mounted to the device, either in the fixed or rotating embodiment.

In yet another embodiment, a speed of rotation of each of the rods can be greater than a speed of the rotation of the rod barrel.

BRIEF DESCRIPTION OF DRAWINGS

FIG. 2A is a front view while

FIGS. 9A-9C are perspective side views that mutually depict the fifth illustration in series continuing the assembly procedure described in FIGS. 5A-5C, FIGS. 6A-6B, FIGS. 7A-7C and FIGS. 8A-8B. Depicted here are the two (2) worm discs 9*b*-9*c* as each are fixed to the two (2) worm disc sheaths 9*a*-9*d*. This illustration further depicts how said parts are incorporated into and interact with the previously described assembly of parts.

FIG. 10A is a side view and FIG. 10B is a perspective top view depicting the now assembled round brush barrel 4*a*' incorporated into an electric motor driven, automatically rotating round brush appliance that includes a blow-dryer feature.

FIGS. 12A-12C are front views depicting, in series, a description of the mechanical motions that occur as the operator gradually pushes the lever 10*o* controlling the repositioning features of the bristles 1*d*'. Said depictions represent how each of the several positions of these mechanical aspects correspond to each of the several lever 10*o* positions.

DETAILED DESCRIPTION OF THE INVENTION (See FIG. 1 for the following) Attention is drawn to a version of a conventional manual round brush consisting of a hollow perforated tube 1*b* that surrounds a bristled 1*d* spine 1*c*. The bristles 1*d* are fixed to the spine 1*c* and the spine 1*c* is held suspended in the center of the perforated tube 1*b* by end caps 1*e*. The bristles 1*d* extend out of the perforated tube 1*b* through the pattern of perforations 1*f* that are located over the surface of the tube. The perforations 1*f* range in size and shape but are generally large enough to allow both a bristle 1*d* (or bundle of bristles depending on the design of the brush) along with air to move through the perforations 1*f*.

Figure 1:
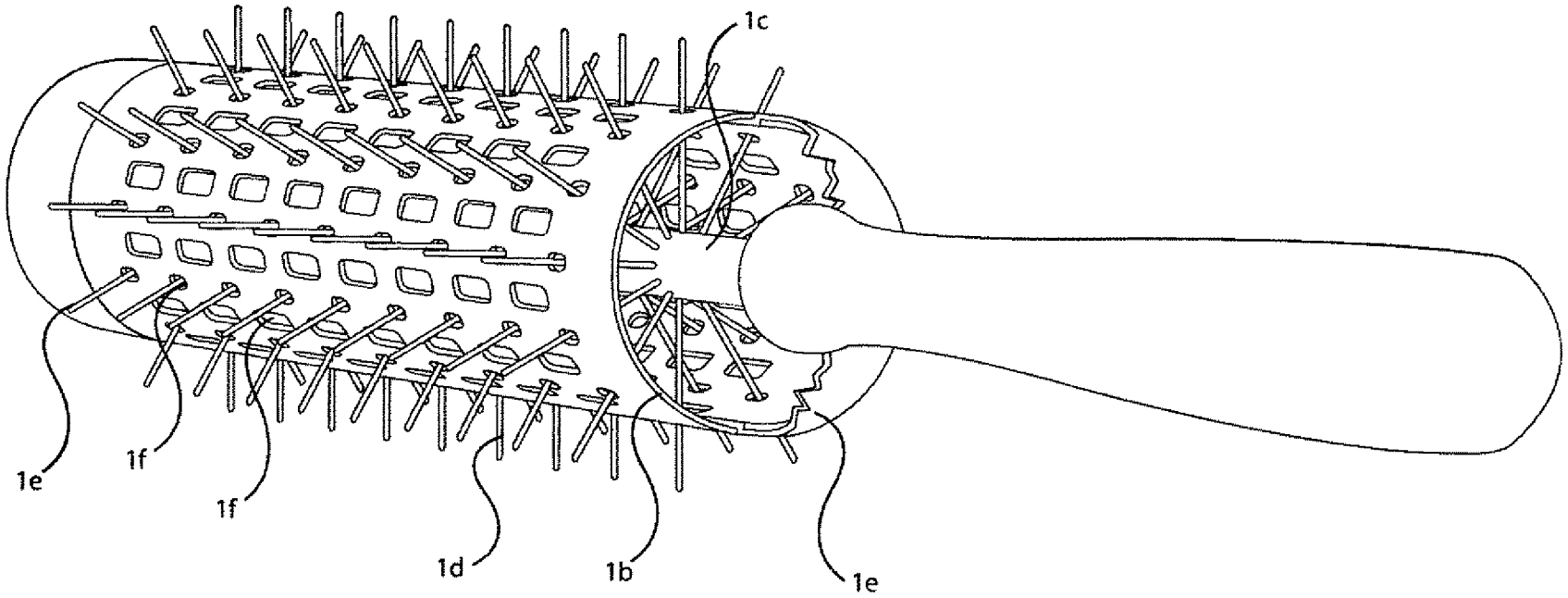
FIG. 1 is a perspective side view of a standard type of round brush presented as a visual point of reference for the overall description of the invention.
Figure 2B:
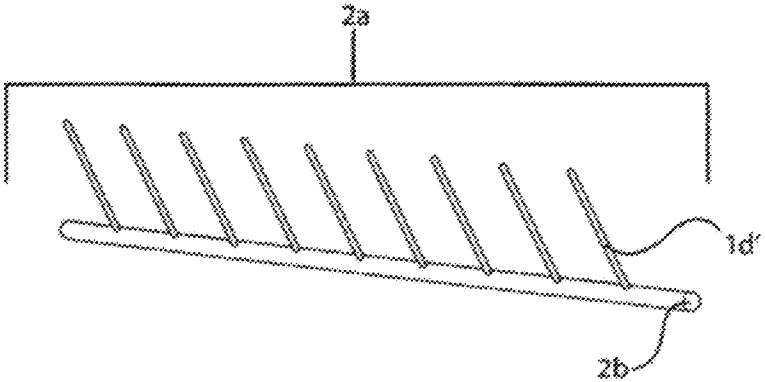
FIGS. 2B-2D are perspective views of the inventive brush, together illustrating the mechanical aspects required to convert the 'bristled 1*d* spine 1*a* centered within a perforated tube 1*b* type round brush barrel of FIG. 1 to the 'bristled 1*d*' spine 1*a* off center within a perforated tube 1*b*" type round brush barrel.
Figure 2D:
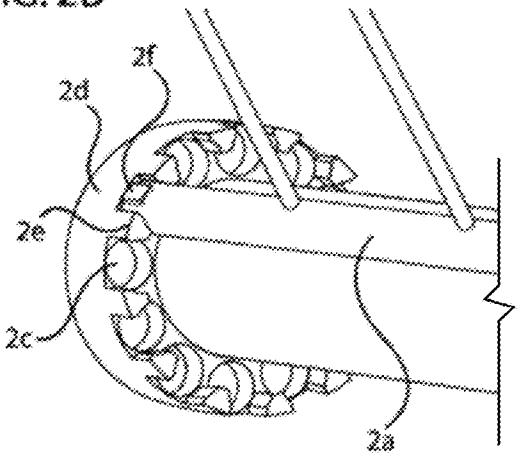
Figure 2A:
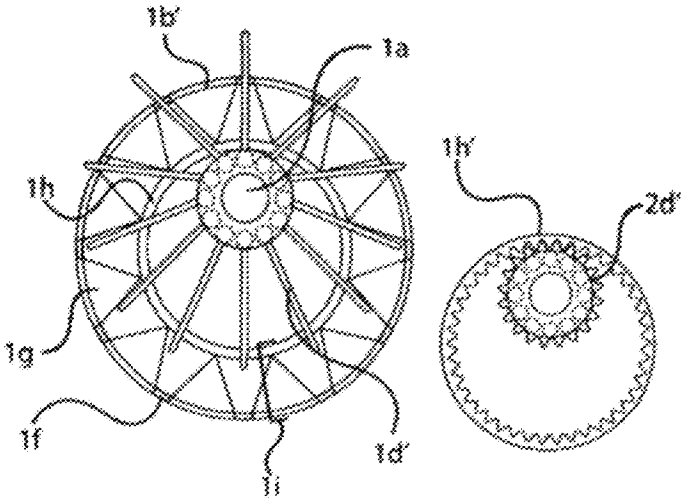

FIG. 2A is a circumferential view of a preferred basic mechanical arrangement of one embodiment of the inventive round brush configuration as compared to the standard round brush configuration described in FIG. 1. FIG. 2A depicts a round brush spine 1*a* positioned within a perforated tube 1*b*' with bristles 1*d*' extending radially away from said spine 1*a*. This view also depicts bristle guides 1*g* positioned fixed to the inside surface of the perforated tube 1*b*'. Also, a spacer ring 1*h* is centered within the perforated tube 1*b*' as said spacer ring 1*h* is fixed to the innermost edge of each bristle guide 1*g*. All perforated tubes described throughout this disclosure can include any of the various frictionless and/or slippery finishes to the outside surface. These coatings may include but are not limited to Teflon or PTFE. This feature is intended to eliminate the possibility of hair sticking to or being dragged along by the rotation of the barrels described below.

As illustrated in FIG. 2A, the spine 1*a* is positioned upward against the spacer ring 1*h* causing the bristles 1*d*' attached to the top of the spine 1*a* to extend out through the bristle perforations 1*f* at the top of the perforated tube 1*b*'. This spine 1*a* position also causes the bristles 1*d*' attached to the bottom of the spine 1*a* to retract into the perforated tube 1*b*'.

As this entire depicted assembly rotates, the spine 1*a* is maintained as the rotationally stationary axial, while allowing gravity to affect the perforated tube assembly against the spine 1*a*. The perforated tube assembly 1*i* consists of: the perforated tube 1*b*', bristle guides 1*g* and spacer rings 1*h*. As the bristles 1*d*' also extend through the perforated tube assembly 1*i*, said assembly is urged by the bristles 1*d*' to turn in tandem with the spine 1*a* while the top of the spine 1*a* continually rolls against the inside top of the spacer ring 1*h*. As the entire assembly depicted in FIG. 2A continues to rotate, and as said assembly maintains said rolling configuration [as depicted in FIG. 2A], it will also be noticed that each bristle 1*d*' moves through a continual extension and retraction cycle relative to each successive rotational position of the perforated tube assembly 1*i*.

The combined motion described above creates a novel and useful feature pertinent to the concept of a spinning round brush; as the brush turns, bristles sweep across the top of the brush barrel but do not sweep across the bottom of said barrel. This renders a spinning round brush, whether motor or manually turned, that may be used to smooth various lengths and textures of hair while perhaps eliminating, or at least, greatly reducing the potential for hair to become tangled around the spinning brush barrel. The reduction of this potential for tangling will be understood as becoming further enhanced as this disclosure continues to reveal additional features both related to, as well as indirectly related to, the issue of tangling. For now, however, more mechanical aspects of the invention that may be gleaned from FIG. 2A are described below.

While viewing FIG. 2A, notice the triangular bristle guides 1*g*. Said guides function to guide each bristle 1*d*' to extend out from, and retract into the perforated tube 1*b*' as each bristle 1*d*' rotates through each cycle. Arranged side by side around the inside surface of the perforated tube 1*b*', the bristle guides 1*g* create an equidistant circular continuum of triangular spaces. Said spaces are widest at the circumference of the spacer ring 1*h* and narrow outward toward the perforated tube 1*b*'. In this manner, each triangular space tapers to a row of bristle perforations 1*f*. The tapered spaces created by the bristle guides 1*g* are necessary to cope with the pivoting action of the bristles 1*d*'. The following includes a description of this pivoting action and the mechanical compensation required for said action.

Figure 2C:
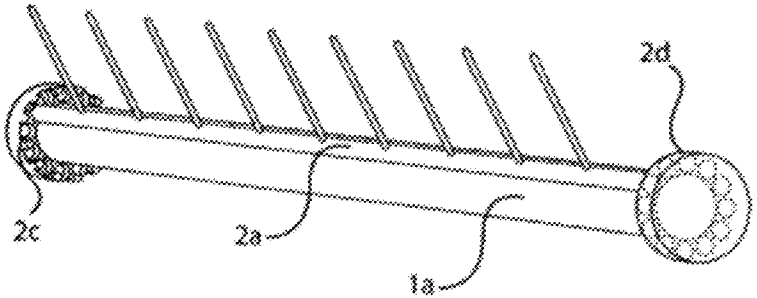

As seen in FIG. 2B, each bristle 1*d*' is attached side by side to a straight rod thereby forming a single bristle span 2*a*. Each bristle span end 2*b* is flat and round. This allows each end of a bristle span 2*a* to seat pivotally into a bristle span seat FIGS. 2C and 2D, 2*c*. Continuing to view FIGS. 2C and 2D, a ring of bristle span seats 2*c* is formed into each bristle span hub 2*d*, while a bristle span hub 2*d* is formed onto each end of a spine 1*a*. Further concerning the bristle span 2*a* pivoting action, FIG. 2D depicts a means that limits the degree of bristle span 2*a* pivot. First, said means consist of pivot restrictors 2*e* that extend away from the inside face of each bristle span hub 2*d* with each pivot restrictor 2*e* occupying each space between each bristle span seat 2*c*. The second of said pivot limiting means consists of a bristle span tab 2*f* located on each end of each bristle span 2*a*. Now, as the seated bristle span 2*a* pivots, the bristle span tab 2*f* will encounter each of the pivot restrictors 2*e* positioned on either side of said bristle span tab 2*f*. In this manner, the degree of bristle span 2*a* pivot action is limited to the degree necessary to compensate for the coincidence of: [1] the off-center rotation by the spine 1*a* and perforated tube assembly 1*i*, and [2] the necessary and variable deviation from a 90-degree projection of the bristles 1*d*' from the spine 1*a* that would not occur if the spine and perforated tube rotated centered to one another. Viewing FIG. 2A, the angles of projection of the bristles 1*d*' relative to the spine 1*a* vary circumferentially.

While the perforated tube assembly 1*i* is shown in terms of the triangular guides 1*g*, the spacer rings 1*h*, and the perforated tube 1*b*' as a means to facilitate the movement of the bristles 1*d*' inside and outside of the perforated tube 1*b*' during rotation thereof, the perforated tube 1*b*' could be sized and molded to have depressions along an inside of the perforated tube 1*b*' to provide channels that may be an alternative to the triangular guides 1*g* and spacer rings 1*h*. These channels will likewise guide the bristles 1*d*' to move toward, and therefore, in and out of the perforations 1*f*, during use of the bristle device. Similarly, the perforated tube 1*b*' could also be configured with an inner peripheral surface that would provide rolling surfaces for the perforated tube assembly 1*i* to roll on the spine 1*a*.

The bristles of the present embodiment are always engaged with the perforations and/or bristle guides of the barrel and this engagement is sufficient to turn the barrel as the bristled spine is driven. The bristles act as the gear that turns the barrel. Alternatively, and as seen in FIG. 2A, the outside spacer rings 1*h*'/rolling surfaces 1*h*' may include internal gear teeth and the bristle span hubs 2*d*' may also include gear teeth. These gears engage while in use and may be employed in the manual version of the present embodiment as well as the electric, auto-rotating version described below.

Versions of the above-described embodiment may be configured in such a manner that the bristles of the eccentrically rotating bristled spine may be fixed to a spine in various manners rather than positioned pivotally on a span 2*a* within a seat 2*c* on a hub 2*d*.

The mounting of the spine inside the perforated tube such that the rolling surfaces associated with the perforated tube rest on a portion of the spine, an axis of the spine is offset from an axis of the perforated tube, and the bristles extend into channels formed by the guide surfaces is one example or means to accomplish the functionality of the rotating bristle device, i.e., wherein rotation of the spine causes the rolling surfaces of the perforated tube to roll on the spine and eccentrically rotate the perforated tube with respect to the spine, the eccentric rotation of the perforated tube allowing the bristles to extend and retract from the perforations in the perforated tube during rotation. The extension as described above can be in a sequential manner, wherein the bristles sequentially extend and then retract from the perforations. As also described below, the rotating bristle device can be configured such that the bristles are either extended or retracted during rotation.

In operation, the rotating bristle device described in FIGS. 2A-3C or elsewhere in this description can be rotated manually or electrically so that the bristles could engage any desired material for any use or purpose. One example of material to be engaged would be hair for the purpose of manipulating the hair for styling or the like, but the use of the bristle assembly is not limited to this example.

As the preceding portion of this section describes the basic mechanical arrangement necessary to achieve the prerequisite performance of the rotating bristle device invention, the following portion describes various iterations of said rotating bristle device that expand upon the invention to describe additional features and assemblies.

Figure 3A:
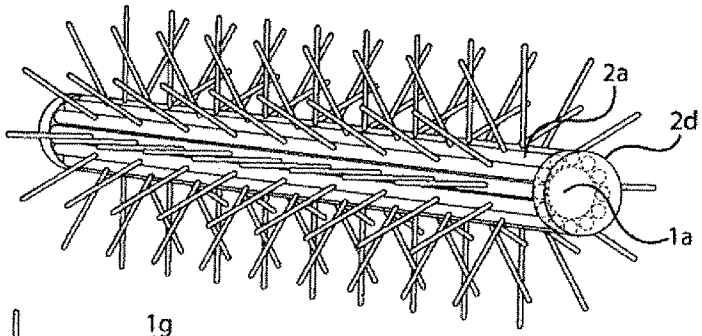
FIGS. 3A-3C are perspective side views collectively depicting a preferred embodiment of a manual 'bristled 1*d*' spine 1*a* off—center within a perforated tube 1*b*" type round brush.
Figure 3B:
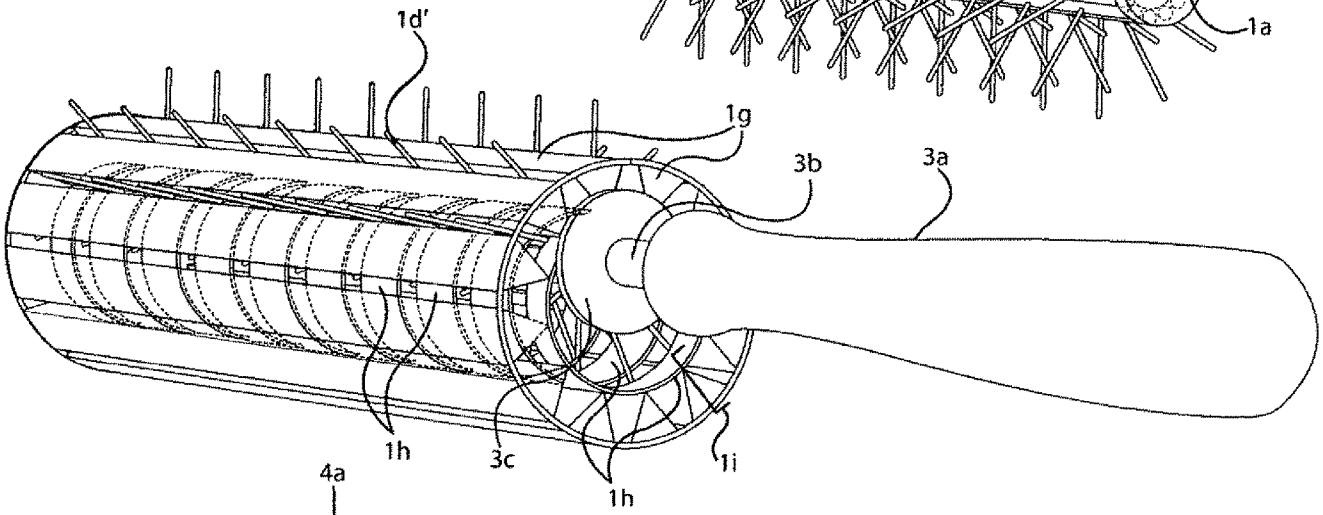
Figure 3C:
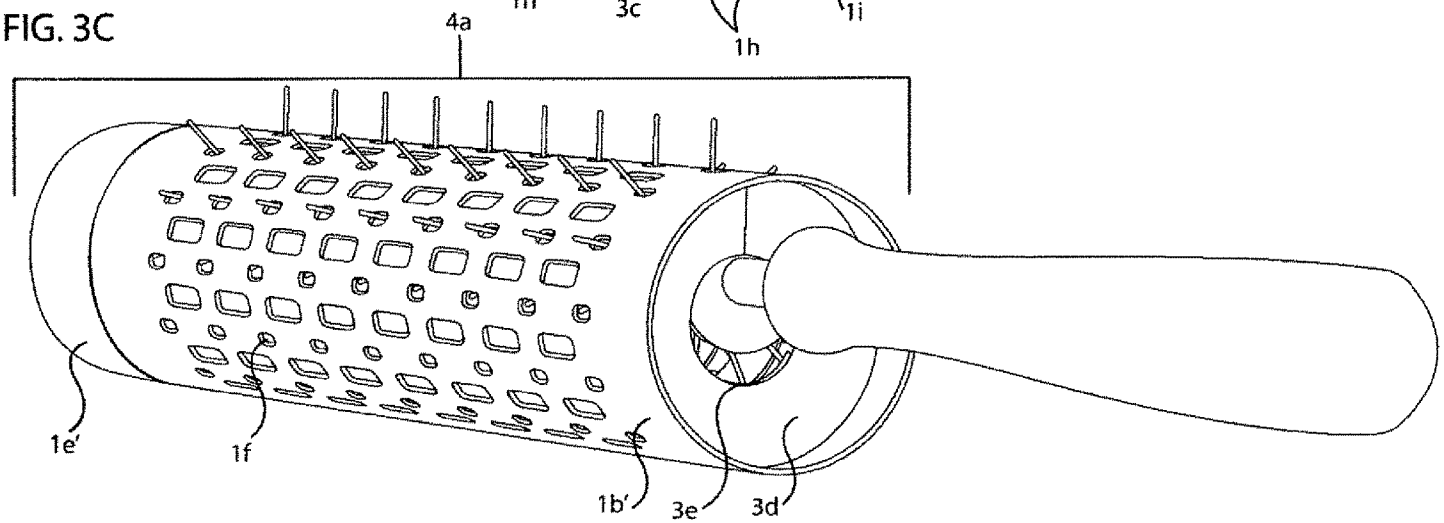

FIG. 3A depicts the spine 1*a,* bristle span hubs 2*d* and bristle spans 2*a* as they appear while assembled. FIG. 3C depicts a complete version of the present manual embodiment. FIG. 3B demonstrates the assembly depicted in FIG. 3A as it appears appropriately incorporated into a complete preferred manual embodiment of the invention. FIG. 3B also includes a handle 3*a,* spine extension 3*b,* alignment disc 3*c,* as well as the bristle guides 1*g* and spacer rings 1*h* as described before. Said bristle guides 1*g* and spacer rings 1*h* are depicted here again to provide a perspective view. Said view will also aid the reader in accurately visualizing the following preferred embodiment of the perforated tube assembly 1*i.*

As described previously, the spacer rings 1*h* and bristle guides 1*g* act together to guide the motion of each bristle 1*d*'. Said spacers 1*h* and guides 1*g* facilitate a reliable return of each bristle 1*d*' toward and through each applicable perforation 1*f,* from all positions that each bristle 1*d*' passes through. As previously described, said spacers 1*h* and guides 1*g* may just as effectively be substituted by shaping the inside surface of the perforated tube 1*b*' with a pattern of conical depressions that match the bristle guidance of the present spacers 1*h* and guides 1*g*.

Returning to a description of the parts depicted in FIGS. 3A-3C, a spine extension 3*b* extends away from the outside face of, and is fixed to, one bristle span hub 2*d*. Fixed to the spine extension 3*b* is a handle 3*a* and a stabilizer disc 3*c*. Said disc 3*c* is fixed to the spine extension 3*b* in a concentric manner and is sandwiched contiguously between the distal ends of the bristle guides 1*g* and the recessed tube cap 3*d*. The stabilizer disc 3*c* prevents the perforated tube assembly 1*i* from moving side to side [toward and away from the handle 3*a*] relative to the spine 1*a,* and is larger than the spine extension opening 3*e* thereby preventing the stabilizer disc 3*c* from slipping outside of the recessed tube cap 3*d*.

Notice that the spine extension opening 3*e* at the center of the recessed tube cap 3*d* is wider in diameter than the circumference of the spine extension 3*b*. This feature allows the perforated tube assembly 1*i* to remain against the spine 1*a* as said tube assembly spins while the operator turns the handle 3*a*. As the present iteration (FIGS. 3A-3C) maintains the mechanically offset relationship between the spine 1*a* and the perforated tube assembly 1*i,* it is maintained as such by reliance on gravity. This offset relationship is further maintained as the operator uses the brush in her hair. Laying the hair on top of said tube assembly and turning the brush from underneath in the direction that draws the hair away from the scalp causes the weight of the hair to further hold the perforated tube assembly 1*i* against the spine 1*a* as the operator manually turns the brush. Coincidentally, and as described previously, maintaining said offset relationship through said hair styling operation maintains the cycling of the bristles 1*d*' over the top of the perforated tube assembly 1*i,* thereby continuing the brushing action through the hair. Concurrently, the bristles cycling through the bottom of the perforated tube assembly 1*i* continue to retract back into said assembly, thereby, facilitating the continuing release of the just previously bristle entrained hair. This cycle of catch and release significantly reduces the probability of hair being bristle caught around the entire circumference of the perforated tube assembly 1*i*. This, of course, is a major cause of round brush tangling in general.

Figure 4:
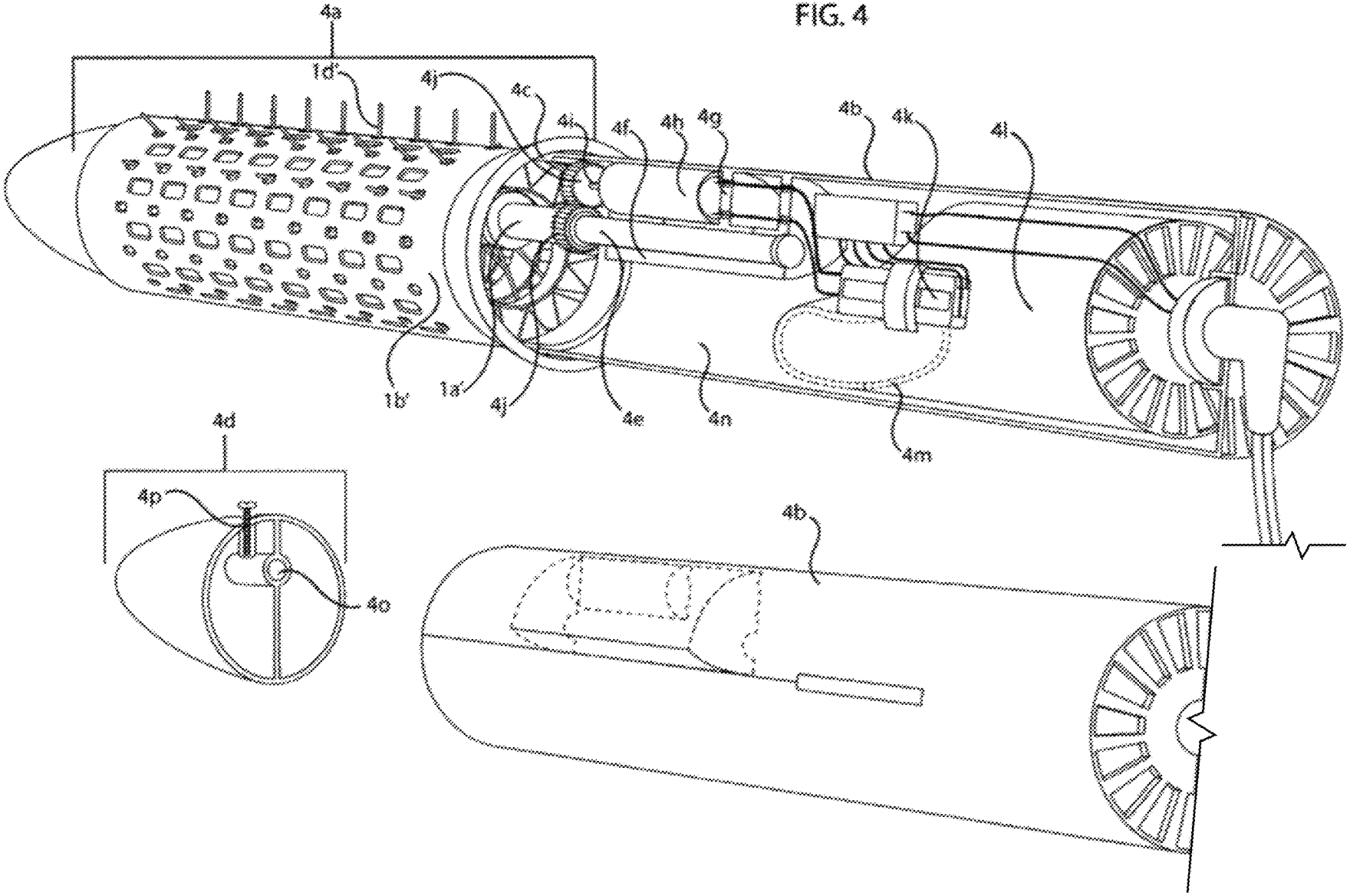
FIG. 4 is a perspective side view illustrating the 'bristled 1*d*' spine 1*a*' off—center within a perforated tube 1*b*" type round brush barrel incorporated into an electric motor driven, automatically rotating round brush appliance that includes a blow—dryer feature.

The following describes a preferred motorized iteration of the preceding FIGS. 3A-3C embodiment. The brush barrel 4*a* of FIG. 4 is identical in function; the differences lie in the mechanical means that actuate these functions. The following is a description of said means.

FIG. 4 depicts the brush barrel 4*a* positioned rotationally contiguous to the front of a motorized brush chassis 4*b*. The brush barrel 4*a* is held in said position as a barrel cap 4*d* is fixed to one end of a stabilizer shaft 4*e* while the opposite end of said shaft spans through the hollow spine 1*a*' of the brush barrel 4*a* and is fixed to the handle/chassis 4*b*. Said shaft is held fixed to the handle/chassis 4*b* at the shaft seat 4*f* location within the internal seating geometry that is molded into the handle/chassis 4*b*. The barrel cap 4*d* is held fixed to the stabilizer shaft 4*e* as the barrel cap 4*d* end of the stabilizer shaft 4*e* is inserted into the cap shaft seat 4*o* where upon the cap shaft seat screw 4*p* is tightened into the mated threaded opening in the stabilizer shaft 4*e*.

One inside circumferential edge of the perforated tube 1*b*' fits contiguously over the circumferentially lipped and recessed front edge of the handle/chassis 4*b*. Said handle/chassis front edge will be referred to as the chassis lip 4*c*.

The barrel cap end of the perforated tube 1*b*' overlaps the inside edge of the barrel cap 4*d;* this arrangement reduces the potential of hair becoming entangled along what would otherwise be the level, butt ended, rotational joint shared by the perforated tube 1*b*' and the barrel cap 4*d*. The handle/chassis 4*b* end of the perforated tube 1*b*' increases in diameter creating a concaved end of said tube. This angled outward end of the perforated tube 1*b*' also overlaps the handle/chassis 4*b*. The cylindrical overlap space of both perforated tube 1*b*' ends is wide enough that hair is not likely to become tangled in it if hair manages to slip sideways into said space. Also, hair will continually be drawn toward the center of the perforated tube 1*b*' from the angled outward handle/chassis 4*b* end of said tube, further reducing the opportunity for hair to become tangled in the spinning joint. The barrel cap 4*d* end of the perforated tube 1*b*' may taper outward like the chassis 4*b* end of said tube, or; alternatively, the barrel cap 4*d* end of said tube 1*b*' may taper inward for a distance over said cap while still maintaining the previously described space between the overlapping surfaces.

The internal handle/chassis 4*b* geometry includes a motor seat 4*g* that is shaped around and occupied by an electric motor 4*h*. Said motor is positioned over the stabilizer shaft 4*e* in a configuration that finds the distal end of the rotating motor rod 4*i* positioned over and above the proximal end of the spine 1*a*'. As both the distal end of the motor rod 4*i* and the proximal end of the spine 1*a*' are each occupied by a pinion gear 4*j*, and as said gears are engaged, electricity may be applied to the motor 4*h* and the brush barrel 4*a* will rotate. If the current of electricity is reversed, the brush barrel 4*a* will rotate in the opposite direction. An electrical switch 4*k* may be installed into the chassis 4*b* that will actuate said reversal. Furthermore, said switch may be of a type that also adjusts the speed of the rotation. Finally, said switch may also include the capacity to control the functioning of a blow-drying unit 4*l*. The front nozzle 4*m* of said unit will preferably be tapered to one side of the internal handle/chassis 4*b* as depicted. This tapering directs the hot air-flow through the air flow cavity 4*n* that is formed into the handle/chassis 4*b*.

Throughout this disclosure, and to avoid excessive explanation, reference will be made to several alternative features and embodiments of the present invention that the inventor hopes will fall within a range of simplicity and obviousness so that said alternative features and embodiments do not require drawings. The following is one such feature/embodiment.

The motorized embodiment described above may include a toggle that allows the bristles to assume two (2) positions relative to the barrel: one position that allows for the 'catch and release' bristle position and a second position that allows for an 'all bristles within the barrel' bristle position. Said toggle will include a switch that extends to the outside of the handle/chassis. Said switch will actuate a simple mechanism that moves the barrel relative to the handle/chassis to a position that centers the barrel over the bristled spine. As the barrel is in this centered position, all the bristles will be in the 'all bristles within the barrel' position.

Later in this disclosure, an embodiment will be described as having a barrel that is comprised of a circular arrangement of rods or tubes (see FIGS. 13A, 13*a* and 13*c*). The above-described bristled spine may also rotate eccentrically within said FIG. 13 barrel whether the FIG. 13A barrel rods 13*a* individually rotate on, or are fixed to the flanges as the overall barrel 13*c* spins. In the instance where the rods are fixed, they may be in the longitudinal shape of the bristle guide 1*g* of FIG. 2A or other shapes.

The following is a preferred embodiment of the present invention displaying an additional bristle position to the two described above. The bristles of this embodiment possess the ability to: entirely retract into the barrel, entirely protract out of the barrel, vary the degree of protraction of the bristles, as well as assume the position that allows the bristles to cycle between sweeping across the top of the barrel and retracting back into the barrel as previously described.

Figure 5A:
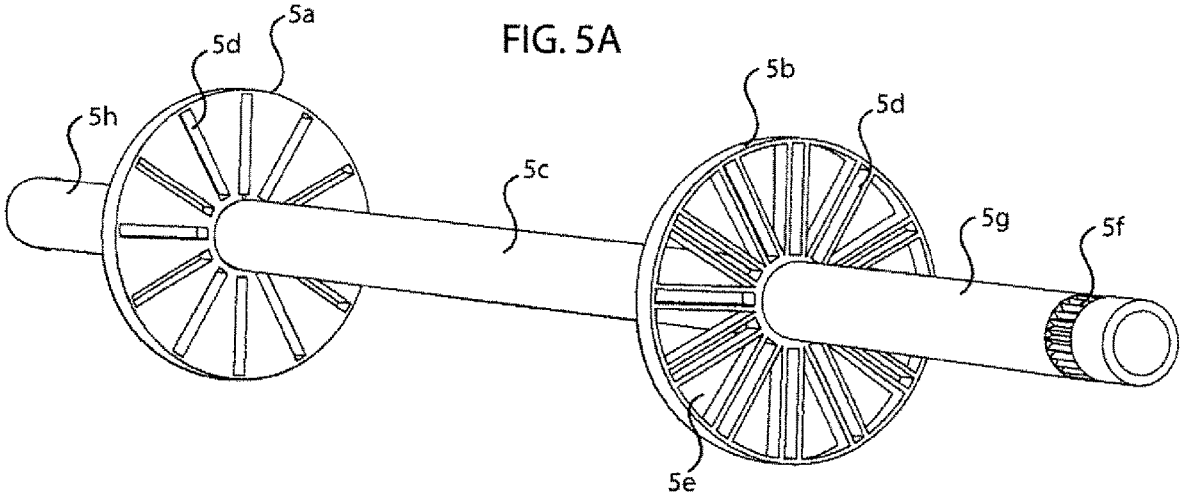
FIGS. 5A-5C are perspective side views and altogether depict the first in a series of a step-by-step assembly procedure of the mechanical aspects required to construct an alternative mechanical approach to achieving the novel features described in the previous figures. Depicted here are the two (2) bristle slide flanges 5*a*-5*b* as each is fixed to a hollow spine 5*c* assembly and includes bristle span 2*a*' placement.
Figure 5B:
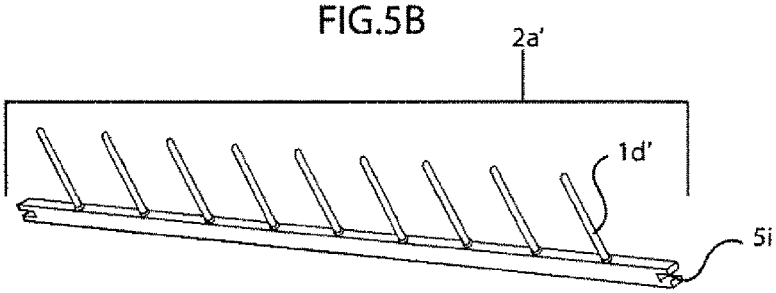
Figure 5C:
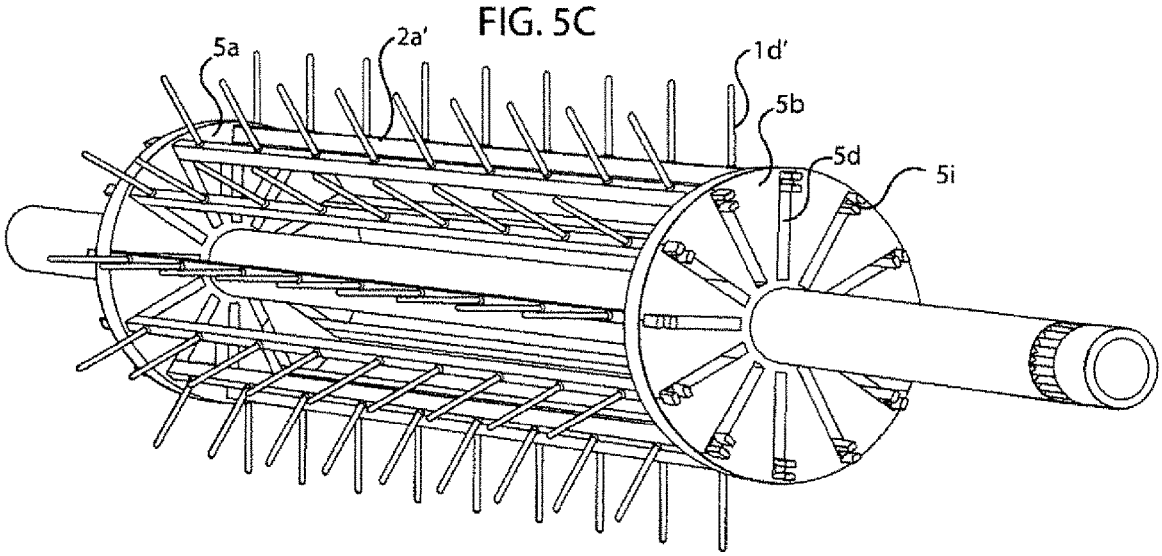
Figure 6A:
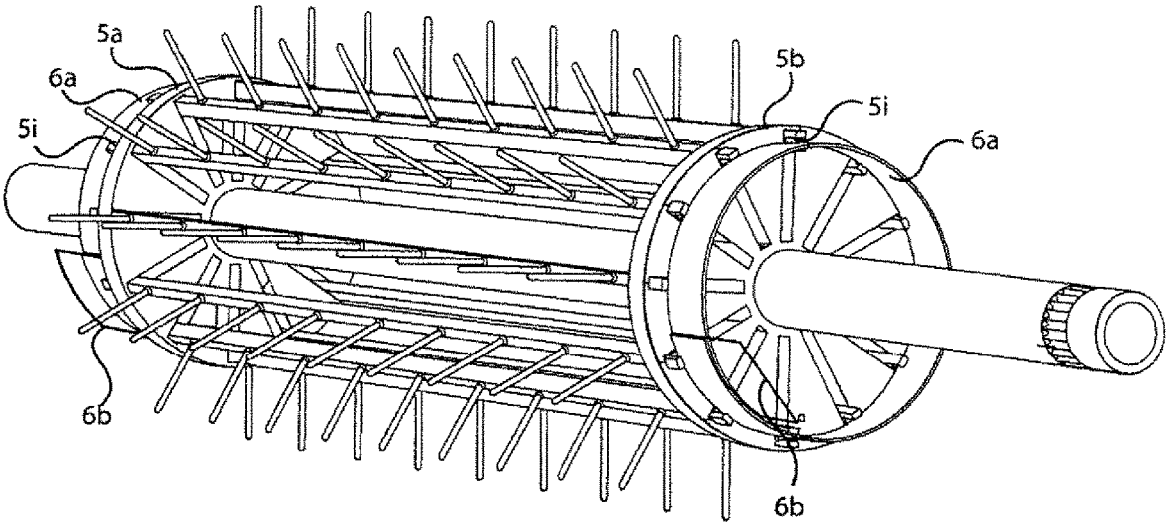
FIGS. 6A-6B are perspective side views and are concurrently the second illustration in series continuing the assembly procedure described in FIGS. 5A-5C. This Illustration depicts the placement of the retraction spring 6*a* and the slide brackets 6*c* and describes how said parts interact with the bristle spans 2*a*'.
Figure 11A:
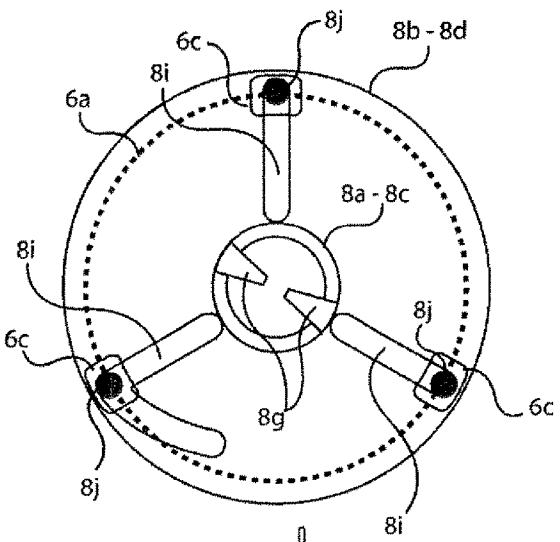
FIGS. 11A-11F are front views that provide an understanding of the mechanical process described in the proceeding FIGS. 12A-12C.
Figure 11B:
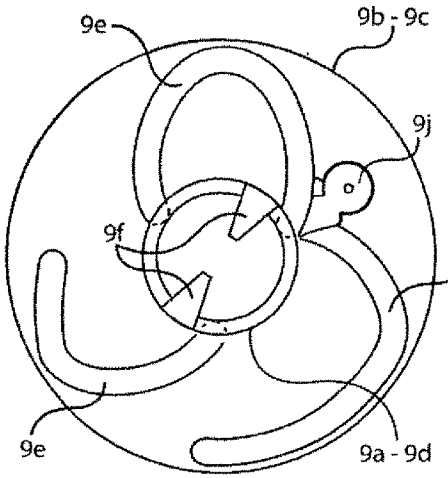
Figure 11C:
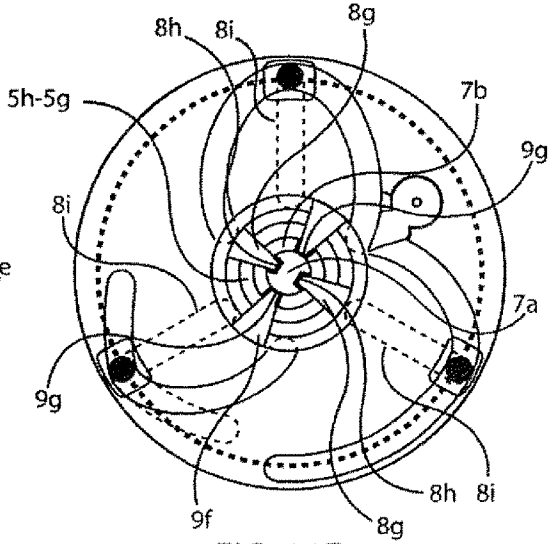
Figure 11D:
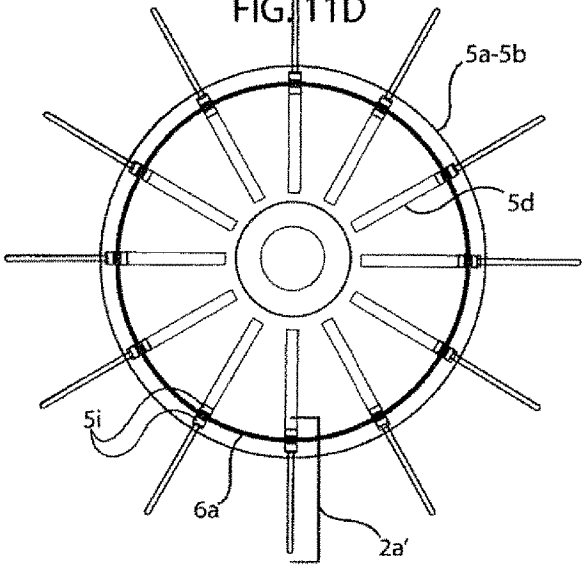

As seen in FIGS. 5B and 5C, the bristle spans 2*a*' may slide back and forth within the slide channels 5*d* of the bristle flanges 5*a* and 5*b*. Concurrent with this, the bristle span channels 5*i* on either end of each bristle span 2*a*' are engaged with a set of circular retraction springs FIGS. 6A, 6*a*, as the edge of each retraction spring FIGS. 6A, 6*a* that is facing each bristle flange 5*a* and 5*b* is between the two (2) prongs of each bristle span channel 5*i*. Now consider that the entire assembly depicted in FIGS. 6A and 11D is spinning except for the retraction spring 6*a*, which remains stationary. Said considered arrangement will find each bristle span channel 5*i*, as well as the bristle span 2*a*', riding along on each stationary retraction spring 11D, 6*a*, while each bristle span channel 5*i* remains within each outer end of each slide channel 5*d*

Figure 11E:
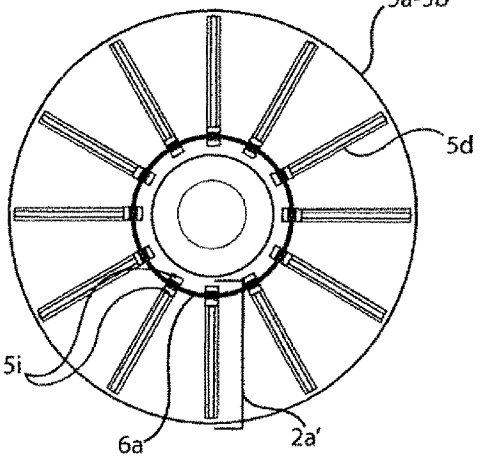

Now, while viewing FIG. 11E, consider that each stationary retraction spring 6*a* retracts and becomes smaller in diameter while remaining centered relative to the outside circumference of each bristle flange 5*a* and 5*b*. Coincidentally, each bristle span 2*a*' will slide toward the inner end of each slide channel 5*d* as each bristle span channel 5*i* of the spinning assembly simultaneously rides the shrinking retraction spring 6*a* inward.

Figure 11F:
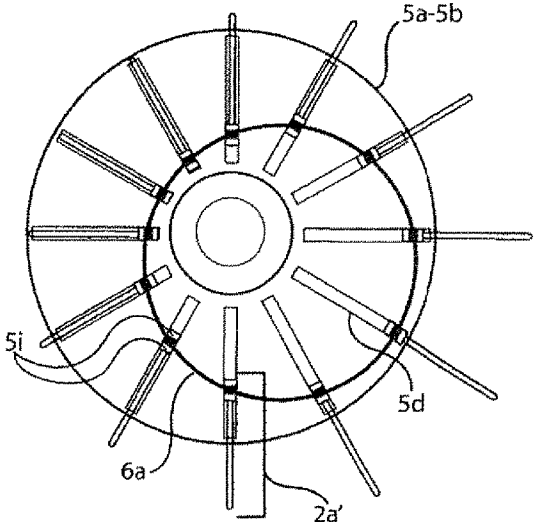

Consider now (as seen in FIG. 11F) that the non-spinning retraction spring 6*a* is positioned off center (relative to the circumference of each bristle flange 5*a* and 5*b*) with the bristle span channels 5*i* still engaged with the retraction spring 6*a*. One side of the spring 6*a* will be over the outside ends of the slide channels 5*d* and the opposite side of the spring 6*a* will be over to the inside ends of the slide channels 5*d*. Now, as the bristle flange 5*a* and 5*b* and bristle span 2*a*' assembly spins, all bristle spans 2*a*' will continually slide to the outer end of each slide channel 5*d* on one side of the assembly while all bristle spans 2*a*' continually slide to the inner end of each slide channel 5*d* on the opposite side of the assembly, as the bristle span channels 5*i* ride the eccentrically positioned retraction spring 6*a*.

With this understanding, and with the bristle flange 5*a* and 5*b* and bristle span 2*a*' assembly positioned appropriately inside a perforated tube (see FIGS. 10B, 10*a*), an alternative means to extend and retract bristles from a perforated barrel in the three modes just described will be evident. What remains to be explained is the means employed to retract, expand and position eccentrically, the retraction springs 6*a*.

Figures 7A, 7B, 7C:
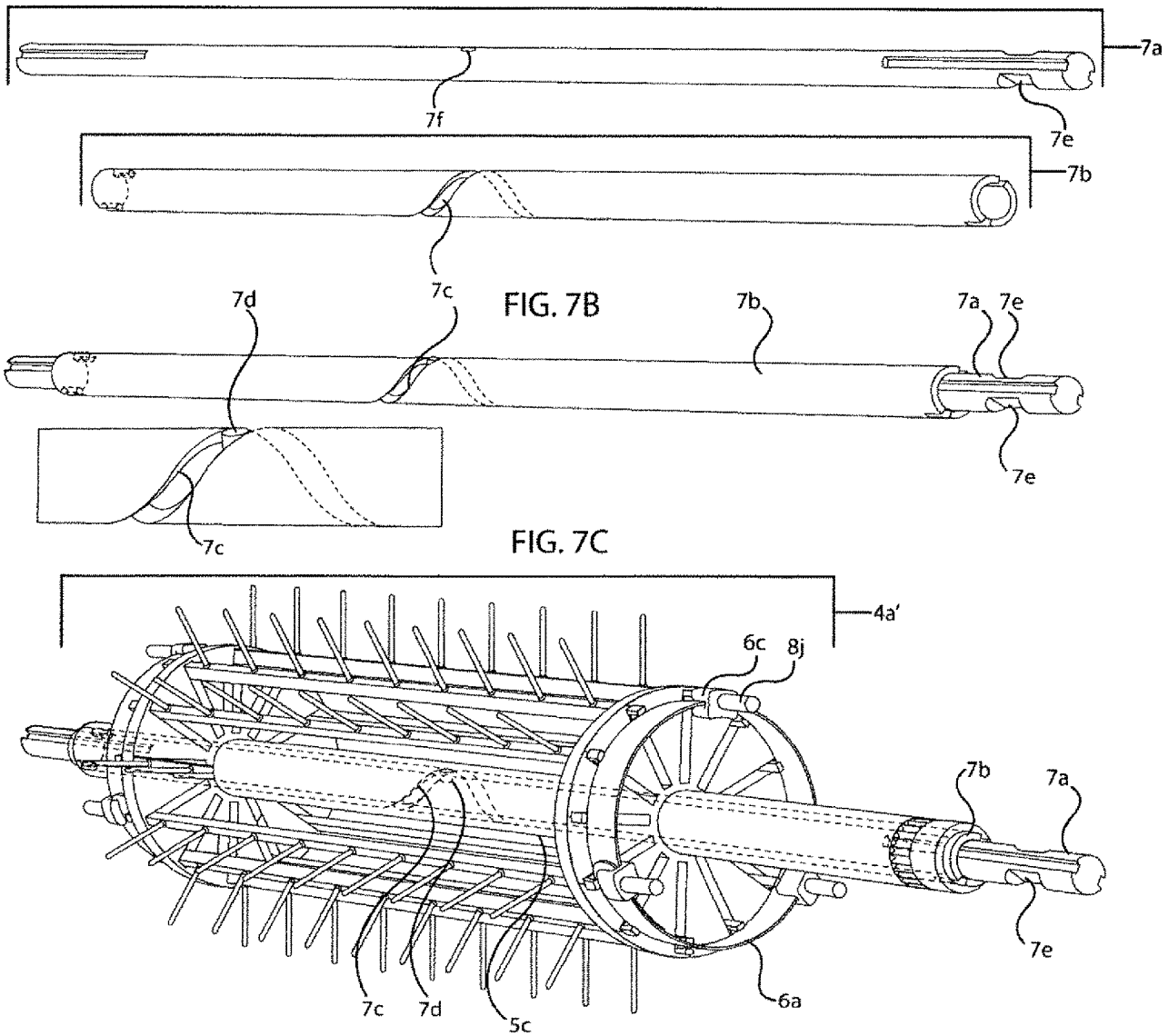
FIGS. 7A-7C are perspective side views that collectively represent the third illustration in series continuing the assembly procedure described in FIGS. 5A-5C and FIGS. 6A-6B. Depicted here are the bracket stabilizer rod 7*a* and the actuator rod 7*b*. These illustrations describe how said parts transfer motion through the hollow spine 5*c* from one side of the brush barrel assembly to the other side.
Figure 8A:
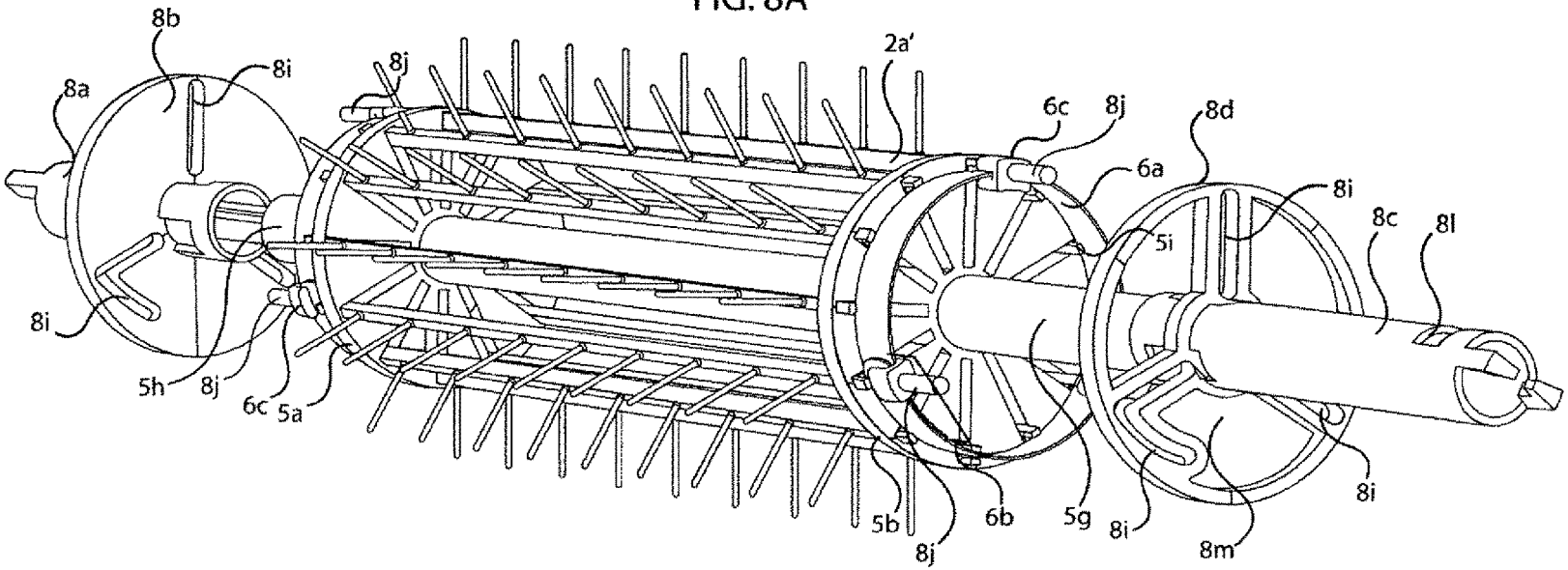
FIGS. 8A-8B are perspective side views that together, represent the fourth illustration in series continuing the assembly procedure described in FIGS. 5A-5C, FIGS. 6A-6B and FIGS. 7A-7C. Depicted here are the two (2) bracket stabilizer discs 8*b*-8*d* as each is fixed to the two (2) bracket stabilizer disc sheaths 8*a*-8*c*. This illustration further depicts how said parts are incorporated into and interact with the previously described assembly of parts.
Figure 8B:
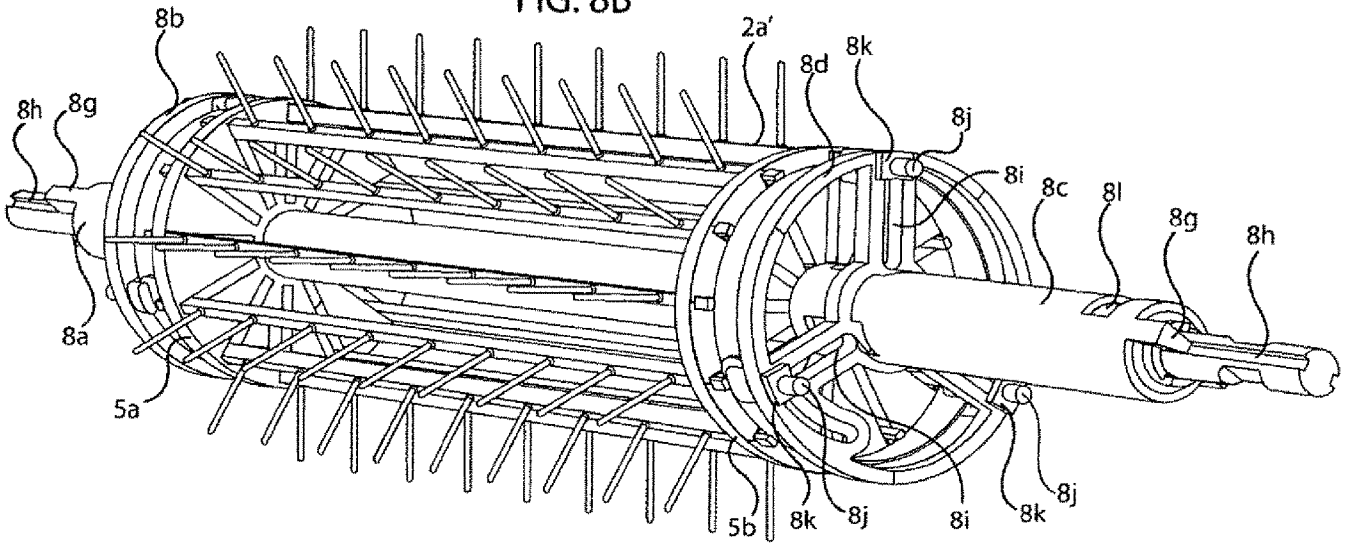

As seen in FIG. 7C, 3 brackets 6*c* are positioned along the outside edge of each retraction spring 6*a*. Attached to each bracket 6*c* is a bracket pin 8*j*. As seen in FIGS. 8A and 8B, each pin 8*j* occupies each bracket slide channel 8*i* of each stabilizer disc 8*b* and 8*d*.

Each of the two stabilizer discs 8*b* and 8*d* is positioned on the outside of each bristle span flange 5*a* and 5*b* and remains stationary as per the handle. The purpose of the stabilizer discs 8*b* and 8*d* and their bracket slide channels 8*i* is to guide the motion of the retraction springs 6*a* as the movement of the brackets 6*c*, and therefore, each retraction spring 6*a*, is confined to the sliding allowance of each bracket pin 8*j* as each bracket pin 8*j* is positioned within each bracket slide channel 8*i* of each stabilizer disc 8*b* and 8*d*.

As seen in FIGS. 9A and 9B, the inward and outward movement of each bracket pin 8*j* is actuated by the partial side to side pivot of the worm gears 9*b* and 9*c* and relative to the stationary stabilizer discs 8*b* and 8*d*. Each of the two worm discs 9*b* and 9*c* is positioned flatly adjacent to the outside of each of the two stabilizer discs 8*b* and 8*d*. The bracket pins 8*j* extend through the bracket slide channels 8*i*, and into the worm channels 9*e* as seen in FIG. 9B. The stabilizer discs 8*b* and 8*d* remain stationary and the worm disks 9*b* and 9*c* are actuated to pivot clockwise and counter clockwise; each direction of turn is approximately one third (⅓) of a full rotation. The brackets 6*c* move inward and outward as the two sets of slide channels 8*i* and 9*e* push against each bracket pin 8*j* as per a 'scissors action'.

Below is a detailed description of the entire mechanical assembly that is necessary to actuate the mechanical operations described above.

FIG. 5A depicts a front bristle flange 5*a* and a rear bristle flange 5*b* fixed [at a distance to one another] concentrically to a hollow spine 5*c*. Formed into said flanges are equidistantly spaced, slide channels 5*d*. Said channels begin at, then extend radially away from the hollow spine 5*c* and end at the outer circumference of each bristle flange 5*a* and 5*b*. Notice the airflow spaces 5*e* between each slide channel 5*d* on the rear bristle flange 5*b* as well as the lack of said spaces on the front flange 5*a*. This arrangement is present for a directional airflow feature described later in this disclosure. The airflow spaces 5*e* of the rear flange 5*b* will not be depicted throughout the remainder of this disclosure. It is the author's hope that this will minimize the visual complexity of the Illustrations as parts continue to layer.

Another feature present in FIGS. 5A and 5C is the set of recessed gear teeth 5*f* that surrounds the back of the rear spine extension 5*g*. This gear teeth 5*f* feature will also be elaborated upon later.

FIG. 5B depicts a single bristle span 2*a*'. As depicted in FIG. 5C, each slide channel 5*d* is occupied by one end of a single bristle span 2*a*' as each of said spans bridges the space between the two bristle flanges 5*a* and 5*b* with all of the bristles 1*d*' radiating outward. While viewing FIGS. 5B and 5C, notice the bristle span channel 5*i* formed into both ends of each bristle span 2*a*'.

Figure 6B:
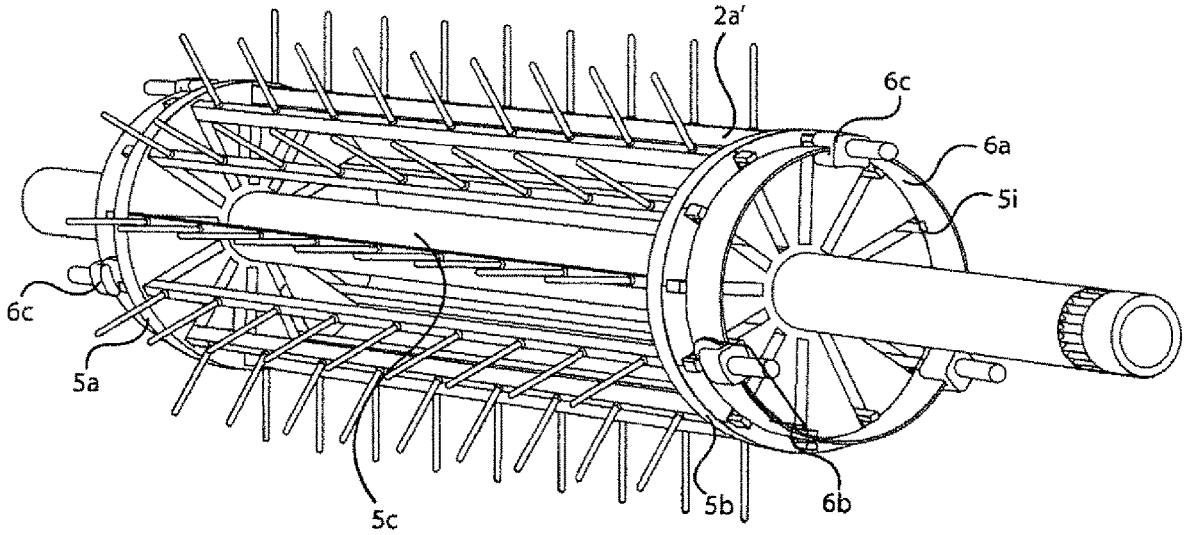

While viewing FIG. 6A, notice each bristle span channel 5*i* functions as a receiver of one edge of a circular retraction spring 6*a*. Said spring is preferably the thin ribbon type retraction spring commonly found in a retractable tape measure. More preferably, it is a section of said spring type that is of a length to complete a full circuit that finds the edge of said spring 6*a* occupying all bristle span channels 5*i* while including an overlap 6*b* of said spring ends. This spring end overlap 6*b* will preferably be of a length that will occupy a minimum of two bristle span channels 5*i*. As seen in FIG. 6B, each retraction spring 6*a* is held simultaneously within each bristle span channel 5*i* by three slide brackets 6*c*. An inward force is then applied equally to the three equidistantly spaced slide brackets 6*c* positioned around the perimeter of each spring 6*a*. The inward force of each slide bracket 6*c* slides each bristle span 2*a*' toward the spine 5*c*. Also, as seen in FIG. 6B, the side edges of each bristle span channel 5*i* and each slide bracket 6*c* are rounded to cope smoothly with the rotation of the bristle span channels 5*i* over the spring 6*a*, as the rounded edges of the bristle span channels 5*i* and slide brackets 6*c* encounter the rounded edges of each spring 6*a* created by the overlap 6*b*.

As described previously in FIGS. 5A-C, the bristles are capable of several functional settings. It is necessary for a portion of the mechanical action related to said functional settings to be transferred through the inside of the hollow spine 5*c*. The following is a description of the telescopic mechanical communication assembly that occupies the inside of the spine 5*c*.

FIG. 7A depicts the bracket stabilizer rod 7*a* and the bracket actuator rod 7*b*. As seen in FIG. 7B, said stabilizer rod 7*a* slides telescopically inside said actuator rod 7*b*. Notice the short spiral of open worm gear thread 7*c* formed into the actuator rod 7*b*. A tread pin 7*d* is installed flush through said thread and into the thread pin seat 7*f* located on the bracket stabilizer rod 7*a*. As depicted in FIG. 7C, the now telescopically joined bracket stabilizer rod 7*a* and bracket actuator rod 7*b* are positioned telescopically within the hollow spine 5*c*. The stabilizer rod 7*a* has a bracket stabilizer rod recess 7*e*, which is described below.

The following is a description of the two telescopic disc assemblies responsible for stabilizing and guiding the movement of the slide brackets 6*c*, and coincidentally, the bristle spans 2*a*'. Notice in FIG. 8A, the front bracket stabilizer disc sheath 8*a* of the front bracket stabilizer disc 8*b* fits telescopically over the front spine extension 5*h* while a rear bracket stabilizer disc sheath 8*c* of the rear bracket stabilizer disc 8*d* fits in like manner over the rear spine extension 5*g*. Notice in FIG. 8B, the front stabilizer disc rod tooth 8*g* slides into the front stabilizer rod tooth channel 8*h*. Likewise, the rear stabilizer disc rod tooth 8*g* slides into the rear stabilizer rod tooth channel 8*h*. While continuing to view FIGS. 8A and 8B, notice another assembly engagement; the six (6) bracket slide channels 8*i* formed into the two (2) bracket stabilizer discs 8*b* and 8*d* [three (3) bracket slide channels 8*i* per stabilizer disc 8*b* and 8*d*] engage with the six (6) bracket pins 8*j*. The final assembly engagement to view in FIG. 8B is the six (6) pin locks 8*k* fixed over the six (6) bracket pins 8*j*. Notice the flat back of each bracket 6*c* in FIG. 8A. Combined with the flat front of each bracket pin lock 8*k* in FIG. 8B, each of these six (6) sets of two flat surfaces sandwich each bracket stabilizer channel 8*i* in a tight fashion while allowing for a smooth slide of each bracket 6*c* up and down each stabilizer channel 8*i*. Also, notice the gear access opening 8*l* located on the rear bracket stabilizer disc sheath 8*c* and the air flow spaces 8*m* located on the rear bracket stabilizer disc 8*d*. These features will be touched on later.

FIGS. 9A-9C describes the final mechanical aspects incorporated into the brush barrel that are responsible for moving the slide brackets FIGS. 6B, 6*c* and therefore the bristle spans 2*a*'. Notice in FIG. 9A, the front worm disc sheath 9*a* slides telescopically over the front bracket stabilizer disc sheath 8*a*. As depicted in FIG. 9B, this positions the front worm disc 9*b* flatly adjacent to the front bracket stabilizer disc 8*b*. Continuing with FIG. 9B, a small space 9*k* can be seen between said discs around most of the circumferential edge of said discs. This space 9*k* occurs as the back of the front worm disc 9*b* rest contiguously against the front of the bracket pin locks 9A, 8*k*. The rear bracket stabilizer disc 8*d* and rear worm disc 9*c* as well as the rear bracket stabilizer disc sheath 8*c* and rear worm disc sheath 9*d* share the same assembled spatial and positional relationships as the frontal counterparts just described, yet mirrored. While said discs and sheaths are positioned as seen in FIG. 9B, each end of the six (6) bracket pins 8*j* engage with each of the six (6) respective worm channels 9*e* [three (3) worm channels 9*e* per worm disc 9*b* and 9*c*. Concurrently, each of the four (4) worm disc sheath teeth 9*f* [two (2) teeth per worm disc sheath 9*a* and 9*d* end] engage with each of the four (4) actuator tooth notches 9*g*; two (2) actuator tooth notches 9*g* are located on either end of the actuator rod 7*b*. FIG. 9C provides a larger view of said teeth 9*f* and notches 9*g*. Also, notice the air flow spaces 9*h*, gear access opening 9*i* located on the rear worm disc sheath 9*d* and each worm channel lever 9*j* positioned on the front and rear worm discs 9*b* and 9*c*. These mechanical aspects will be described later in this disclosure.

FIGS. 10A (side view) and 10B (top perspective view) are detailed depictions of the present embodiment as it has been described and depicted thus far and as said assembly is further incorporated into a perforated tube 10*a* and device body/chassis 10*b*.

The following is a description of lips and depressions that hold the barrel together as well as to the handle/chassis. These lips and depressions are only depicted in FIG. 10A in their entirety and do not appear in FIGS. 9A and 9B.

FIG. 10A depicts the brush barrel 4*a*' positioned contiguous to the front of a chassis 10*b*. As seen in FIGS. 10A and 10B, the brush barrel 4*a*' is held in said position as the rear worm disc sheath 9*d* is positioned inside the chassis worm disc sheath receiver 10*c*. Said sheath is held contiguous to, yet unable to slide out of, said receiver as the worm disc sheath receiver depression 10*d* [that surrounds the inside of said receiver] functions as a rotationally contiguous seat for the [likewise surrounding] worm disc sheath lip 10*e*. The bracket stabilizer disc sheath 8*c* is likewise rotationally seated to the worm disc sheath 9*d* from the outside by the worm disc sheath depression 10*f* and the bracket stabilizer sheath lip 10*g*, and from the inside by the bracket stabilizer depression 10*h* and the hollow spine lip 10*i*. May it suffice to state that the barrel cap 10*j* is contiguously attached to the front of the barrel by the same digression of lips and depressions described above. Several methods may be employed to seat said lips and depressions over one another in the assembly process. The disc and sheath unit may be molded with a split lengthwise on one side so that the sheath and disk may expand at the split for a moment as said units may be malleted together with some force, thereby, permanently mating the units together at the lip/depression location. Another way to assemble these telescopic sheaths would be to simply mold them in halves and then fuse the halves together over one another.

May it also suffice to state that the rear circumferential edge of the perforated tube 10*a* is contiguously positioned against the front circumferential edge of the handle/chassis 10*b* in like manner to the same parts of the previously described motorized embodiment of FIG. 4.

As seen in FIG. 10B, an electric motor 10*k* is attached to the handle/chassis 10*b* at the motor seat 10*l*. The motor seat 10*l* is molded into the inside geometry of the handle/chassis 10*b*. The motor pinion gear 10*m* is attached to the spinning rod 10*n* of the motor 10*k*. The motor pinion 10*m* passes through the gear teeth access 8*l* of the rear bracket stabilizer disc sheath 8*c* as well as the gear access 9*i* of the rear worm disc sheath 9*d* to align with the gear teeth 5*f* that are molded recessed into the rear hollow spine extension 5*g*. As can be seen, the gear access 9*i* of the rear worm disc sheath 9*d* circumferentially traverses said sheath for a longer distance than the gear teeth access 8*l* of the bracket stabilizer disc sheath 8*c*. This arrangement allows the rear worm disc sheath 9*d* to pivot while the motor pinion 10*m* teeth and gear teeth of the rear hollow spine extension 5*g* remain engaged.

As seen in FIG. 10A, the control arm 10*o* is hinged to the control arm stabilizer 10*p*. The control arm stabilizer 10*p* is attached to the inside bottom of the handle/chassis 10*b*. As seen in FIG. 10B, the control arm 10*o* is split into two (2) sections; one section is hinged to the bottom of one side of the control arm stabilizer 10*p* and a second section of the control arm 10*o* is hinged to the other side of said stabilizer. Said stabilizer 10*p* is therefore sandwiched between the two sides of the control arm 10*o*. The bracket stabilizer rod recess 7*e* is also sandwiched between the two sections of the control arm 10*o*. Also, see FIG. 7B for a more complete view of the stabilizer rod recess 7*e*. The two sections of the control arm 10*o* join at the top of said arm 10*o*. This joined section of the control arm 10*o* emerges through the control arm slot 10*r* located at the top of the handle/chassis 10*b*. A control arm button 10*s* is attached to the top of the control arm 10*o*. The control arm 10*o* pivots front to back on the control arm pin 10*t*.

For the following, see FIG. 10A for the central position of the control arm 10*o* and bracket stabilizer rod recess 7*e*, as well as the two additional positions of the control arm 10*o* and bracket stabilizer rod recess 7*e* represented by dashed lines in FIG. 10A. As mentioned, the two sections of the control arm 10*o* sandwich the bracket stabilizer rod recess 7*e*. (See the two additional dashed line positions of the bracket stabilizer rod recess 7*e* depicted in FIG. 10A). The three (3) pivotal positions of the control arm 10*o*, and consequently, the three (3) slide positions of the bracket stabilizer rod 1*a*, control the three (3) bristle positions that the present embodiment may assume. While the control arm is in the central position, the bristles are in the fully extended position as depicted in FIGS. 10A and 10B. The following is a description of the mechanical action that causes the bristles to assume two (2) additional positions. FIGS. 11A-11C depict the layered mechanical assemblies that interact with the movement of the control arm 10*a* to cause the bristles to assume the two (2) additional positions.

FIG. 11A is a circumferential view of both bracket stabilizer discs 8*b* and 8*d*, as well as both stabilizer disc sheaths 8*a* and 8*c*. Also, depicted in FIG. 11A are the stabilizer channels 8*i*, bracket stabilizer teeth 8*g*, slide brackets 6*c*, slide bracket pins 8*j* (filled black circles), and the retraction springs 6*a* (dashed line). The two (2) bracket stabilizer assemblies in FIG. 11A are as they would appear in isolation looking straight down the present embodiment of brush barrel.

FIG. 11B is a circumferential view of both worm discs 9*b* and 9*c* as well as both worm disc sheaths 9*a* and 9*d*. Also, depicted in FIG. 11B are the worm channels 9*e*, worm sheath teeth 9*f*, and worm channel lever 9*j*. As with FIG. 11A, the two (2) assemblies in FIG. 11B are as they would appear in isolation looking straight down the brush barrel of the present embodiment.

FIG. 11C is a circumferential view of the components of 11A and 11B overlapped while, again, looking straight down the brush barrel. Also, depicted here are the bracket stabilizer rod 7*a* along with the tooth channels 8*h* of said rod, the bracket slide channels 8*i*, the bracket actuator rod 7*b*, along with the tooth notches 9*g* of said rod and both hollow spine extensions 5*h* and 5*g*. Notice the bold black outlines around the tooth tips as depicted in FIG. 11C. Said lines delineate the point where the teeth 8*g* and 9*f* and the respective rod notches 9*g* and rod channels 8*h* are engaged.

FIGS. 12A(1) and 12B(1) are the mechanical assemblies depicted and described in FIG. 11C. FIGS. 11A-11C are also the same relative rotational configuration as they will appear while the control arm 10*o* is in the central position (See FIG. 10 for control arm 10*o* position). Said position is also responsible for establishing the bristles spans 2*a*' in the rotational setting of fully extended. FIG. 12A(4) is the same mechanical assembly depicted in FIG. 11C but in a different configuration. This configuration establishes the bristle spans 2*a*' in the rotational setting of alternating between extension and retraction i.e., as the brush barrel rotates, the bristles 1*d*' continually sweep extended over one side of the rotating barrel while the bristles on the other side of the rotating barrel continually retract. This setting is achieved by pushing the control arm 10*o* to the farthest forward position (See FIG. 10A for said control arm 10*o* position). FIG. 12B(4) is also the mechanical assembly depicted and described in FIG. 11C and is a third configuration. This configuration establishes the bristles 1*d*' in the rotational setting of fully retracted into the brush barrel. This setting is achieved by pushing the control arm 10*o* to the farthest backward position (See FIG. 10A for said control arm 10*o* position). Other settings between the three described thus far are also possible, for instance; pushing the control arm 10*o* to a position half way between center and fully forward will allow the user to employ spinning bristles of half the length of the fully extended position. Furthermore, a control arm 10*o* position of halfway between center and fully backward will provide spinning bristles that are longer one side of the spinning barrel and shorter on the other side, and so on.

FIG. 12C is a perspective depiction of the central telescopic rod assembly. This assembly corresponds to the assemblies depicted and described in FIG. 12A(1-4) and FIG. 12B(1-4) and is a reference intended to aid in the description of the progression of mechanical configuration depicted in FIG. 12A(1-4) and FIG. 12B(1-4).

As stated above, FIG. 12A(1) depicts the position of parts as they are configured with the control arm 10*o* in the central position with the bristle spans 2*a*' fully extended. (See FIG. 10A for control arm 10*o* position). As the control arm 10*o* is pushed forward, the parts configuration of FIG. 12A(1-4) occurs.

The following is a description of the prerequisite mechanical interactions responsible for the change in the parts configuration between FIG. 12A(1) and FIG. 12A(2). As described earlier (Refer also to FIGS. 7A-7C and FIGS. 10A and 10B), the thread pin 7*d* is fixed into the thread pin seat 7*f* of the bracket stabilizer rod 7*a*. The tread pin 7*d* then extends outward from the bracket stabilizer rod 7*a* and into the thread 7*c* located on the bracket actuator rod 7*b*. Now, as the bracket stabilizer rod 7*a* moves forward within the bracket actuator rod 7*b*, the thread pin 7*d* pushes forward against the front wall of the worm gear thread 7*c*. While this occurs, the bracket stabilizer rod 7*a* is prevented from rotating inside the bracket actuator rod 7*b* as the bracket stabilizer rod recess 7*e* is sandwiched between the two (2) sections of the control arm 10*o* (See FIG. 10A for control arm 10*o* position). Now, as the thread pin 7*d* pushes against the inside front edge of the worm gear thread 7*c*, and as the bracket stabilizer rod 7*a* is prevented from rotating, the bracket actuator rod 7*b* begins to rotate. As the bracket actuator rod 7*b* rotates while the bracket stabilizer rod 7*a* moves non-rotationally forward within the bracket actuator rod 7*b*, the front and rear stabilizer disc sheath teeth 8*g* are engaged with the front and rear stabilizer rod tooth channels 8*h* of the bracket stabilizer rod 7*a* (see also FIG. 11C). This prevents the front and rear bracket stabilizer sheaths 8*a* and 8*c* as well as the front and rear bracket stabilizer discs 8*b* and 8*d* from rotating (see also FIG. 11A). Concurrently, the front and rear worm disc sheath teeth 9*f* are engaged with the front and rear actuator rod notches 9*g* (see also FIGS. 9C and 11C). This causes the front and rear worm disc sheaths 9*a*-9*d* and the front and rear worm discs 9*b*-9*c* to rotate (see also FIG. 11B).

(Continuing with FIG. 12A(2)) It has, therefore, been established that the front and rear bracket stabilizer discs FIGS. 11A, 8*b*-8*d* do not rotate, while the front and rear worm discs FIGS. 11B, 9*b*-9*c* rotate counter clockwise when the control arm 10*o* is pushed forward (see FIG. 10A-10B). Thus established, notice in FIG. 12A(2) the slide bracket pins 8*j* (bold black dots) as well as the slide brackets 6*c* attached to said pins 8*j* begin to slide inward along the bracket slide channels 8*i* as said pins 8*j* and brackets 6*c* are simultaneously pushed along by the worm disc thread channels 9*e*. As this occurs, the retraction springs (dashed line) 6*a* are also coiling inward as said spring is positioned within said brackets 6*c*. Furthermore, (see FIGS. 6A and 6B for the following) as the bristle span channels 5*i* are engaged with the retraction spring 6*a*, the bristle spans 2*a*' also begin to move inward.

FIG. 12A(3) is a continuation of the mechanical motions described above in FIG. 12A(2). Notice how the brackets 6*c* and retraction springs (dashed line circle) 6*a* have assumed the off—center position relative to the perforated tube 10*a*. Also, notice the interaction of the worm channels 9*e* and bracket slide channels 8*i* as said channels interact simultaneously to move the brackets 6*c* to the depicted position.

FIG. 12A(4) depicts another mechanical interaction of note. Notice the thread channel lever 9*j*. This feature acts as a channel switch that guides the slide bracket pins 8*j* along the appropriate worm thread channel 9*e*. FIG. 12A(4) depicts said lever in the counter-clockwise position. This position ensures that the slide bracket pin 8*j* adjacent to said lever 9*j* follows the same worm channel 9*e* through the reverse of the heretofore described mechanical interactions. Said reversal is actuated by the control arm being returned to the central position. Said return will re-establish the mechanisms to the positions depicted in FIG. 12A(1). Notice in the series of depictions FIG. 12B(1-4), the same type of mechanical interactions occur in the present series as occurs in the series of depictions of FIG. 12A(1-4). The difference lies in the movement of the control arm FIGS. 10A, 10*o* to the backward position, therefore; 12B(1-4) follows the mechanisms as the worm discs 9*b*-9*c* rotate clockwise. As stated previously, FIG. 12B(1-4) depicts the series of mechanical motions that allow all bristle spans 2*a*' to retract into the perforated tube 10*a*. Notice in FIG. 12B(4), the thread channel lever 9*j* has pivoted clockwise ensuring that the applicable bracket pin 8*j* is guided back through the same worm disc thread channel 9*e* on the return trip to the setting of FIG. 12B(1).

It will also be necessary to describe a difference in the bristle guidance means between the embodiments of FIGS. 3A-3C as well as FIG. 4 and the embodiment described in FIGS. 10A-10B. As the bristle spans 2*a* of FIGS. 3A-3C and FIG. 4 are attached to the spine 1*a* and 1*a*' (respectively), and as said spine and perforated tube assembly 1*i* rotate in tandem yet eccentrically to one another, the necessity of pivoting bristles 1*d*'/bristle spans 2*a* and consequently, bristle guides 1*g* and spacer rings 1*h* is an effect of this arrangement.

Pivoting bristles 1*d*'/bristle spans 2*a*', as well as bristle guides 1*g* and spacer rings 1*h* [or any other bristle guidance means described previously] are not necessary in the embodiment of FIGS. 10A and 10B. (See also FIG. 5A for the following) Affectively, each bristle span 2*a*' is seated to accurately slide up and down along each pair of applicable slide channels 5*d*, one of said pair on each bristle flange 5*a* and 5*b*, with each length and distal end of each bristle 1*d*' always following a straight path in and out of each perforation 1*f* of the perforated tube 10*a*, and as said tube is fixed to the bristle flanges 5*a* and 5*b* and furthermore, as said flanges are fixed to the spine 5C. This straight path traveled by each bristle span 2*a*' up and down each pair of slide channels 5*d* [as the brush barrel rotates] is actuated by the relative position of each retraction spring 6*a* as each of said springs is engaged slidable along each inside perimeter edge to each bristle span channel 5*i*, and as a bristle span channel 5*i* is located on each end of each bristle span 2*a*'.

The mechanism described in connection with FIGS. 5A to 12B(4) that extends and/or retracts the bristles in the bristle flanges is considered a means for moving the brush barrel and the bristle assembly such that in one mode, the brush barrel rotates with all of the bristles extending from the perforations, in a second mode, the brush barrel rotates with the bristles continually extending over one side of the rotating brush barrel while bristles on the other side of the rotating brush barrel continually retract, and in a third mode, the bristles are fully retracted such that the bristles do not extend from the rotating brush barrel during rotation thereof.

Another iteration may be assembled employing a perforated tube that is flexible and is arranged with the previously described or later described mechanical assemblies producing a spinning 'oblong' or crescent shaped brush barrel with two wider flat sides and two narrow rounded sides. Said barrel rotates in a manner that resembles the belt on a belt sander or tracks on a military tank. We may refer to such an arrangement as a 'spinning paddle brush'. May it suffice to describe this preferred embodiment in text only.

A preferred design will find the bristles in the extending cycle on one flat side and in the retracting cycle on the opposite flat side as well as both rounded narrow sides as the brush barrel rotates. This embodiment provides an additional styling choice of forming the hair into a straighter appearance than the previous round brush iterations. Another important benefit that is derived from the present embodiment lies in the decreased probability of hair wrapping around the entire perimeter of the brush barrel.

Figures 14A, 14B, 14C:
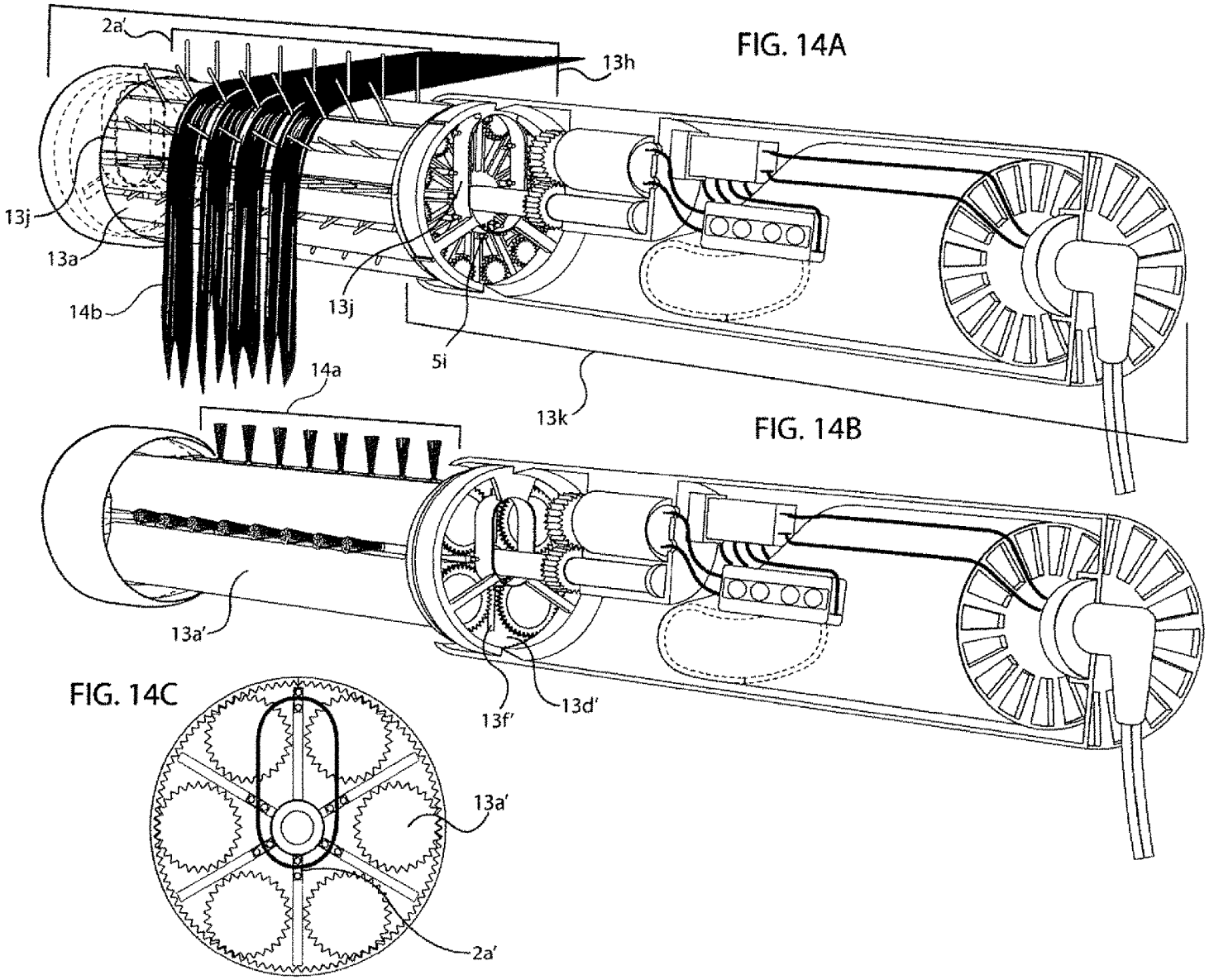
FIG. 14A is a perspective side view of the rod type brush barrel spinning round brush.
FIG. 14B is a perspective side view of an alternative embodiment of the rod type brush barrel spinning round brush.
FIG. 14C is an end view of yet another embodiment of the rod type brush barrel spinning round brush.

Consider the present 'belt' type barrel combined with the mechanical arrangement of FIG. 4 or FIG. 14A yielding the present iteration: a rotating belt type oblong brush barrel with bristles that are in the extending cycle on one flat side only. Also, incorporated into said arrangement, is a perforated belt tube preferably composed of a tough flexible fabric or silicone rubber with a perhaps Teflon fabric or other low friction or slippery outer layer or coating that prevents hair from sticking to the belt type barrel.

As an operator is holding the rotating paddle brush by the handle, the operator drapes a section of hair over the barrel. With the hair draped over barrel, the flat side of the barrel with the bristles in the extending cycle are facing upward with the hair enmeshed with the bristles. The barrel is rotating so that the top bristled side is conveying away from scalp. This allows the bristles to release the hair at the point where the hair begins to drape over the outside rounded side of the barrel. So, the prevention of tangling of hair all the way around the perimeter of the present brush type begins at the top of the first rounded side of the barrel. To become wrapped around the barrel beyond this point, the already released hair will need to bend upward 90 degrees from the draped position and become stuck to the slippery, flat, wide [albeit rotating] and bristleless bottom side of the brush barrel. This is unlikely. Continuing this unlikely process of tangling, the hair that is stuck to the bottom will need to perform an even more unlikely maneuver by somehow continuing to be stuck to the equally slippery and bristleless inside rounded side of the brush barrel.

The following are descriptions of the various iterations of the inventive round brush in use. An operator may use the brushes, whether on her own hair or another person's hair, by clipping most of the hair to the top of the head thereby leaving a workable section at the nape of the neck. The operator may brush that section and then drop successive sections as the operator brushes from the nape up to the top of the head. The operator may also simply grab sections of hair while it is all in natural fall and allow the hair unintended for brushing at that moment to simply separate around the intended section and begin brushing. Once a section has been chosen, the operator will lay the section on top of the brush and switch on the brush to spin or manually spin the brush in the direction of spin that finds the top of the brush [with the bristles extending] spinning away from the head. As the brush is spinning the bristles through the hair at the top of the brush, the operator may hold the brush in the present 'bristles up' position and polish the section of hair smooth by moving the brush back and forth away from and toward the head thereby polishing the hair root to end until the operator is satisfied with the result. With all but one of the iterations described, the operator will simply continue through successive sections in the above-described manner until completion. The brush of FIGS. 10A and 10B may be used as just described, but while the operator is still in polishing mode, the operator may draw the brush away from the head until the operator arrives at the ends of the hair and, while the brush is still spinning in place, the operator may switch the mode of the brush to 'all bristles out' and wind the section of hair to the scalp and switch the rotation off as the barrel of the brush nears the scalp. The operator may allow the brush to remain wound at the scalp for a period of time to allow the heat to work on the hair thereby causing the section to become wavy. Once the operator is satisfied with the amount of time that the section is wound, the operator will switch the mode of the brush once again, this time to 'all bristles in'. This completely releases the now wavy section of hair and the operator may repeat the entire process. Other techniques for using the several embodiments of the inventive round brush may also be employed.

The following describes another iteration of the present invention that possesses yet another detangling feature that is employed along with the retractable bristle feature, rendering another novel hair styling appliance. Said feature addresses an issue that arises when any one of the previously described embodiments of the retractable bristle spinning round brush, that do not include the counter-rotating rod feature described below, encounters when this type of spinning brush is used on wet or damp hair. Although the retractable bristles of said embodiment catch and release the wet or damp hair, the hair that is wet due to water, or other fluids commonly used in hair, sticks to the outside surface of the barrel that the bristles retract into. This issue may be remedied by employing one or more of the many non-stick or hydrophobic coatings. The following describes a mechanical solution to wet hair stickiness including the stickiness caused by the electro static attractiveness inherent in water and other fluids. The embodiment of the present invention that mechanically addresses said issue is referred to as the counter-rotating rod type rotating barrel. The barrel of the present embodiment may also be coated with the above stated types of coatings. Any known types of non-stick coating can be used, e.g., PTFE or the like.

Figures 13A, 13B, 13C:
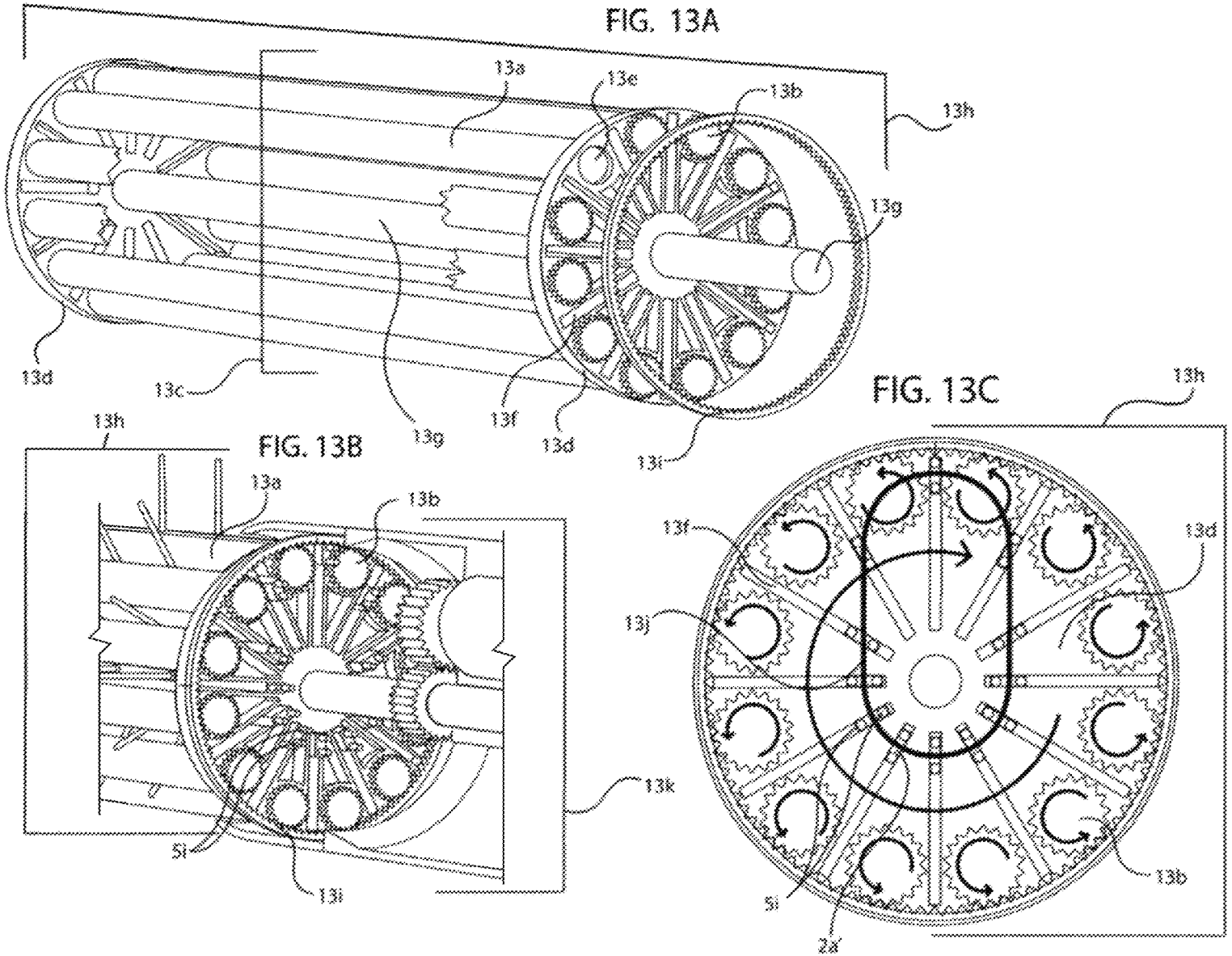
FIG. 13A is a perspective side view of the rod type brush barrel.
FIG. 13B is a partial perspective side view of the rear of the rod type brush barrel 13*h* and front of the brush handle/chassis 13*k*.
FIG. 13C is an end view of the rod type brush barrel 13*h*.

As seen in FIG. 13A, the present embodiment utilizes a plurality of preferably (but not limited to) round or cylinder-shaped rods 13*a*. A gear 13*b* is molded into one end of each rod 13*a*. Each rod in said plurality of geared rods is positioned closely parallel to one another and arranged into a cylinder 13*c*. This cylinder of geared rods is sandwiched at either end between two (2) rod and bristle flanges 13*d*. Circular openings 13*e* are arranged equidistant to one another around the circumference of each rod and bristle flange 13*d*; each opening 13*e* serves as a pivotal seat for each rod end. A bristle span slide channel 13*f* is positioned between each rod seat 13*e* and each rod and bristle flange 13*d* is fixed to each end of a spine 13*g*. This arrangement of rods 13*a*, flanges 13*d*, and spine 13*g* forms the rod type brush barrel 13*h*. As seen in FIGS. 13B and 14A, the barrel 13*h* is appropriately joined to the handle/chassis 13*k*, and each rod gear 13*b* of the cylinder of geared rods 13*c* engages with a single internal gear 13*i* positioned fixed or molded into the barrel receiving end of the handle/chassis 13*k*. The channel rail 13*j* (described later in this disclosure) is omitted from FIG. 13B as this provides a clearer view of the placement of the internal gear 13*i*.

(See FIGS. 13B and 13C for the following). As the rod barrel 13*h* is joined to the handle/chassis 13*k* and is set to spin, the present mechanical rod barrel 13*h* mechanical arrangement causes the rod barrel 13*h* to rotate in one direction while each rod 13*a*, in the cylinder of geared rods 13*c*, rotates in the opposite direction at the same rate as the rotation rate of the rod barrel 13*h*, no matter what rate the barrel 13*h* is spinning. This action causes the hair that would otherwise stick to the individual rods 13*a* to be rolled away from each rod 13*a* in the opposite direction that the barrel 13*h* is spinning.

Alternatively, the individual barrel rods 13*a* may be arranged to release the hair or other material by creating a free spinning rod embodiment. This is achieved by eliminating the rod gear 13*b* and internal gear 13*i* aspects of the mechanical arrangement described above. The hair will attempt to stick to the barrel 13*h* and the free spinning rods 13*a* will simply roll in the opposite direction. In this embodiment, in place of rotating the rods that are geared to spin in the opposite direction as the rotation direction of the rod barrel, means are provided to allow the rods to spin freely during rod barrel rotation.

The retractable bristle span mechanical arrangement described previously is likewise arranged into the present rod barrel arrangement. The previous FIG. 8A iteration employs a pair of retractable springs 6*a* as rails for each of the bristle span channels 5*i* to engage with and rotate upon. These round retractable springs 6*a* are part of the mechanical means that allows an operator to move the bristles through three (3) primary bristle positions; however, each of the bristle span channels 5*i*, of the present iteration, rotates upon a pair of fixed oval channel rails 13*j* (see FIGS. 13C and 14A, for the placement of the bristle span channels 5*i* relative to the fixed oval channel rail 13*j*). As compared to the two (2) round retractable spring type channel rails 6*a* shown in FIG. 8A, these oval shaped channel rails 13*j* reduce the number of bristle spans 2*a*' that cycle through the 'bristles extended' position as the bristle spans 2*a*' cycle in and out of the barrel 13*h*. This reduces the risk of hair 14*b* becoming wrapped all the way around the barrel 13*h* as there are fewer bristle spans 2*a*' in the extended position at the top of the barrel 13*h* and engaging with the hair 14*b* as the barrel spins (see FIG. 14A). Note: the position of the hair 14*b* as it is appropriately draped over the barrel 13*h* (as seen in FIG. 14A) is the same position hair 14*b* will be draped over any barrel of any embodiment of the retractable bristle rotating barrel brush described in this disclosure (although said position will be mirrored when the barrel is set to spin in the opposite direction).

As seen in FIG. 13C, the bristle span channels 5*i*, along with the bristle spans 2*a*' that said channels 5*i* are fixed upon at either end of each of said spans, move within the guidance of two (2) types of structures simultaneously. These two types of (2) structures are the slide channels 13*f* (of the rod and bristle flanges FIGS. 13A, 13*d*) and the channel rails 13*j*. These channel rails 13*j* are alternatively the retractable springs 6*a* in the FIG. 6B embodiment. The slide channels 13*f* rotate (as the barrel 13*h* rotates) while the two (2) channel rails 13*j* remain stationary. This arrangement causes the bristle spans 2*a*' and therefore, the bristle span channels 5*i* to travel up and down the slide channels 13*f* as the bristle span channels 5*i* are simultaneously engaged with and travel around the channel rails 13*j*.

May it suffice to say, and without further need for illustration, that the brush iteration FIG. 14A and brush iteration of FIGS. 10A and 10B may simply exchange each barrel for each body, spine and bristle actuating mechanical arrangement of one another thereby rendering two more iterations of the retractable bristle rotating barrel brush. One of these embodiments is a counter-rotating rod type spinning barrel 13*h* of FIG. 14A incorporated into the three (3) bristle position spine mechanical arrangement of the FIGS. 10A and 10B handle/chassis 10*b*. The other embodiment is the perforated type barrel 4*a*' of FIGS. 10A and 10B incorporated into the fixed oval channel rail mechanical arrangement of the FIG. 14A handle/chassis 13*k*.

The present embodiment of FIG. 14A utilizes twelve (12) counter-rotating rods 13*a* and twelve (12) bristle spans 2*a*'. Other iterations of the present embodiment may be arranged by changing the number of counter-rotating rods 13*a* and bristle spans 2*a*' utilized per iteration. These alternative embodiments may feature three (3) or more counter rotating rods 13*a* and bristle spans 2*a*'. FIG. 14B depicts an embodiment that utilizes four counter-rotating rods 13*a*' and four bristle spans 2*a*'. FIG. 14C depicts a gear end view of a rod barrel that utilizes six (6) rods 13*a*' and six (6) bristle spans 2*a*'.

FIG. 14B utilizes a FIG. 14A type bristle span 2*a*' that has been changed to a bristle bundle span 14*a* rather than the spaced individual bristles of the 2*a*' bristle span. Any embodiment of the spinning brush described herein may substitute the individual bristles for the bristle bundles or any of the wide variety of, or combination of the variety of bristles that are presently used in the various brushes that are available for purchase. Other simple modifications may also be included to each embodiment. For instance, the previously described FIG. 2A-10B embodiments, may substitute the 12 rows of individual perforations for 12 open longitudinal channels, being approximately the same lateral dimension but would be one (1) continuous longitudinal opening that will be closed only at the distal and proximal ends of the tube barrel. The internal bristle rings FIGS. 3B, 1*h* or the like may also be removed from the FIGS. 2A-4. The barrel tube 10*a* of the FIGS. 5A-10B embodiment will need to include the 1*g* bristle guide feature of the FIGS. 2A-4 embodiments. Said open channel type perforations will appear and function very much like the openings between the rods of the rod type barrel described in the FIG. 13A-14A embodiment, although with fixed rather than spinning rods.

The number of bristle spans as well as the coincident number of perforation rows in the FIG. 2A-10B embodiments may vary through simple alteration of the related mechanisms to render more embodiment options that actuate 3 or more bristle spans and barrel perforations.

Any embodiment of the counter rotating rod type brush barrel may substitute solid rods or solid heated rods for tubes and said tubes may include perforations that allow hot air to move through.

Figures 15A, 15B, 15C, 15D:
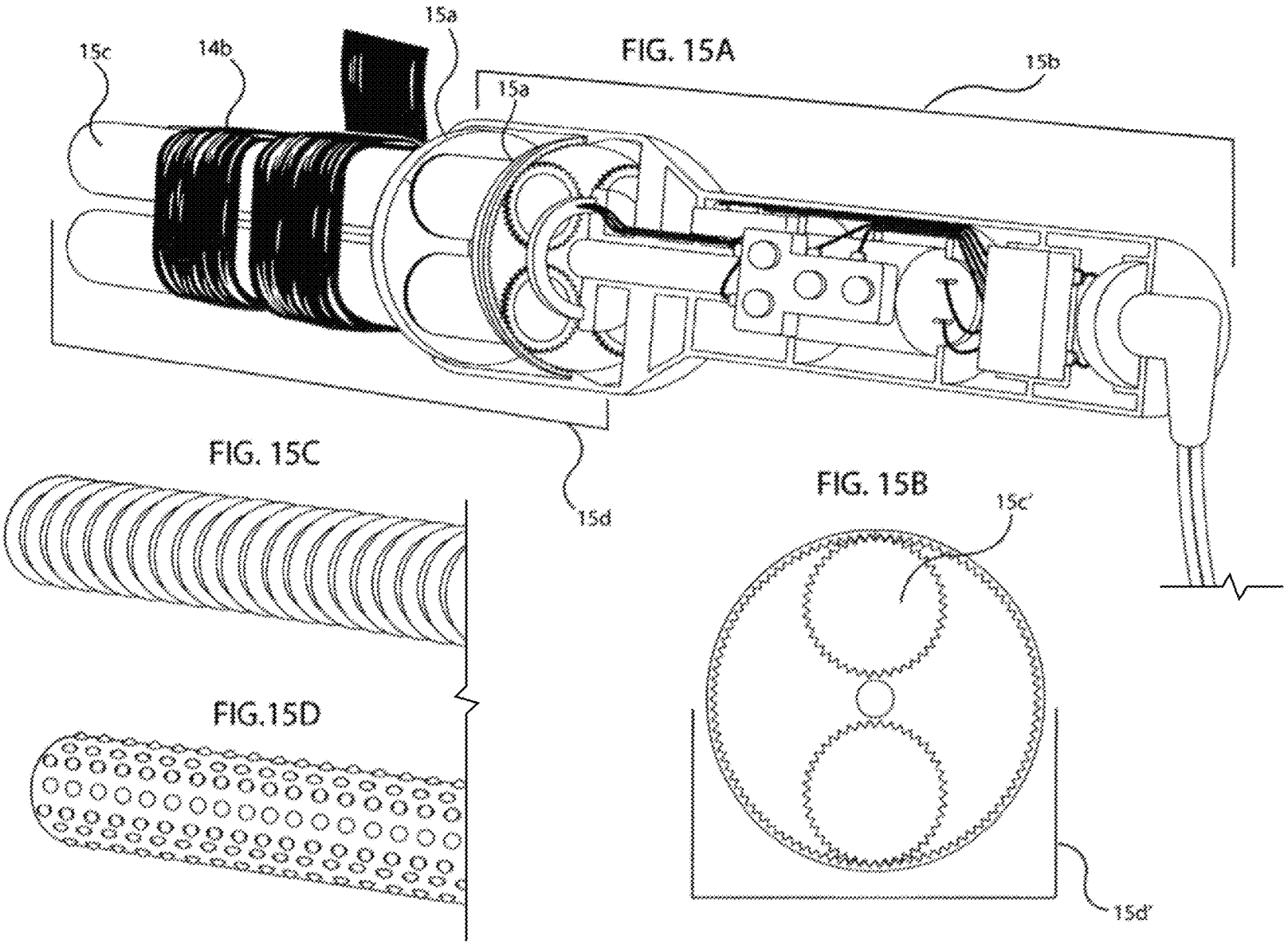
FIG. 15A is a perspective side view of the multi-rod spinning curling iron.
FIG. 15B is an end view of an alternative embodiment of the multi-rod spinning curling iron.
FIGS. 15C and 15D are perspective side views of a single rod of the multi-rod spinning curling iron depicting alternative surface textures.

Another iteration of the present invention involves a novel type of curling iron. The rendering of such an iteration, as in the preferred embodiment of FIG. 15A, involves the removal of the bristle spans 14*a* of FIG. 14B and related mechanical aspects along with the elimination of the slide channels 13*f*' from the rod and bristle flanges 13*d*' and the relocation of what is now the outside rod flange 15*a* to a position closer to the opposite rod flange 15*a* and handle 15*b*. FIG. 15A depicts a multi-rod barrel 15*d* that consists for four (4) counter rotating rods 15*c*. Other curling iron embodiments may utilize two (2) or more counter-rotating rods 15*c*. FIG. 15B is a gear end view of a two (2) rod 15*c*' multi-rod barrel 15*d*' arrangement.

The novelties of the present curling iron embodiment manifest as the opportunity to regulate the heat administered to the hair 14*b* (or other material where said regulation is ideal) that is wrapped around the FIG. 15A multi-rod barrel 15*d*. This regulation of heat presents as a more even distribution of heat throughout the wrapped ribbon of hair 14*b*. Said opportunity arises in two (2) manners. Manner one (1)

presents the opportunity to simultaneously prevent mechanical winding of the hair 14*b* or material wrapped around the outside of this collective rod arrangement while keeping said hair 14*b* moving on the multi-rod. Manner two (2) presents the opportunity to pulse heat into the hair 14*b* or material wrapped around the multi-rod.

Manner one (1) is facilitated as the non-circular shape of the spinning multi-rod continually changes position beneath the wrapped hair 14*b* or material, e.g., FIG. 15A depicts a preferred, but not limited to, four (4) rod arrangement forming (from a barrel end view) a spinning rounded square, or (from the perspective view of FIG. 15A) a rectangular cuboid shape beneath the wrapped hair 14*b* or material. Such continuous movement may be expanded beyond the vertical motion of the overall wrapped ribbon of hair to include a continuous and subtle side to side lateral movement as well as a continuous separation of individual bundles and strands that comprise the ribbon. This lateral movement may be achieved by including various surface textures into the shape of each rod. FIG. 15C depicts a spiral, sharp peeked, bolt type thread surface texture covering the rod surface. When considering an even number of rods in the multi-rod configuration, such as the four (4) rod configuration of FIG. 15A, such a threaded texture may be preferably reversed on two (2) of the rods rendering a configuration where each rod will have a rod on either side of it with the thread spiraling in the opposite direction. As each individual rod of the multi-rod rotates in the opposite direction of the over-all spin of the multi-rod, some of the hair that is wrapped around the multi-rod will inevitably slide into the valleys of the thread texture. As said slide occurs, each thread pattern of each rod is rotating and moving the valley occupying hair toward one side. As each rod on either side of the presently observed rods are threaded in the opposite direction, the valley occupied hair of each of these rods will be moving sideways in the opposite direction as the centered rod. This balanced side to side movement of the hair will continually and finely separate and re-separate the wrapped hair as the hair cycles in and out of the threads.

FIG. 15D is another example of a surface texture depicted as a staggered raised stipple surface texture that will likewise achieve this lateral movement and separation of hair bundles and strands.

As the shape formed by the various number of barrels that may be included in the multi-barrel rotates beneath the hair or other material that is wrapped around the barrel, the shape of the curl that the spinning barrel produces will be round regardless of the shape that is rotating, provided the barrel continues to rotate when the hair is released. Another curl shape option is to stop spinning the barrel and leave the hair on the non-rotating barrel for an increment of time or not rotate the barrel at all.

Yet another implication of the inclusion of a surface texture onto each rod is the fact that any given cross section of any bundle or strand of hair that cycles through contact with the heated surface will do so partially surrounded by the heated surface. This affect is pronounced but not limited to the thread texture depicted in FIG. 15C. This instance causes the bundles of hair to continually re-separate and slide into the valleys formed by the threads. Said valleys constitute a multi-sided heating surface.

Manner two (2) pulses heat into the wrapped hair or material while the multi-rod spins, as any given cross section of wrapped hair or material will not, during any considerable increment of time, be in continuous contact with any heated surface of any rod as the multi-rod spins beneath the wrapped hair or material. The rate of intermittent contact of the hair or material with a heated rod may be adjusted by changing the number of rods comprising the multi-rod and/or by adjusting the spinning speed of the multi-rod. Also, less that the total number of rods could be supplied with heat. The manner of heating could be any known type with forced air being a preferred embodiment. Furthermore, less than the total number of rods may be supplied with cooling using one or more of the various types of refrigeration technology presently available, whether it be cold blown air or direct cooling of the various materials that the rods are formed from. Alternatively, some rods may be cooled, and some not, with perhaps some that are neither heated or cooled.

FIGS. 13A-13C illustrate a means for rotating the rod barrel in one direction and rotating the individual rods in the opposite direction to avoid the tangling problem disclosed above. These Figures also show the means to move the bristles in and out of the spaces between the rods, similar to the other embodiments disclosed above that move the bristles in and out of the perforations on the barrel. FIGS. 15A-D illustrate means for rotating the rods collectively in one direction while rotating each rod separately in a direction opposite the one direction and without the bristles and means to move them with respect to the barrel.

As with the embodiments described in connection with FIGS. 1-12C, while hair is a preferred material for engagement with a bristle-containing device for the embodiments of FIGS. 13A-15C, any material that would need manipulation and/or treatment using the rod and bristles embodiment or the rotating rod device without bristles is a candidate for use with the inventive devices.

While human hair is an ideal candidate to use with the various embodiments of the invention, the inventive devices could also be used on animal hair, e.g., grooming a horse's tail, grooming long haired dogs and cats, and the like.

Figures 16A, 16B, 16C:
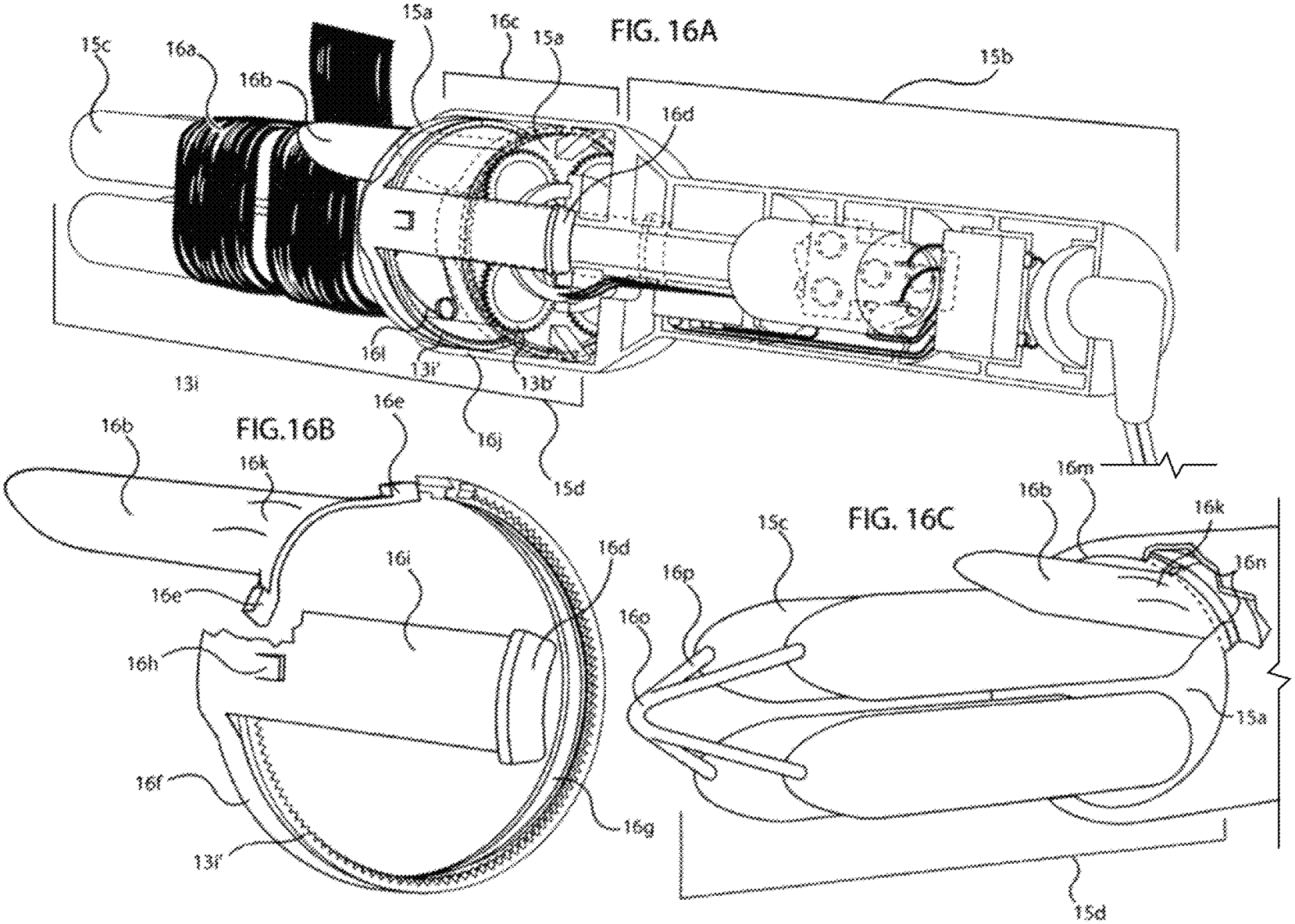
FIG. 16A is a perspective side view of the multi-rod spinning curling iron. This view is the opposite side of the perspective side view shown in FIG. 15A.
FIG. 16B is a perspective side view of the slide clip 16*b* and slide clip ring 16*f* components of the multi-rod spinning curling iron.
FIG. 16C is a perspective side view pertaining to the front of the multi-rod barrel 15*d* spinning curling iron.

FIG. 16A describes a unique type of hair clip that is incorporated into the front of the handle/chassis section of the multi-barrel spinning curling iron and is manipulated by the operators thumb for the purpose of clamping hair against one or more of the individual rods of the multi-barrel of the curling iron. More than one unique clip may be incorporated into a multi-barrel curling iron arrangement.

Commonly, a spring-loaded hinge type clip is incorporated into curling irons. The clip mechanism is usually hinged at the front of the handle with the hair clipping section extending forward and away from the handle, and over the majority of the barrel with the clip lifting (button) section of the clip mechanism extending back a short distance over the handle. This type of clip remains over the barrel whether it is engaged with the barrel with hair in between or not. Also, a preferred clip mechanism will rotate with the barrel when said clip is engaged with the hair on the multi-iron or when the clip is not engaged. A standard clip lacks the functionality to fulfill either of these preferred requirements.

FIGS. 16A-C describes a preferred hair clip arrangement that is ideal for the multi-rod iron embodiment. The present clip embodiment may be incorporated into any type of curling iron that is presently available.

Rather than a hinge type clip, the present multi-rod iron iteration (as seen in FIG. 16A) employs a clip body 16*b* that slides into and out of the distal front edge of the barrel mechanism section 16*c* handle/chassis 15*b*. Said clip body latitudinally conforms closely to the shape of the surface of a single multi-barrel rod. It will be necessary for the clip body 16*b* to retract entirely into said handle chassis section 16*c*.

As seen in FIGS. 16A and 16B, and while the multi-barrel is not spinning, the operator engages the clip body 16*b* by urging forward on the slide button 16*d* with the thumb. (See FIG. 16B for the following) As the clip body tabs 16*e* are seated within the clip ring 16*f* along the clip ring tab channel 16*g*, the clip body slides forward against a single multi-barrel rod 15*c* while the bottom surface of the length of the clip body 16*b* remains in contact with the outside surface of the rod 15*c*. As the operator continues to urge forward against the slide button 16*d*, the operator will feel a click as the raised catch 16*h* that is located on the top surface of the slide button ring arm 16*i* slides beyond the catch mate located on the inside surface of the barrel mechanism section 16*c* of the outer casing 16*j*. (It is necessary to imagine the location of the 'catch mate' as the section of outer casing 16*j* that features said catch mate is not shown in FIG. 16A, as showing this section of the casing would obstruct the view of the internal mechanisms.) Continuing to urge forward on the slide button 16*d* beyond the click of the catch 16*h* causes the front of the clip body 16*b* to lift away at an angle from the multi-barrel rod 15*c*. (See FIG. 16C for the lifting of the clip body 16*b*.) This occurs as the clip body tabs 16*e* are attached to the clip body 16*b* at a forward angle. As the operator continues to urge forward on the slide button 16*d*, this forward angle placement of the tabs 16*e* causes the top front edge of each tab 16*e* to contact the front inside surface clip ring tab channel 16*g* first. Further urging will bring the bottom front of each tab 16*e* into contact with the front inside surface of the clip ring tab channel 16*g* as well, causing the clip body 16*b* to lift away from the multi barrel rod 15*c* at a forward angle. The clip ring tab channel 16*g* is wide enough to accommodate said slight pivoting action of the clip body tabs 16*e*. This clip body 16*b* lifting action (see FIG. 16C) allows the operator to place the ends or other section of hair between the clip body 16*b* and the multi barrel rod 15*c*. Once there is a section of hair 16*a* in place between the clip body 16*b* and rod 15*c*, the operator will release pressure on the slide button 16*d* and the clip body 16*b* will partially retract back into the barrel mechanism section 16*c* of the handle, by the tension of the clip spring 16*l*, until the opposing surfaces of the two catches 16*h* meet. This sliding back of the clip body 16*b* to the catch 16*h* point causes the raised portion 16*k* of the top surface of the clip body 16*b* to contact the front edge FIGS. 16C, 16*m* of the barrel mechanism section 16*c* of the casing 16*j*. This causes the clip body 16*b* to clamp down onto the section of hair 16*a*.

As the clip body 16*b* is clamping down on the section of hair 16*a*, the operator will press the button that causes the multi-barrel to spin. While the multi-barrel is spinning, the clip body 16*b* also spins as the clip body 16*b* remains clamped down on the hair 16*a*. (See FIG. 16C for the following.) This occurs as the clip body 16*b* is held in place over the rod 15*c* as said clip body 16*b* occupies the clip allowance channel 16*n* that is recessed into the outside edge of the front rod flange 15*a*. The other factor that allows the clip body 16*b* to spin along with the multi-barrel is the fact that the clip body tabs 16*e* simply rotate around the inside circumference of the clip ring tab channel 16*g* as the raised portion 16*k* of the clip body 16*b* remains in contact with the front edge 16*m* of the barrel mechanism section 16*c* of the casing 16*j*.

Concurrent to the above-described mechanical action, when the operator urges forward on the slide button 16*d*, the internal gear 13*i*' disengages from the rod gears 13*b*' and rear rod flange 15*a* as the internal gear 13*i*' is a fixed feature of the clip ring 16*f*.

Now, as the rod gears 13*b*' are disengaged and the multi-rod barrel is spinning with hair 16*a* clamped between a rod 15*c* and the clip body 16*b*, this arrangement presents as a novel multi-barrel hair auto-winding feature. Once the hair 16*a* is sufficiently wound around the multi-barrel, the operator simply presses down on the slide button 16*d* thereby disengaging the mated catches 16*h*. Following this action, the slide ring 16*f* slides back into the resting position (due to the tension of the clip spring 16*l*) with the clip body 16*b* retracted and the rod gears re-engaged 13*b*' with the internal gear 13*i*'. The operator may press the multi barrel rotation button again and the barrel will spin under the wound hair without further winding the hair and the controlled and more evenly distributed heat will be administered to the wound hair. Once this operation is complete, the operator simply slides the hair forward on the barrel thereby completely releasing the hair from the spinning multi-barrel curling iron.

In summary, the embodiment shown in FIGS. 16A-C is an example of the addition of the slide clip to the multi-rod embodiment, wherein the clip body of the slide clip holds hair or other material to one of the rods for material winding around the rods. The mechanism describes a means that prevents rotation of the plurality of rods when the slide clip is extended, i.e., longitudinal movement of the internal gear 13*i*' to disengage the rods gears 13*b*' from the internal gear 13*i*' while still permitting the barrel 16*c* to rotate the plurality of rods together so as to wind hair or other material around the stationary rods, and then means to allow rotation of the plurality of rods while the barrel rotates by reengagement of the rods gears 13*b*' with the internal gear 13*i*' by moving the slide clip to its retracted position. The embodiment of FIGS. 16A-C also shows a means to pivotally move the slide clip between open and closed positions for hair or other material clamping. That is, with the specially configured clip body 16*b* and its tabs 16*e*, slide button 16*d*, clip ring tab channel 16*g*, clip spring 16*i*, catches 16*h*, and raised portion 16*k*, the slide clip can be pivotally moved between the open position where hair or other material can be placed and the closed position, wherein the hair or other material is held in place for winding or other treatment.

The final feature to be presented is the multi-barrel joint cage FIGS. 16C, 16*o*. This feature prevents hair from sliding between the individual rods of the multi-barrel. Each leg 16*p* of the cage 16*o* is pivotally seated (not fixed) to each tip of each multi-barrel rod 15*c*. This pivotally seated arrangement allows the cage 16*o* to spin with the multi-barrel while allowing each rod 15*c* to rotate in the opposite direction of the rotation of the multi-barrel.

It should be understood that the modes shown for the embodiment using the retaining spring, wherein the bristles can be all in, all out, or some in and some out, can be interchanged with the mode associated with the channel rail, wherein some of the bristles extend beyond the rods and some of the bristles are retracted or do not extend beyond the rods.

Any embodiment described herein may interchange or combine, rendering a variety of different embodiments. Examples of such interchange have been described previously. Another example of such interchange is to combine any of the retractable bristle and embodiments of FIGS. 4A-14B that are capable of both full or partial bristle extension and full retraction with the multi-barrel curling iron embodiments of FIGS. 15A-16C. This example renders a hybrid rotating brush/multi-barrel rotating curling iron hair styling appliance.'

Figure 17A:
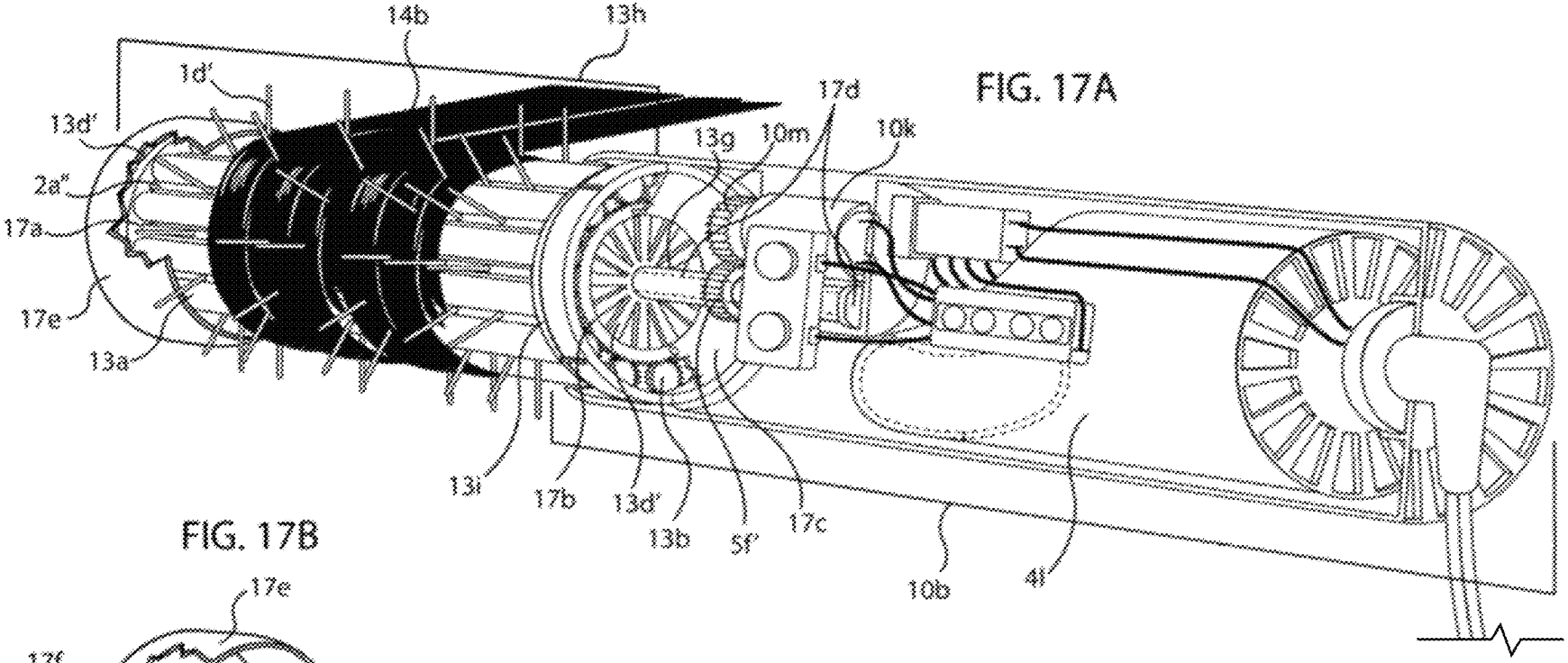
FIG. 17A is a perspective side view of an embodiment that features a preferred method of fixing the bristle spans 2*a*" to the rotating barrel 13*h* as an alternative to the various retracting bristle embodiments. It also depicts a sun gear 17*b* that completes a planetary gear set as a preferred alternative to the barrel rod 13*a* driving means described above. A funnel 17*c* is also described as both a stabilizing means for the gear set and to funnel hot air from the blow-dryer 4*l* to the inside of the barrel 13*h*.
Figure 17B:
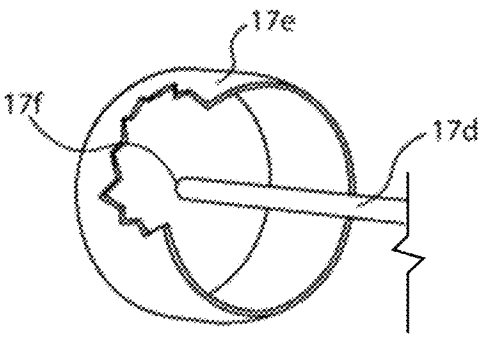
FIG. 17B is a perspective side view of an end cap 17*e* and axial 17*d* including a fix point 17*f* between said two parts.

As depicted in FIGS. 17A and 17B, another embodiment of the present invention features a surround of extended and static bristles 1*d*' positioned between the counter rotating rods 13*a*. Each bristle span 2*a*" is fixed (see fix point 17*a*) on both ends to each of the bristle span flanges 13*d*' in a manner that allows many combinations of incrementally positioned individual bristles 1*d*, bristle bundles (as an individual bristle bundle is depicted in FIGS. 14B, 14*a*), as well as knobbed bristles and wavy bristles to be fixed to each bristle span 2*a*" and extend out from between and beyond the counter rotating rods 13*a* over the full circumference of the overall barrel 13*h*. Said means for fixing the bristles 1*d*' to the rotating barrel 13*h* are exemplary and other means that would fix the bristles 1*d*' to the rotating barrel 13*h* are within the scope of the invention.

Each counter rotating rod embodiment described thus far, as well as the presently described embodiment, provide an improved functionality for hairbrushes or brushes that would treat some other elongated material. That is, as depicted in FIG. 17A, a length of a typical and manageable size section of hair 14*b* may encircle the entire circumference of the rotating barrel 13*h* and continue to rotate. This feature is also present when the embodiments are used for long hair, and the section of hair 14*b* encircles the barrel multiple times. Furthermore, this feature is present for both dry and wet hair and performs said feature in a comfortable manner for the recipient of said novel feature.

In addition to this, the operator may move the barrel 13*h* toward and away from the scalp indefinitely as the hair 14*b* remains wrapped around the barrel 13*h*. In this manner, the recipient experiences continuous and comfortable variable tension through the length of the hair section 14*b*. As more of the length of hair 14*b* is allowed to wind, as with the rotating barrel 13*h* approaching the scalp, hair tension around the barrel 13*h* decreases; as less of the length of hair 14*b* is allowed to wind, as with the rotating barrel 13*h* moving away from the scalp, hair 14*b* tension around the barrel 13*h* increases. This feature, when combined with heat, facilitates an ease and enhancement of the smoothing and reshaping of a hair section 14*b*.

The embodiment of FIG. 17A is advantageous as compared to the retractable bristle embodiments due to the mechanical simplicity of this embodiment. Furthermore, with bristles 1*d*' dispersed incrementally around the full circumference of the barrel 13*h*, smoothing and reshaping of the section of hair 13*a* is enhanced and an automatic winding feature is improved, i.e., the barrel 13*h* may be positioned against a section of hair that is in natural fall and the hair will automatically wind around it.

A complete execution of the features described above is predicated on incrementally positioned bristles 1*d*' extending out between the counter rotating rods 13*a* and the bristles 1*d*' extending beyond the outside hair contact surface formed by the cylindrical arrangement of the rods 13*a*. As the bristles 1*d*' are, therefore, in contact with the hair 14*b* as the barrel 13*h* spins, each bristle 1*d*' will be continually and randomly cycled through two (2) positions: a position of being pressed against an adjacent barrel rod 13*a* by the winding hair, and a position of being released away from an adjacent barrel rod 13*a*, and this, as each bristle 1*d*' flexes back to an approximately upright position, having emerged momentarily through the winding hair 14*b*. Said two (2) bristle 1*d*' positions are depicted in FIG. 17A, as there are some bristles 1*d*' visible in an approximately upright position and some that are not present. This depicts, by the absence of the bristles 1*d*', that the absent bristles are under the hair 14*b* and pressed against a barrel rod 13*a*. The gear driven rod 13*a* arrangement is, therefore, desirable to overcome the rotational resistance applied to each barrel rod 13*a* by the bristles 1*d*' being randomly pressed against each rod 13*a* by the wound hair 14*b* as well as the resistance applied to the counter rotating barrel rods 13*a* by the hair as the hair 14*b* continually winds around the barrel 13*h*. All embodiments depicted and described in this disclosure that include both gear driven rods and bristles that extend beyond the outside hair contact surface formed by the cylindrical arrangement of the rods benefit from the ability of the gear rods to cope with said continually winding hair and bristle to rod resistance.

To achieve the safest and most comfortable execution of the invention, the bristles 1*d*' will be flexible for release of the hair 14*b* and the distance between the barrel rods 13*a* will be minimal. Gear driven, counter rotating barrel rods 13*a* are, therefore, a preferred embodiment. This embodiment is also preferred for the incorporation of the widest range of bristle 1*d*' configuration as well as barrel rod 13*a* number and size into a barrel 13*h* design.

As depicted in FIG. 17A, a sun gear 17*b* has been included, thereby, completing a more stable planetary gear set as combined with the rod gears 13*b* (or referred to in this planetary gear context as planetary gears), and internal gear 13*i* (also see FIGS. 13A, 13*i* for the internal gear). This planetary gear arrangement is also appropriate when considering the load placed on the rod gears 13*b* by the continuously winding hair 14*b*, as per said novel feature.

A funnel 17*c* is positioned over the planetary gear set. The

An outside surface of the funnel 17*c* is contiguous to a face of the sun gear 17*b*; this will allow said gear 17*b* to be held in place as it rotates. A funnel 17*c* that is contiguous to both the sun gear 17*b* and the rod gears 13*b* may also be preferred. The funnel 17*c* will also direct hot air from the blow-dryer 4*l* unit away from the gear set and into the barrel 13*h*.

The specific embodiment shown above is just one means to provide bristles in combination with the driven counter rotating rods and other means can be employed, wherein the bristles would be fixed to the rotating barrel and extend through and beyond the spaces between adjacent rollers that are driven counter to the rotating barrel. For the embodiment combining the counter rotating rods and bristles, the bristles can be arranged to extend between all of the rotating rods or less than all of the rods. For example, a device with twelve rods could have six bristle sets, wherein only half the spaces between adjacent rods have bristles therein.

FIGS. 17A and 17B depict an axial 17*d* that is seated in the handle 10*b* in a manner that prevents the axial 17*d* from rotating. This non-rotating axial 17*d* is telescopically seated within the spine 13*g* and provides an axial 17*d* for the rotating barrel 13*h*. An end cap 17*e* is attached to the distal end of the axial 17*d* to prevent the barrel 13*h* from sliding off the axial 17*d* and to provide a stationary end cap as the barrel 13*h* rotates. Said stationary end cap 17*e* prevents hair from winding around it as the barrel 13*h* rotates. See FIG. 17B for an axial to end cap fix point 17*f*. Other means to attach the axial 17*d* to the end cap 17*e* may be preferred. One example of such a means is a commonly known click lock and release mechanism.

This non-rotating axial 17*d* extending through a spine 13*g* arrangement also requires the electric motor 10*k* that drives the barrel 13*h* to be offset from the spine 13*g*. Said offset requires a motor shaft gear 10*m* engaged with a spine gear 5*f*' to rotate the barrel 13*h* over the axial 17*d*. The following describes an alternative to this offset motor 10*k* arrangement.

Figure 18A:
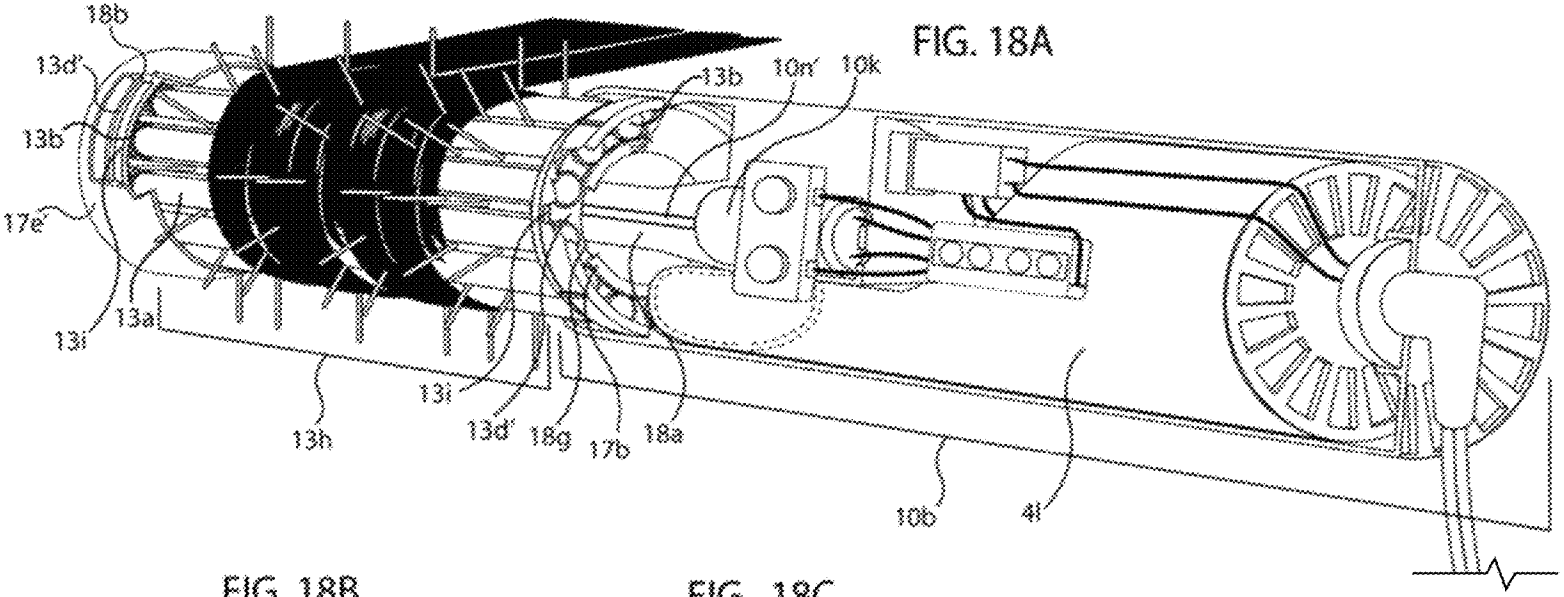
FIG. 18A is a perspective side view of an embodiment featuring a barrel axial 18*a* that is centered to the electric motor 10*k*. This motor 10*k* position allows the motor shaft 10*n*' to directly rotate the barrel 13*h*.

FIGS. 18A-19B depict additional preferred 'static bristles with counter rotating barrel rods' embodiments of the present invention. FIGS. 18A and 19A depict an electric motor 10*k* that is in the handle 10*b* with the motor shaft 10*n*' centered to the rotation of the barrel 13*h*. FIGS. 18A-19B also share the following identical features: barrel axial 18*a*, motor shaft 10*n*', distal barrel flange 13*d*' to motor shaft 10*n*' fix point 19*c*, and a proximal barrel flange 13*d*' that features a central opening 18*g*. Said opening 18*g* functions as a pass-through for the barrel axial 18*a* as well access into the barrel 13*h* of the air traveling out from the blow dryer unit 4*l*.

Figure 18B:
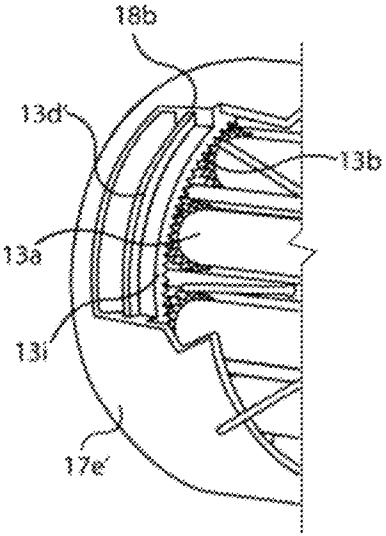
FIG. 18B is an enlarged view of the distal end of the barrel of FIG. 18A. Said enlarged view depicts an alternative means of allowing the end cap 17*e*' of embodiment FIG. 18A to remain stationary as the barrel 13*h* rotates.
Figure 19A:
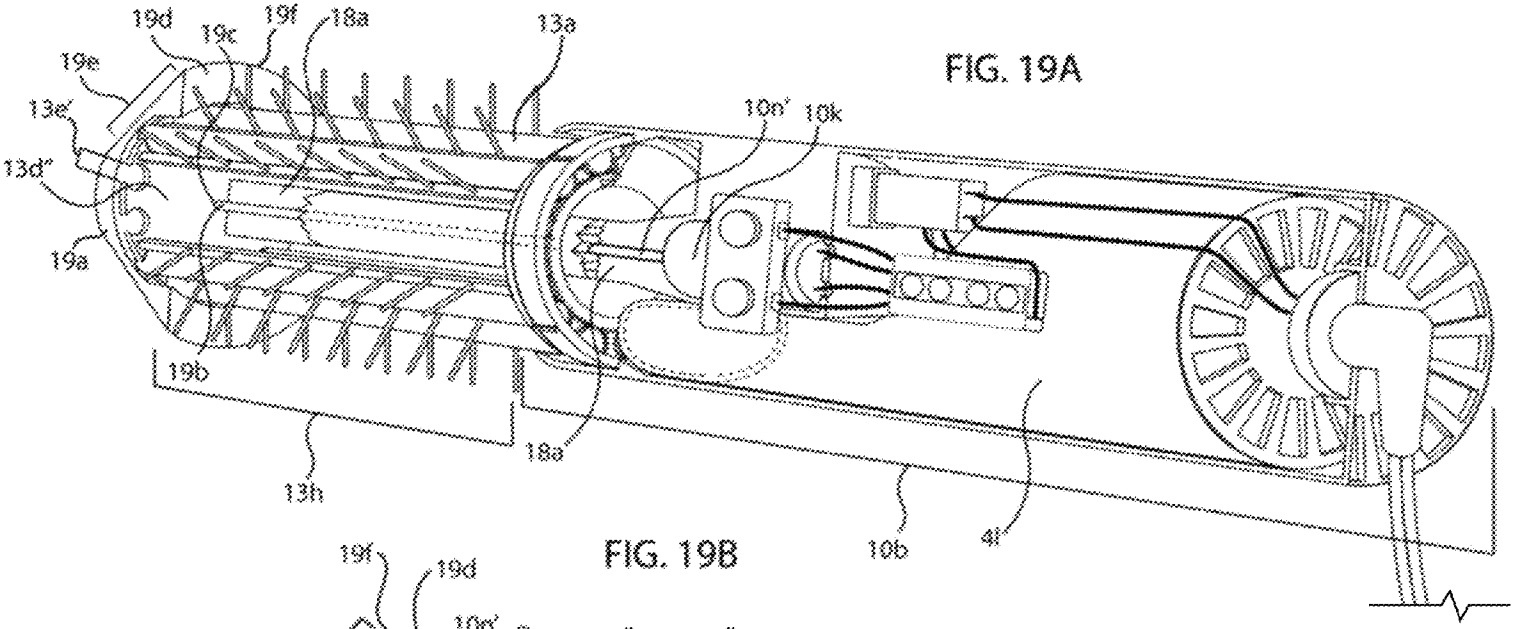
FIG. 19A depicts an embodiment featuring a fixed end cap 19*a* that rotates along with the barrel 13*h*.
Figure 19B:
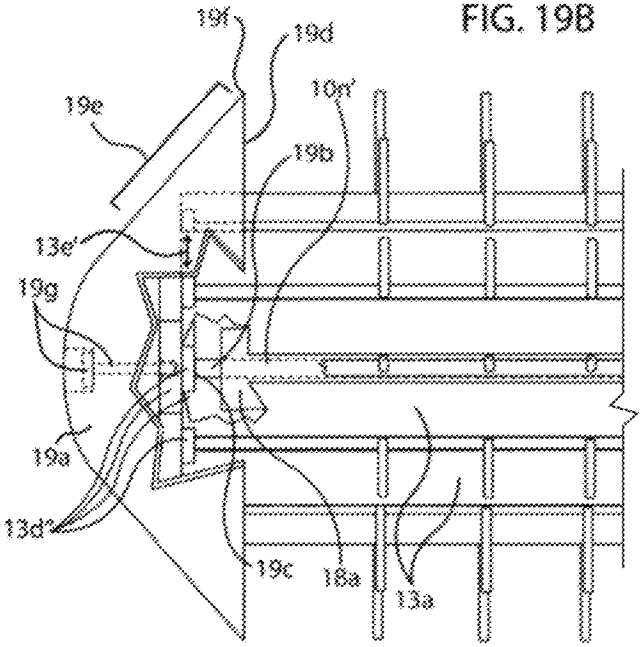
FIG. 19B is an enlarged side view of the distal end of the embodiment of FIG. 19A and further depicts the parts of said end cap 19*a*.

As seen in FIGS. 18A, 19A and 19B, a proximal end of the barrel axial 18*a* is fixed to the inside front of the handle 10*b*. Said axial 18*a* extends out of the handle 10*b* and into the axial center of the barrel 13*h*. A motor shaft 10*n*' extends away from the electric motor 10*k*, continues through the center of the barrel axial 18*a*, and extends a short distance beyond the distal end of the barrel axial 18*a*. The distal end 19*b* of the motor shaft 10*n*' that is exposed from the distal end of the barrel axial 18*a* is fixed to the inside center of the distal barrel flange 13*d*', 13*d*". See the motor shaft 10*n*' to barrel flange 13*d*', 13*d*" fix point 19*c* in FIGS. 18B, 19A and 19B. A commonly known 'click lock and release' mechanism is a preferred alternative means that engages and disengages the distal end of the motor shaft 19*b* from the distal barrel flange 13*d*' at said fix point 19*c*.

Figure 18C:
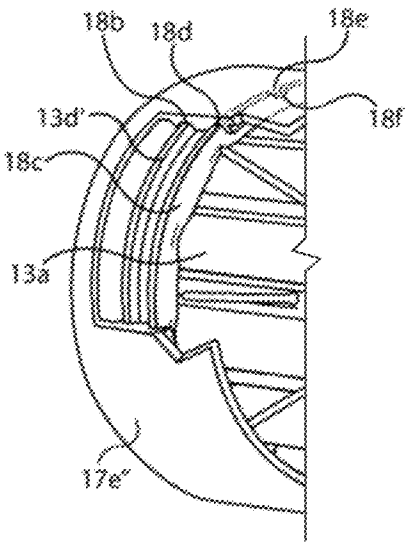
FIG. 18C is an additional enlarged view of the distal end of the embodiment FIG. 18A. Said enlarged view depicts a means additional to that described in FIGS. 18A and 18B that allows the end cap 17*e*" to remain stationary as the barrel 13*h* rotates.

FIGS. 18A, 18B and 18C depict alternative means to allow the end cap to remain stationary as the barrel 13*h* rotates.

As depicted in FIGS. 18A and 18B, the end cap 17*e*' is positioned over the distal end of the barrel 13*h*. An internal flange groove 18*b* extends around the inside circumference of the end cap 17*e*'. The outer circumferential edge of the distal barrel flange 13*d*' seats slidable into the flange groove 18*b*. This allows the end cap 17*e*' to rotate independent of the barrel 13*h* while remaining in a stable position over the distal end of the barrel 13*h*. As the end cap 17*e*' remains rotationally independent, the end cap 17*e*' also remains stationary while the barrel 13*h* rotates by utilizing the same gear arrangement and motion that drives the counter rotating rods 13*a* on the handle 10*b* side of the barrel 13*h*. As depicted in FIGS. 18A and 18B, an internal gear 13*i* is preferably molded into both the end cap 17*e*' and the handle 10*b*. Also, a rod gear 13*b* is preferably molded onto the distal end and proximal end of each barrel rod 13*a*. Furthermore, each rod gear 13*b*, located on both the distal and proximal ends of each barrel rod 13*a*, is engaged with each of the two respective internal gears 13*i*. Now, as the barrel rotates, and as the barrel rods 13*a* are gear 13*b*, 13*i* driven to counter rotate on the handle 10*b* side of the barrel 13*h*, this same gear arrangement and action is also driving the end cap 17*e*' to remain stationary. Alternatively, a sun gear 17*b* may be incorporated into said dual sided gear arrangement.

FIG. 18C depicts an alternative means of allowing a rotationally independent yet stable end cap 17*e*" to remain stationary as the barrel 13*h* rotates. Rather than the gear driven end cap 17*e*' described in FIGS. 18A and 18B, FIG. 18C depicts a ring 18*c* composed of silicone, rubber or other suitable rubber-like material positioned within a ring groove 18*d*. This ring groove 18*d* extends around the inside circumference of the proximal side of the end cap 17*e*". The ring groove 18*d* includes one or more ring groove tabs 18*e* that fit into one or more ring indentations 18*f*. This tab 18*e* and indentation 18*f* arrangement causes the rubber ring 18*c* to remain stationary while seated in the ring groove 18*d*. With the rubber ring 18*c* positioned within the ring groove 18*d*, and with the end cap 17*e*" positioned over the distal end of the barrel 13*h*, the inside circumference of the rubber ring 18*c* will contact each outside surface of each counter-rotating rod 13*a*. Now as the barrel 13*h* rotates, and each barrel rod 13*a* counter-rotates while touching firmly against the inside circumferential edge of the rubber ring 18*c*, the end cap 17*e*" is driven to remain stationary by the friction between the counter rotating rods 13*a* and the rubber ring 18*c*.

A commonly known 'quick lock and release mechanism' is a preferred enhancement to the flange groove 18*b* of FIGS. 18A-18C. Said mechanism preferably engages and disengages the end caps 17*e*' and 17*e*" from the outside edge of the distal barrel flange 13*d*'.

FIGS. 19A and 19B depict an end cap 19*a* that is removably fixed to the barrel 13*h*. Although this end cap 19*a* is fixed to and rotates with the barrel 13*h*, hair that is wound, or in the process of winding, around the barrel 13*h* is prevented from wrapping around this fixed end cap 19*a* and winding onto it due to the shape of said end cap 19*a*.

The proximal surface 19*d* of the end cap 19*a* is positioned circumferentially perpendicular relative to the longitudinal position of the barrel rods 13*a*. As hair is placed onto, or loosely encounters, said surface 19*d* of the end cap 19*a*, the hair will only slide along and against this surface 19*d* until captured by the rotating barrel 13*h*.

The distal surface 19*e* of the end cap 19*a* conically tapers distally and sharply away from the outer circumferential edge 19*f* formed by the proximal surface 19*d* of the end cap 19*a*, and toward the axial center of the end cap 19*a*. Hair that separates along this distal surface 19*e* of the end cap 19*a* slides along said conically tapered distal surface 19*e* and away from the rotating barrel 13*h*. In this manner, any hair that encounters the rotating end cap 19*a* is immediately separated by the outer edge 9*f* and simply slides to one side of the end cap 19*a* or the other side finding no winding purchase on the end cap 19*a*.

As depicted in FIG. 19B, the end cap 19*a* is removably fixed to the outside surface of the distal barrel flange 13*d*" by a screw 19*g*. Other means of fixing the end cap 19*a* to the flange 13*d*" such as a commonly known quick lock and release mechanism, may be preferable.

A distal barrel flange 13*d*" featuring barrel rod seats 13*e*' that are open along the outer circumferential edge of said flange 13*d*" is depicted in FIGS. 19A and 19B. This open rod seat 13*e*' configuration allows for easier removal of the occasional hair that becomes loose and wrapped around any barrel rod 13*a*. The operator may simply remove the end cap 19*a* and manually slide the loose rod wrapped hair toward the distal end of the rod 13*a* and then off the rod easily, and this, as an obstruction to said manual hair removal operation caused by the closed rod seat 13*e* is eliminated. (See FIGS. 13A, 13*e* depicting the closed rod seat.)

The barrel rods 13*a* of any embodiment described herein may counter rotate somewhat faster than the overall rotation of the barrel 13*h*. This alternative counter rotation speed will reduce the torque applied to the barrel rods 13*a* as well as the overall barrel 13*h* by the fully wrapped hair around the barrel 13*h* as the barrel 13*h* rotates.

The mechanisms described in FIGS. 17A-18C can be considered exemplary means for maintaining the end cap in a stationary position while the barrel rotates as detailed above. However, other kinds of mechanisms may also be employed to keep the cap from rotating while the barrel rotates. Similarly, the mechanism shown in FIGS. 19A and 19B are exemplary means to allow the removable cap to rotate with the barrel but be configured such that hair is impeded from contacting an outer end surface of the removable cap, and if hair does so contact, the cap is configured such that the hair would slide off the cap, for example, the cap is tapered toward its distal end, and the cap creates a lip with respect to the barrel to prevent hair from traveling over the lip and winding around the removable cap.

The various embodiments described above are provided by way of illustration only and should not be construed to limit the claims attached hereto.

Those skilled in the art will readily recognize various modifications and changes that may be made without following the example embodiments and applications illustrated and described herein, and without departing from the true spirit and scope of the following claims.

I claim:

1. A material treatment device comprising:

a plurality of rods arranged circumferentially as part of a rod barrel;

a handle attached to the rod barrel for rotatable support thereof means for rotating the rod barrel in a first direction;

means for rotating each of the rods separately from the rod barrel in a second direction opposite the first direction, and wherein a material being contacted by the rods during use of the material treatment device rolls away from the contacted rod in the second direction.

2. The device of claim 1, wherein the rods are arranged so as to form one of a square barrel shape, a rectangular barrel shape, a triangular barrel shape, an oval barrel shape, a crescent barrel shape or a cylindrical barrel shape.

3. The device of claim 1, wherein two, four, six, or twelve rods are employed.

4. The device of claim 1, further comprising means to pass heated or cooled air into one or more of the plurality of rods or through the rod barrel.

5. The device of claim 1, wherein a surface of one or more of the rods is textured.

6. The device of claim 5, wherein a surface of one or more of the rods has a spiral texture or a stippled texture.

7. The device of claim 1, wherein each rod is coated with a non-stick coating.

8. The device of claim 7, wherein the non-stick coating is PTFE.

9. The device of claim 1, further comprising a cage attached to a distal end of each of the plurality of rods, the cage preventing material from getting between the plurality of rods from the distal ends thereof.

10. The device of claim 9, wherein the cage further comprises a plurality of legs, one end of each leg rotatably attached to a distal end of each rod and the other ends of the plurality of legs joined together to prevent the material from getting between the plurality of rods from the distal ends thereof.

11. The device of claim 1, wherein the rod barrel includes bristles fixed thereto such that the bristles rotate with the rod barrel, the bristles extending through and beyond spaces between adjacent rods so as to contact material being treated by the device.

12. The device of claim 1, further comprising a cap mounted at a distal end of the device, the cap configured to remain stationary when the rod barrel rotates.

13. The device of claim 1, further comprising a cap mounted to the rod barrel and including means to allow the cap to rotate with the rod barrel.

14. The device of claim 13, wherein the cap is configured to inhibit hair from traveling over an outer cap surface and/or to allow hair to slide off the outer cap surface if hair comes into contact with the outer cap surface.

15. The device of claim 1, wherein a speed of rotation of each of the rods is greater than a speed of the rotation of the rod barrel.

16. A method of engaging a material comprising:

providing the device of claim 1; and rotating the rod barrel and rods so that the rods can engage the material.

17. The method of claim 16, wherein the material being engaged is hair.

18. The method of claim 17, wherein the hair is human or animal.

* * * * *